US012116752B2

(12) United States Patent
Yoshida et al.

(10) Patent No.: US 12,116,752 B2
(45) Date of Patent: Oct. 15, 2024

(54) WORKING MACHINE

(71) Applicant: KUBOTA CORPORATION, Osaka (JP)

(72) Inventors: Kenichiro Yoshida, Osaka (JP); Takayoshi Takata, Osaka (JP); Tetsuya Yoshida, Osaka (JP); Kengo Miyazaki, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 34 days.

(21) Appl. No.: 18/200,840

(22) Filed: May 23, 2023

(65) Prior Publication Data

US 2023/0315140 A1 Oct. 5, 2023

Related U.S. Application Data

(63) Continuation of application No. PCT/JP2021/042394, filed on Nov. 18, 2021.

(30) Foreign Application Priority Data

Nov. 27, 2020 (JP) ..... 2020-197206
Nov. 27, 2020 (JP) ..... 2020-197207
Jun. 30, 2021 (JP) ..... 2021-109151

(51) Int. Cl.
*E02F 9/20* (2006.01)

(52) U.S. Cl.
CPC ..... *E02F 9/2004* (2013.01)

(58) Field of Classification Search
CPC ..... E02F 9/2004; E02F 3/325; E02F 9/2012; G05G 1/04; G05G 2505/00; G05G 5/005; G05G 1/01
See application file for complete search history.

(56) References Cited

U.S. PATENT DOCUMENTS

2010/0236642 A1 9/2010 Umizaki et al.

FOREIGN PATENT DOCUMENTS

DE 102018112598 A1 * 11/2018 ..... E02F 3/325
EP 989245 A1 * 3/2000 ..... E02F 9/2004
JP 5704034 B2 4/2015

(Continued)

OTHER PUBLICATIONS

International Search Report issued Feb. 8, 2022 in International application No. PCT/JP2021/042394, with English language translation.

(Continued)

*Primary Examiner* — Thomas C Diaz

(74) *Attorney, Agent, or Firm* — GREENBLUM & BERNSTEIN, P.L.C.

(57) ABSTRACT

A lock mechanism that is switchable between a locking state in which a movement of an operation member of a working machine is restricted and an unlocking state includes an engagement portion to rotate together with the operation member, a lock body including an engaged portion at its intermediate portion, a lock support shaft that supports the lock body rotatably, and a driving portion that applies a driving force to the lock body. The lock body is moved by the applied driving force to a position in which the engaged portion is in engagement with the engagement portion and a position in which the engaged portion is not in engagement with the engagement portion.

20 Claims, 32 Drawing Sheets

(56) References Cited

FOREIGN PATENT DOCUMENTS

| | | | |
|---|---|---|---|
| JP | 2018-199916 | A | 12/2018 |
| JP | 2018-199917 | A | 12/2018 |
| JP | 2019-078062 | A | 5/2019 |
| JP | 2019-078063 | A | 5/2019 |
| WO | 2009/017076 | A1 | 2/2009 |

OTHER PUBLICATIONS

Written Opinion issued Feb. 8, 2022 in International application No. PCT/JP2021/042394, with English language translation.
Office Action in Oct. 24, 2023 in family member Japanese application No. 2020-197206 and English translation thereof.

* cited by examiner

WORKING MACHINE

CROSS REFERENCE TO RELATED APPLICATIONS

This application is a continuation application of International Application No. PCT/JP2021/042394, filed on Nov. 18, 2021, which claims the benefit of priority to Japanese Patent Application No. 2020-197206, filed on Nov. 27, 2020, to Japanese Patent Application No. 2020-197207, filed on Nov. 27, 2020, and to Japanese Patent Application No. 2021-109151, filed on Jun. 30, 2021. The entire contents of each of these applications are hereby incorporated herein by reference.

BACKGROUND OF THE INVENTION

1. Field of the Invention

The present invention relates to a working machine such as, for example, a backhoe.

2. Description of the Related Art

A working machine that is provided with a lock mechanism that locks and unlocks (cancels the lock) the motion of an operation member is known in the art. For example, in a working machine disclosed in Japanese Unexamined Patent Application Publication No. 2018-199917, a manipulator base is provided in front of an operator's seat provided on a machine body. An operation member manipulated to operate a traveling device, and operation support shaft supporting the operation member, a lock mechanism, and a lock lever manipulated to operate the lock mechanism are provided on/in the manipulator base. The lock mechanism is made up of an engagement portion that rotates together with the operation member, a lock body that includes a engaged portion (lock pin) that restricts the motion of the operation member by being in engagement with the engagement portion and allows the motion of the operation member by being disengaged from the engagement portion, a lock support shaft that supports the lock body, and a linking mechanism that causes the lock lever and the lock body to operate together in a linked manner.

A working machine disclosed in Japanese Patent No. 5704034 is known. In the working machine, a plurality of fuel devices such as a fuel pre-filter, a fuel pump, and a fuel main filter that are connected to tubes through which fuel flows are attached to an attachment member (bracket). The attachment member is fastened to a side face of a hydraulic fluid tank by means of bolts.

SUMMARY OF THE INVENTION

However, in the technique disclosed in Japanese Unexamined Patent Application Publication No. 2018-199917, the lock body is cantilever-supported by the lock support shaft, and the engaged portion is provided at the free end of the lock body. For this reason, the relative position and relative angle of the engaged portion in relation to the engagement portion are prone to deviate, which might make it impossible to lock and unlock the motion of the operation member by the lock mechanism properly.

Moreover, if the number of constituent parts of the lock mechanism and the number of parts supporting the lock mechanism are large, cumulative dimension errors caused by deformation or wear, etc. of these parts might make it impossible to lock and unlock the motion of the operation member properly.

Furthermore, in the technique disclosed in Japanese Unexamined Patent Application Publication No. 2018-199917, there is a need to pre-fix, to the side face of the tank, bosses, etc. for mounting the attachment member onto the tank by welding or the like. Therefore, there are problems of an increase in steps of working-machine manufacturing work, a need to manage a welding step to ensure that the hydraulic fluid tank will not be deformed, and an increase in the number of parts.

Preferred embodiments of the present invention provide working machines each of which makes it possible to enhance the accuracy of operation of a lock mechanism that locks or unlocks the movement of an operation member.

Preferred embodiments of the present invention provide working machines each of which makes it possible to mount a plurality of devices on a tank easily and properly.

A working machine according to an aspect of the present invention includes: a machine body; an operator's seat provided on the machine body; and a manipulator base provided in front of the operator's seat, the manipulator base including an operation support shaft extending in a width direction of the machine body, an operation member supported such that the operation member is rotatable about an axis of the operation support shaft relative to the operation support shaft, and a lock mechanism switchable between a locking state and an unlocking state, the locking state being a state in which a movement of the operation member is restricted, the unlocking state being a state in which the movement of the operation member is allowed, the lock mechanism including an engagement portion to rotate together with the operation member, a lock body including an engaged portion for engagement with the engagement portion, a lock support shaft supporting one of opposite end portions of the lock body rotatably, and a driving portion to apply a driving force to the other of the opposite end portions of the lock body, wherein the engaged portion is provided at an intermediate portion between the one of the opposite end portions of the lock body and the other of the opposite end portions of the lock body, and the lock body is configured to be rotated about an axis of the lock support shaft by the driving force applied by the driving portion to change in position between an engagement position in which the engaged portion is in engagement with the engagement portion and a disengagement position in which the engaged portion is not in engagement with the engagement portion.

The driving portion may include an interlock portion provided on the operation support shaft and configured to rotate together with the operation support shaft, and a linking member to link the interlock portion to the lock body. The lock body may be connected, at the other of the opposite end portions, to the linking member such that the lock body is rotatable relative to the linking member.

The lock support shaft may be disposed forward of or rearward of the operation support shaft in a front-rear direction of the machine body. The interlock portion may be disposed on the opposite side of the operation support shaft from the lock support shaft in the front-rear direction of the machine body. The lock body and the linking member may be connected to each other at a position higher than or lower than the operation support shaft.

The engagement portion may protrude from a base portion of the operation member outward in a radial direction of the operation support shaft and has an engagement groove extending from a distal end of the engagement portion toward the operation support shaft. The interlock portion may protrude upward and outward in a radial direction of the operation support shaft. The linking member may be disposed higher than the operation support shaft. The lock support shaft may be disposed lower than the operation support shaft and substantially in parallel to the operation support shaft. The lock body may be configured to swing about the axis of the lock support shaft forward and rearward. The engaged portion may include a lock pin that protrudes in the width direction of the machine body from the intermediate portion of the lock body and is configured to be engaged with and disengaged from the engagement groove.

The manipulator base may include a lock lever changeable in position between a first position and a second position, the first position being a position in which an operator is allowed to get on and off the working machine via a passage between the operator's seat and the manipulator base, the second position being a position in which the operator is prevented from getting on and off the working machine. The driving portion may transmit a manipulation force for changing the position of the lock lever as the driving force to the other of the opposite end portions of the lock body to cause the lock body to rotate about the axis of the lock support shaft.

The driving portion may include an actuator to generate the driving force.

The working machine further includes: a working device supported in front of the machine body; and a traveling device supporting the machine body such that the machine body is allowed to travel. The manipulator base may include a plurality of levers to be manipulated to operate the working device and the traveling device, respectively. The operation member may be a traveling lever to be manipulated to operate the traveling device, the traveling lever being one of the plurality of levers.

A working machine according to an aspect of the present invention includes: a machine body; and a manipulator base provided on the machine body, the manipulator base including a first shaft extending in a width direction of the machine body, a first operation member supported such that the first operation member is rotatable about an axis of the first shaft relative to the first shaft, a lock mechanism switchable between a locking state and an unlocking state, the locking state being a state in which a movement of the first operation member is restricted, the unlocking state being a state in which the movement of the first operation member is allowed, a second shaft provided in parallel to the first shaft, and a second operation member supported such that the second operation member is rotatable about an axis of the second shaft relative to the second shaft, wherein the lock mechanism includes an engagement portion to rotate together with the first operation member, a lock body including an engaged portion for engagement with the engagement portion, and a driving portion to apply a driving force to the lock body, the second shaft supports the lock body such that the lock body is rotatable relative to the second shaft, and the lock body is configured to be rotated about an axis of the second shaft relative to the second shaft by the driving force applied by the driving portion to change in position between an engagement position in which the engaged portion is in engagement with the engagement portion and a disengagement position in which the engaged portion is not in engagement with the engagement portion.

The manipulator base may further include: a plurality of third operation members to be manipulated to operate a respective plurality of objects, and an operation switching mechanism to switch the objects to be operated by the respective plurality of third operation members. The operation switching mechanism may include a third shaft provided in parallel to the first shaft between the first shaft and the second shaft, a plurality of rotary members supported such that the plurality of rotary members are rotatable about an axis of the third shaft relative to the third shaft, and a plurality of link members each of which is rotatably connected to one of the plurality of third operation members and one of the plurality of rotary members in a selectable manner. The lock body may extend from the second shaft to the first shaft via an area located radially outward of one of the plurality of rotary members.

The driving portion may include an interlock portion provided on the first shaft and configured to rotate together with the first shaft, and a linking member connected to the interlock portion and the lock body such that the linking member is rotatable relative to the interlock portion and the lock body. A junction of the interlock portion and the linking member may be more distant from the second shaft than the engaged portion of the lock body is. A junction of the lock body and the linking member may be closer to the second shaft than the engaged portion of the lock body is.

The engagement portion may protrude from a base portion of the first operation member outward in a radial direction of the first shaft and has an engagement groove extending from a distal end of the engagement portion toward the first shaft. The interlock portion may protrude upward and outward in a radial direction of the first shaft. The linking member may extend from an area above the first shaft to an area below the first shaft via an area radially outward of the first shaft. The second shaft is disposed lower than the first shaft. The lock body may be configured to swing about the axis of the second shaft forward and rearward. The engaged portion may include a lock pin that protrudes in the width direction of the machine body from an upper end portion of the lock body and is configured to be engaged with and disengaged from the engagement groove.

The manipulator base may further include: an arm protrusion portion protruding outward in a radial direction of the first shaft from a position different from a position of the engagement portion on the base portion of the first operation member, a joint rotatably connected to the arm protrusion portion, a rod having one of opposite ends thereof connected to a spool of a control valve, and a relay member including a first threaded connected portion and a second threaded connected portion, the first threaded connected portion being in threaded engagement with a first threaded connecting portion in the joint, the second threaded connected portion being in threaded engagement with a second threaded connecting portion in the other of the opposite ends of the rod. One of first and second threaded engagement structures may have right hand threads and the other of the first and second threaded engagement structures may have left hand threads, the first threaded engagement structure being a threaded engagement structure between the first threaded connecting portion and the first threaded connected portion, the second threaded engagement structure being a threaded engagement structure between the second threaded connecting portion and the second threaded connected portion.

The lock body may further include a cavity portion in which one of the plurality of rotary members enters without contacting the lock body when the lock body is in the engagement position.

The manipulator base may further include a lock lever to be swung between a first position and a second position. The driving portion may transmit a force of swinging the lock lever as the driving force to the lock body to cause the lock body to change in position between the engagement position and the disengagement position.

The driving portion may include an actuator to generate the driving force.

The working machine may further include: a traveling device to support the machine body such that the machine body is allowed to travel; and a working device and a dozer device which are supported on the machine body. The manipulator base may further include a plurality of levers to be manipulated to operate the traveling device, the working device, and the dozer device, respectively. The first operation member may be a traveling lever to be manipulated to operate the traveling device, the second operation member is a dozer lever to be manipulated to operate the dozer device, and the third operation member may be a manipulation lever to be manipulated to operate the working device, the traveling lever, the dozer lever, and the manipulation lever being included in the plurality of levers.

The working device may include a boom rotatably connected to the machine body, and an arm rotatably connected to a distal end portion of the boom. The third operation member may include a plurality of manipulation levers to be manipulated to operate the boom and the arm, respectively. The operation switching mechanism may be configured to use each of the plurality of manipulation levers selectively as a boom operation lever manipulated to operate the boom or an arm operation lever manipulated to operate the arm.

A working machine according to an aspect of the present invention includes: a machine body; a tank provided inside the machine body and containing a liquid; a cover mounted detachably to the tank and closing an opening of the tank; and an attachment member to which a plurality of devices is attached, wherein the attachment member is integral with the cover.

The cover may include four or more through holes formed at predetermined intervals along a peripheral portion of the cover, and fixed to the tank by means of fastening members inserted respectively through the through holes.

The working machine may include a working device supported on the machine body; and the tank is a hydraulic fluid tank containing a hydraulic fluid for causing the working device to operate or a fuel tank containing fuel.

The plurality of devices may include devices provided on different piping/wiring systems.

The working machine may further include: an electric path through which a current flows; and a fluid path through which a fluid flows The plurality of devices may include a first device provided on the electric path and a second device provided on the fluid path, and the first device and the second device are attached to the attachment member.

The working machine may further include: a prime mover that is an engine mounted in the machine body, wherein the fluid path includes a fuel path through which fuel is supplied to the prime mover, the second device may include a fuel device provided on the fuel path, the first device may include an electric device through which the current flowing through the electric path flows, and the fuel device and the electric device may be attached to the attachment member.

At least one of a fuel pump and a fuel filter that are included in the fuel device may be attached to the attachment member.

The electric device may include an isolator that shuts off current flow through the electric path and a fuse box in which a built-in fuse that prevents overcurrent flow through the electric path is provided, and at least one of them may be attached to the attachment member.

The fluid path may include a cooling fluid path through which a cooling fluid flows, a cooling device provided on the cooling fluid path includes a reserve tank containing the cooling fluid, and the attachment member may restrict the reserve tank in at least one direction.

The plurality of devices may include two or more kinds of device among an electric device provided on an electric path through which a current flows, a fuel device provided on a fuel path through which fuel flows, a hydraulic device provided on a hydraulic fluid path through which a hydraulic fluid flows, and a cooling device provided on a cooling fluid path through which a cooling fluid flows.

The attachment member may include a plurality of supporting portions supporting the plurality of devices and restricting them in at least one direction, and the supporting portions may include a hose supporting portion for a hose connected to the device provided on the fluid path.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
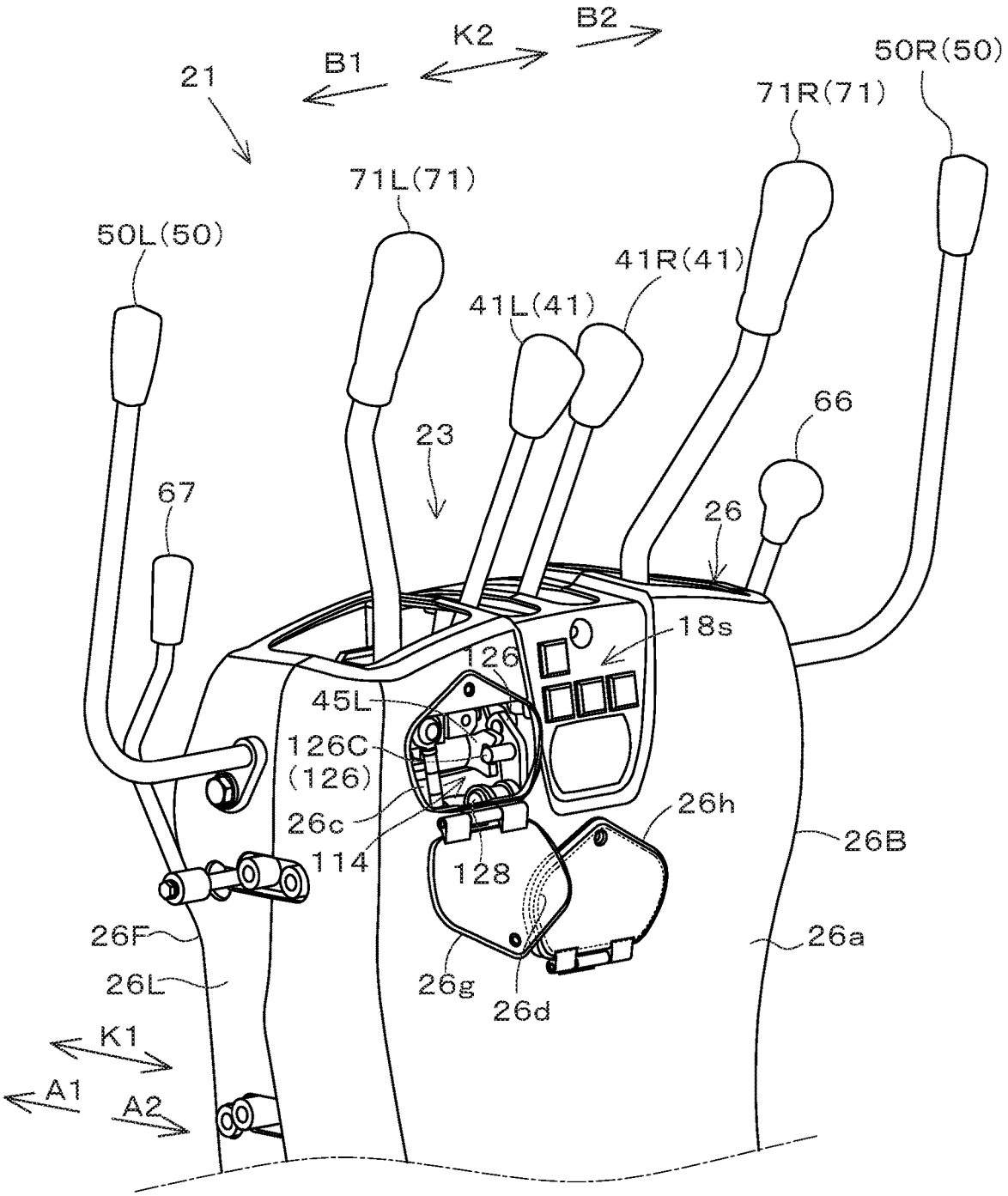
FIG. 1 is a rear perspective view of an upper portion of a manipulator base according to a first embodiment.

The preferred embodiments will now be described with reference to the accompanying drawings, wherein like reference numerals designate corresponding or identical elements throughout the various drawings. The drawings are to be viewed in an orientation in which the reference numerals are viewed correctly.

An embodiment of the present invention will now be described while referring to the drawings, where necessary.

First, an overall configuration of a working machine 1 according to the present embodiment will now be described.

Figure 24:
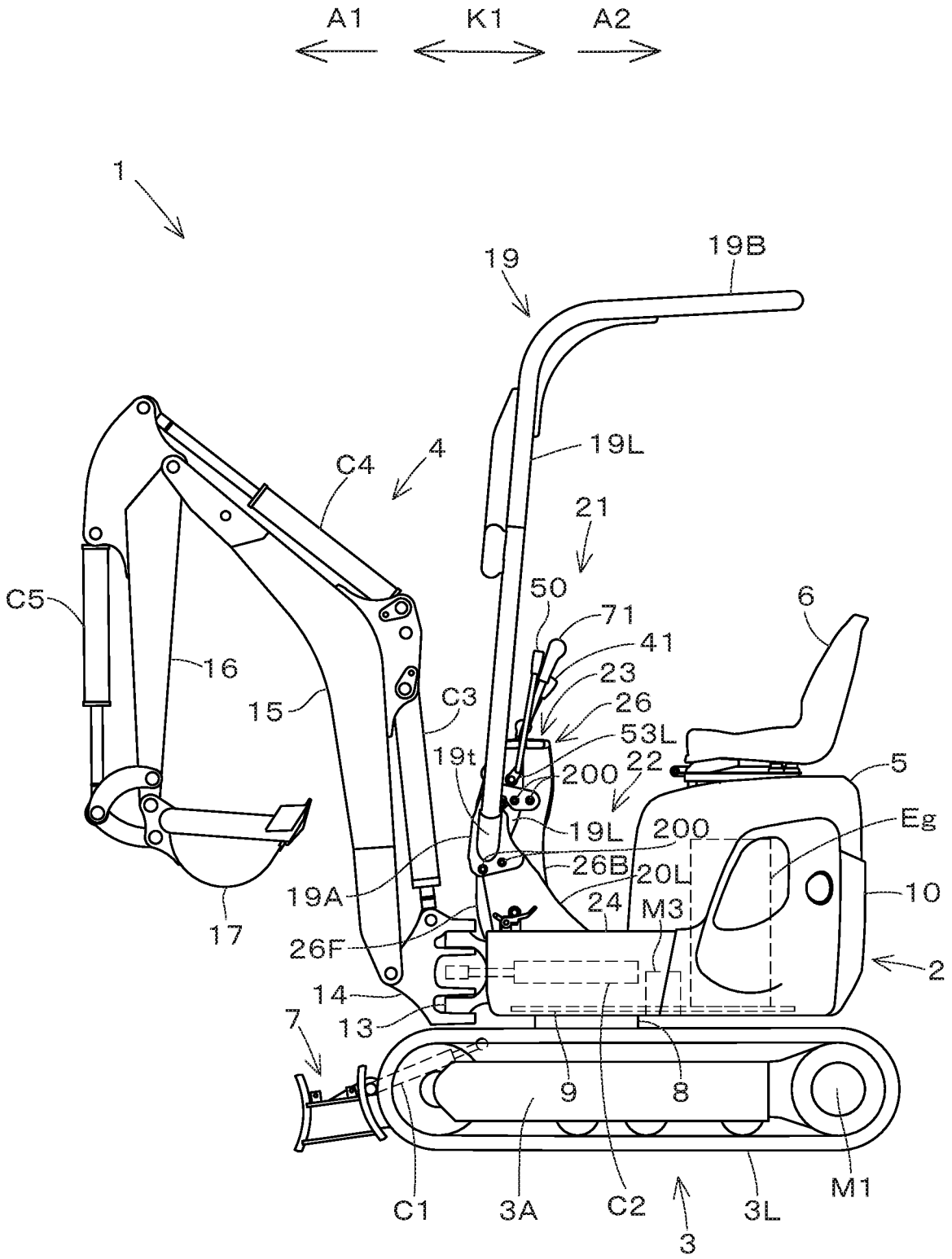
FIG. 24 is a side view of a working machine.
Figure 25:
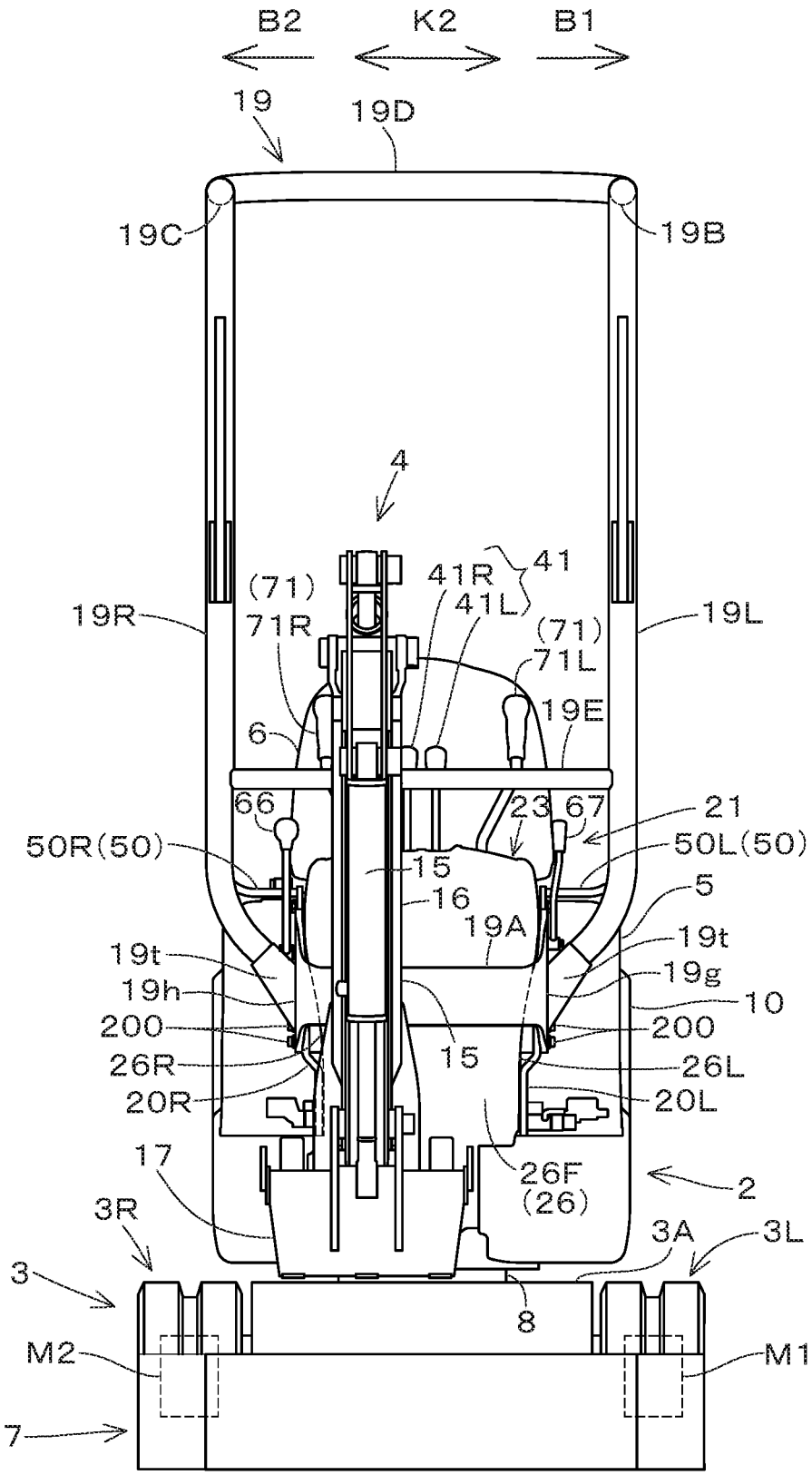
FIG. 25 is a front view of a working machine.
Figure 26:
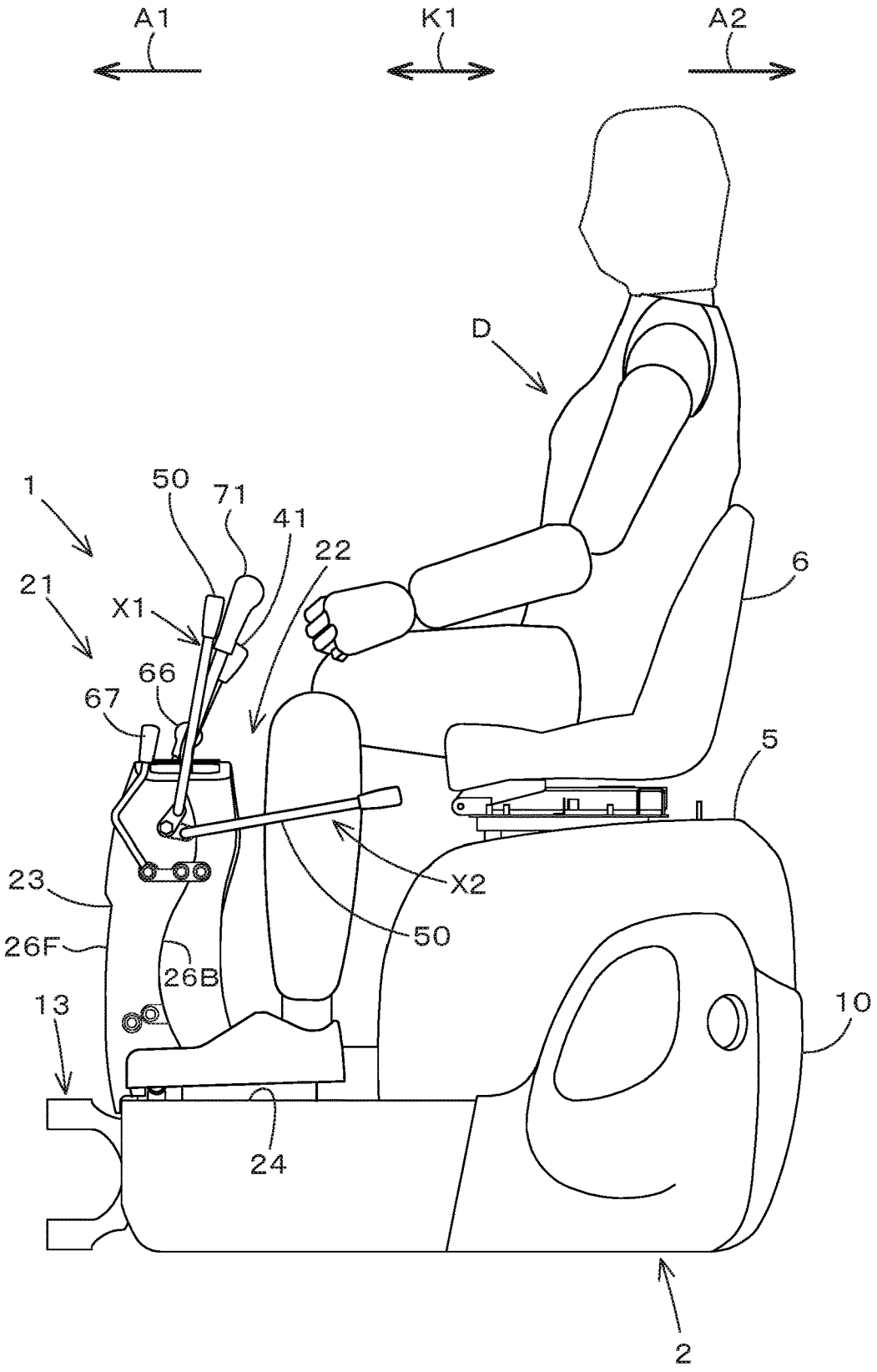
FIG. 26 is a side view of an upper portion of the working machine.
Figure 27:
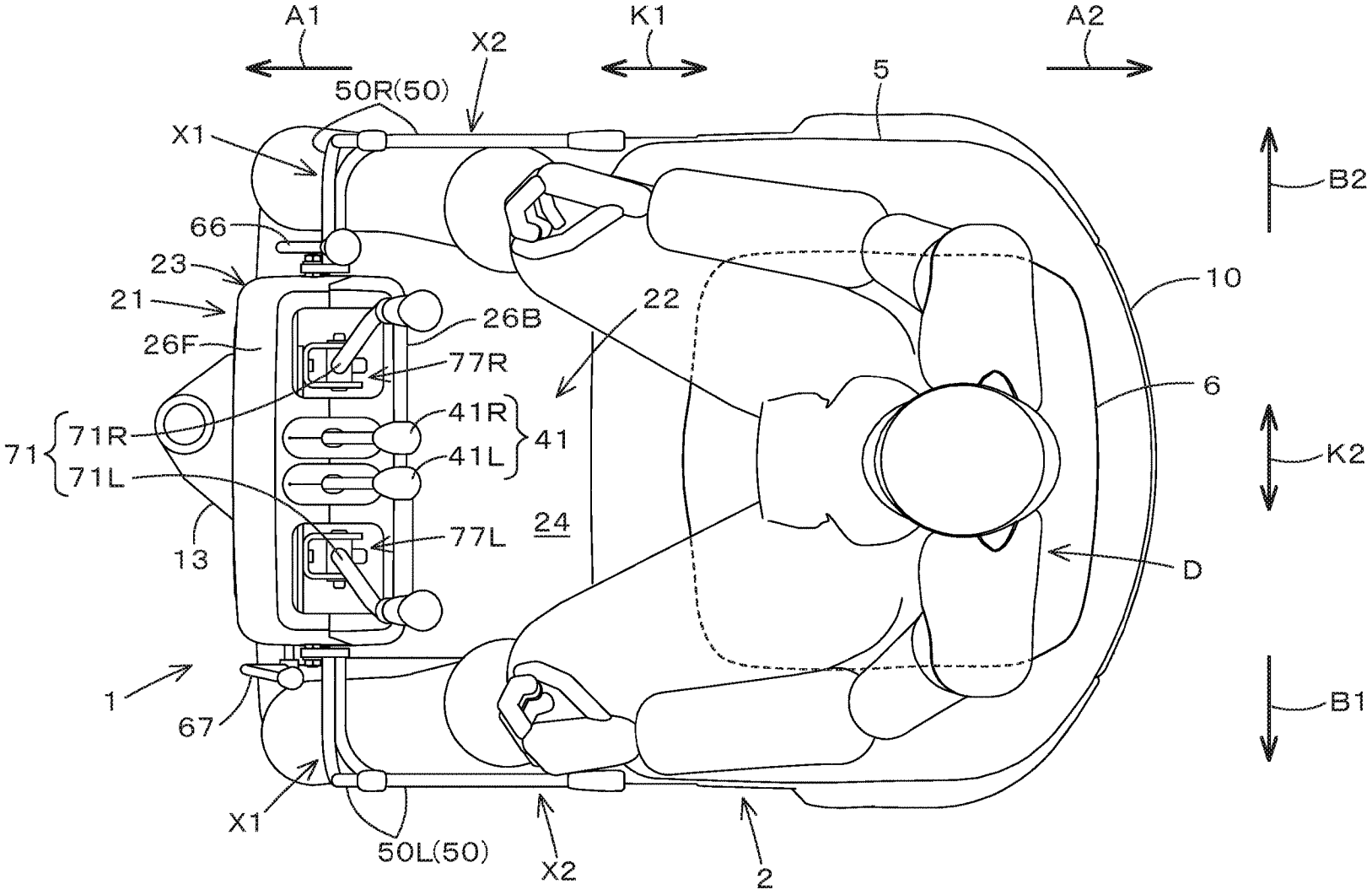
FIG. 27 is a plan view of the upper portion of the working machine.

FIG. 24 is a schematic side view illustrating the overall configuration of the working machine 1. FIG. 25 is a schematic front view of the working machine 1. FIG. 26 is a schematic side view of an upper portion of the working machine 1. FIG. 27 is a schematic plan view of the upper portion of the working machine 1. In the present embodiment, a backhoe, which is a swiveling working machine, will be taken as an example of the working machine 1.

As illustrated in FIG. 24, the working machine 1 includes a machine body (swivel base) 2, a traveling device 3, a working device 4, and the like. An operator's seat 6, on which an operator D (see FIGS. 26 and 27) is to sit, is mounted on the machine body 2.

In the present embodiment, a direction toward an area located in front of the operator D seated on the operator's seat 6 of the working machine 1 (the direction indicated by an arrow A1 in FIGS. 24 and 26) will be described as "forward", a direction toward an area located behind the operator D (the direction indicated by an arrow A2 in FIGS. 24 and 26) will be described as "rearward", a direction toward an area located to the left of the operator D (the direction indicated by an arrow B1 in FIGS. 25 and 27) will be described as "leftward", and a direction toward an area located to the right of the operator D (the direction indicated by an arrow B2 in FIGS. 25 and 27) will be described as "rightward".

A horizontal direction orthogonal to a front-rear direction K1 will be referred to as "machine-body width direction" K2 (width direction of the machine body 2, going leftward and rightward) (see FIGS. 25 and 27). In addition, the direction going rightward or leftward from the center of the machine body 2 will be described as "outward with respect to the machine body". In other words, "outward with respect to the machine body" means a direction that is the machine-body width direction K2 and goes leftward or rightward away from the center of the machine body 2. The direction that is the opposite of "outward with respect to the machine body" will be described as "inward with respect to the machine body". In other words, "inward with respect to the machine body" means a direction that is the machine-body width direction K2 and comes closer to the center of the machine body 2 from the left or from the right.

As illustrated in FIGS. 24 and 25, the traveling device 3 is a device that supports the machine body 2 to make it travelable. The traveling device 3 includes a traveling frame 3A, a first traveling device 3L provided on the left side of the traveling frame 3A, and a second traveling device 3R provided on the right side of the traveling frame 3A (FIG. 25). The first traveling device 3L and the second traveling device 3R are crawler-type traveling devices. The first traveling device 3L is driven by a first traveling motor (traveling motor) M1. The second traveling device 3R is driven by a second traveling motor (traveling motor) M2. The first traveling motor M1 and the second traveling motor M2 are hydraulic motors (hydraulic actuators).

As illustrated in FIG. 24, a dozer device 7 is mounted on the front portion of the traveling device 3. The dozer device 7 can be raised and lowered (blade up/down operation) by extending-and-retracting motion of a dozer cylinder C1 (hydraulic actuator).

The machine body 2 is supported on the traveling frame 3A, with a swivel bearing 8 provided therebetween, in such a way as to be able to swivel around a vertical axis (an axis extending in the vertical direction). The machine body 2 is driven in a swiveling direction by a swiveling motor M3, which is a hydraulic motor (hydraulic actuator). The machine body 2 includes a base board 9 that swivels around a vertical axis (hereinafter referred to as "swivel base board"), and a weight 10. The swivel base board 9 is made of a steel plate or the like and is coupled to the swivel bearing 8. The weight 10 is provided on the rear portion of the machine body 2.

A prime mover Eg is mounted in the rear portion of the machine body 2. The prime mover Eg is a diesel engine. The prime mover Eg may be a gasoline engine, an LPG engine, an electric motor, or the like. The prime mover Eg may be a hybrid-type prime mover that includes an engine and an electric motor. The prime mover Eg is covered by a hood 5. The operator's seat 6 is provided on the hood 5.

As illustrated in FIG. 27, the center of the operator's seat 6 in the machine-body width direction K2 lies at substantially the same position as the center of the hood 5 in the machine-body width direction K2. Both sides (the left-side portion and the right-side portion) of the hood 5 in the machine-body width direction K2 are located outside, and thus do not overlap with, the operator's seat 6 outward with respect to the machine body.

A support bracket 13 is provided on the front portion of the machine body 2. The support bracket 13 is provided at a position that is slightly to the right of the center in the machine-body width direction K2. As illustrated in FIG. 24, a swing bracket 14 is mounted on the support bracket 13 in such a way as to enable swing motion around a vertical axis. The working device 4 is mounted on the swing bracket 14. That is, the working device 4 is supported on the front portion of the machine body 2. Although the working device 4 is illustrated also in FIG. 25, in order to facilitate the readers' understanding, the position of each component of the working device 4 in the height direction in FIG. 25 is illustrated to be different from that of FIG. 24.

As illustrated in FIG. 24, the working device 4 includes a boom 15, an arm 16, and a bucket (working tool) 17. The proximal portion of the boom 15 is pivotally mounted on the swing bracket 14 in such a way as to be able to rotate around a horizontal axis (an axis extending in the machine-body width direction K2). This structure enables the boom 15 to pivot up and down. The arm 16 is pivotally connected to a distal end of the boom 15 in such a way as to be able to rotate around a horizontal axis. This structure enables the arm 16 to pivot forward/rearward or up/down.

The bucket 17 is provided on a distal end of the arm 16 in such a way as to be able to perform shoveling operation and dumping operation. In addition to or in place of the bucket 17, other kind of working tool (hydraulic attachment) that can be driven by a hydraulic actuator can be attached to the working machine 1. Some examples of such other kind of working tool include: a hydraulic breaker, a hydraulic crusher, an angle broom, an earth auger, a pallet fork, a sweeper, a mower, and a snow blower.

The swing bracket 14 is capable of moving pivotally by extending-and-retracting motion of a swing cylinder C2 provided inside the machine body 2. The boom 15 is capable of moving pivotally by extending-and-retracting motion of a boom cylinder C3. The arm 16 is capable of moving pivotally by extending-and-retracting motion of an arm cylinder C4. The bucket 17 is capable of performing shoveling operation and dumping operation by extending-and-retracting motion of a bucket cylinder (working tool cylinder) C5.

The dozer cylinder C1, the swing cylinder C2, the boom cylinder C3, the arm cylinder C4, and the bucket cylinder C5 are hydraulic cylinders (hydraulic actuators). The boom cylinder C3, the arm cylinder C4, and the bucket cylinder C5 are work hydraulic actuators for driving the working device 4.

The working machine 1 is equipped with a manipulator 21 for manipulating the working machine 1. The manipulator 21 includes a manipulator base 23. The manipulator base 23 is provided on the machine body 2 behind (A2) the working device 4 and in front of (A1) the operator's seat 6 and the hood 5.

A passage 22 is provided between the manipulator base 23 and the operator's seat 6 and the hood 5. The passage 22 is formed on a floor portion 24 between the manipulator base 23 and the hood 5, with a predetermined distance therebetween. The passage 22 is open to the left and right of the machine body 2 and is thus passable (a walk-through passage) in the machine-body width direction K2. Therefore, the operator D is able to get on and off the working machine 1 to sit on and leave the operator's seat 6 via the passage 22 from the left open end or the right open end of the working machine 1.

The manipulator base 23 includes a cover 26. The cover 26 includes a first cover 26F, which is provided at a position closer to the working device 4 (a front position A1), and a second cover 26B, which is provided at a position closer to the operator's seat 6 (a rear position A2).

Next, a first embodiment will now be described.

Figure 2:
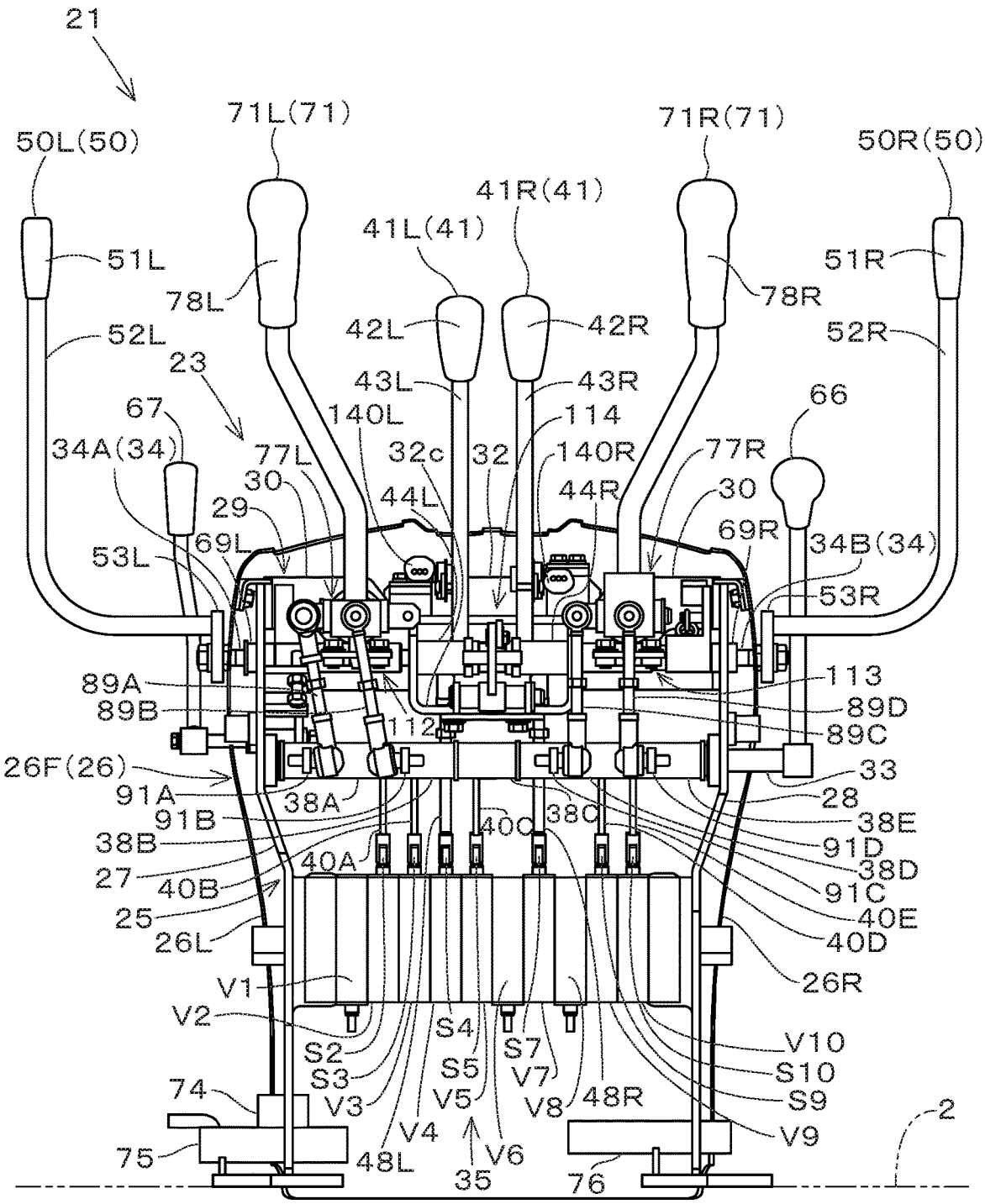
FIG. 2 is a rear view of an inner structure of the manipulator base according to the first embodiment.

FIG. 1 is a perspective view of an upper portion of the manipulator base 23 viewed obliquely from behind (A2) (from the side where the operator's seat 6 is located in FIGS. 24 to 27). FIG. 2 is a rear view of an inner structure of the manipulator base 23 (viewed from the side where the operator's seat 6 is located in FIGS. 24 to 27). Both the first cover 26F and the second cover 26B are shown in FIG. 1, whereas a state in which the second cover 26B has been removed is illustrated in FIG. 2.

As illustrated in FIGS. 1 and 24, etc., the first cover 26F and the second cover 26B are combined together in the front-rear direction K1 to constitute a housing of the manipulator base 23. The cover 26 encloses inner components provided inside the manipulator base 23 such as those illustrated in FIG. 2, etc.

As illustrated in FIG. 2, a support frame 25 forming the skeleton of the manipulator base 23 is included in the inner structure of the manipulator base 23. The first cover 26F and the second cover 26B are fixed to the support frame 25 by means of fastening members (not illustrated) such as bolts and nuts.

As illustrated in FIG. 1, a plurality of windows 26*c* and 26*d* is provided in a rear surface 26*a* of the second cover 26B of the manipulator base 23. Each of the windows 26*c* and 26*d* is a through hole having a predetermined size. A lid 26*g*, 26*h* that can be opened and closed due to a hinge structure is provided on each window 26*c*, 26*d*. In FIG. 1, a state in which the lid 26*g* has been opened to open the window 26*c* and the lid 26*h* has been closed to close the window 26*d* is illustrated. As illustrated in FIG. 1, it is possible to make a part or the whole of a lock mechanism 114, which will be described later, exposed by opening the window 26*c*. In addition, electrical components 18*s* such as various warning lamps are provided on the rear surface 26*a* of the second cover 26B.

As illustrated in FIGS. 24 and 25, a protection member (ROPS) 19 is mounted on the manipulator base 23. The protection member 19 has a function of protecting the operator D seated on the operator's seat 6. The protection member 19 includes a mount portion 19A, vertical portions 19L and 19R, horizontal portions 19B and 19C, and connecting portions 19D and 19E. In FIGS. 26 and 27, for simple illustration, the protection member 19 is not illustrated.

As illustrated in FIG. 25, the mount portion 19A is disposed continuously at a position in front of (A1), to the left of, and to the right of the first cover 26F. There is a support plate 20L between a left side portion 19*g* of the mount portion 19A and a left sidewall 26L of the first cover 26F. There is a support plate 20R between a right side portion 19*h* of the mount portion 19A and a right sidewall 26R of the first cover 26F. Each of the support plate 20L and the support plate 20R is provided upright on the machine body 2.

The left side portion 19*g* of the mount portion 19A is fixed to the support plate 20L and a first vertical member 27 (FIG. 2) of the support frame 25 by means of fastening members 200. The right side portion 19*h* of the mount portion 19A is fixed to the support plate 20R and a second vertical member 28 (see FIG. 2) of the support frame 25 by means of fastening members 200. The fastening members 200 extend through the two sidewalls 26L and 26R of the first cover 26F respectively. The two sidewalls 26L and 26R of the first cover 26F may be fixed to the two side portions 19*g* and 19*h* of the mount portion 19A and to the support plates 20L and 20R. The two sidewalls 26L and 26R of the first cover 26F may be not fixed thereto.

As illustrated in FIGS. 24 and 25, the vertical portions 19L and 19R extend up from the two side portions 19*g* and 19*h* of the mount portion 19A respectively. The horizontal portions 19B and 19C extend rearward (A2) from the top ends of the vertical portions 19L and 19R respectively. The rear ends of the horizontal portions 19B and 19C are connected to each other by the connecting portion 19D extending in the machine-body width direction K2. The vertical portions 19L and 19R are connected to each other by the connecting portion 19E extending in the machine-body width direction K2.

The mount portion 19A is disposed in front of (A1) the first cover 26F but is not disposed behind (A2) the second cover 26B. Therefore, although the second cover 26B is detachable in a state in which the protection member 19 is mounted as illustrated in FIGS. 24 and 25, the first cover 26F is not detachable.

Next, the configuration and structure of the manipulator 21 will now be explained.

Figure 3:
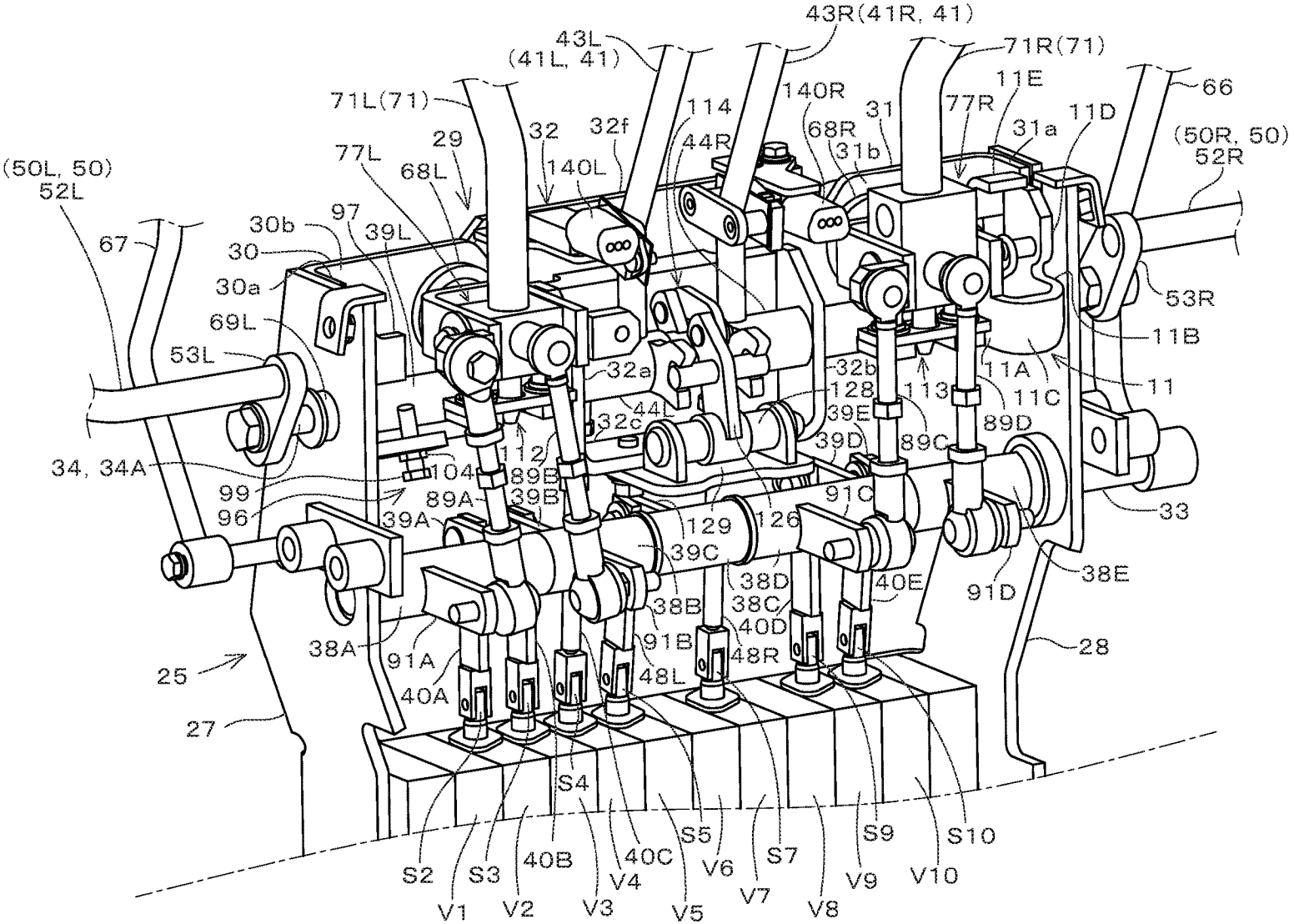
FIG. 3 is a rear perspective view of the upper portion of the inner structure of the manipulator base according to the first embodiment.
Figure 4:
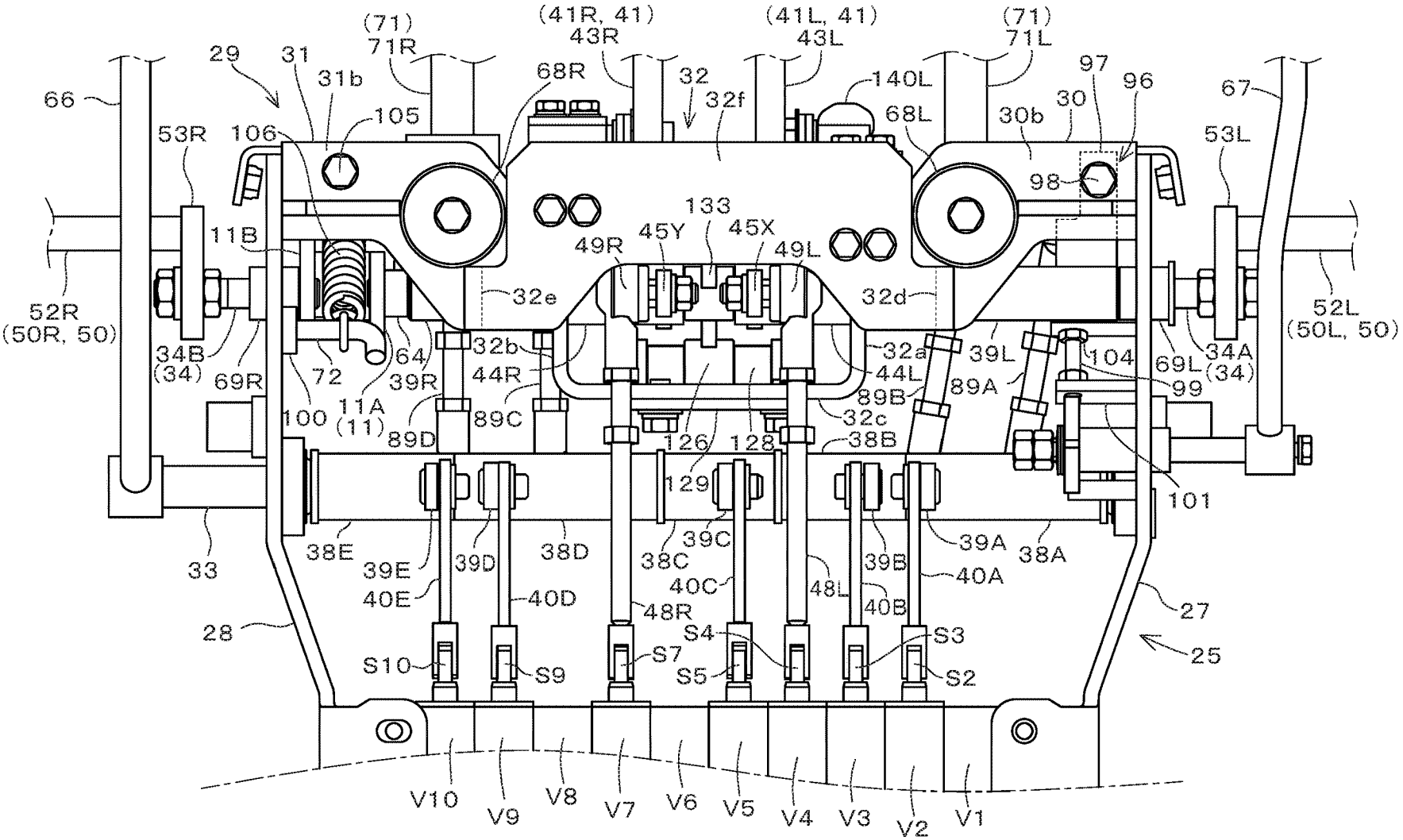
FIG. 4 is a front view of the upper portion of the inner structure of the manipulator base according to the first embodiment.
Figure 5:
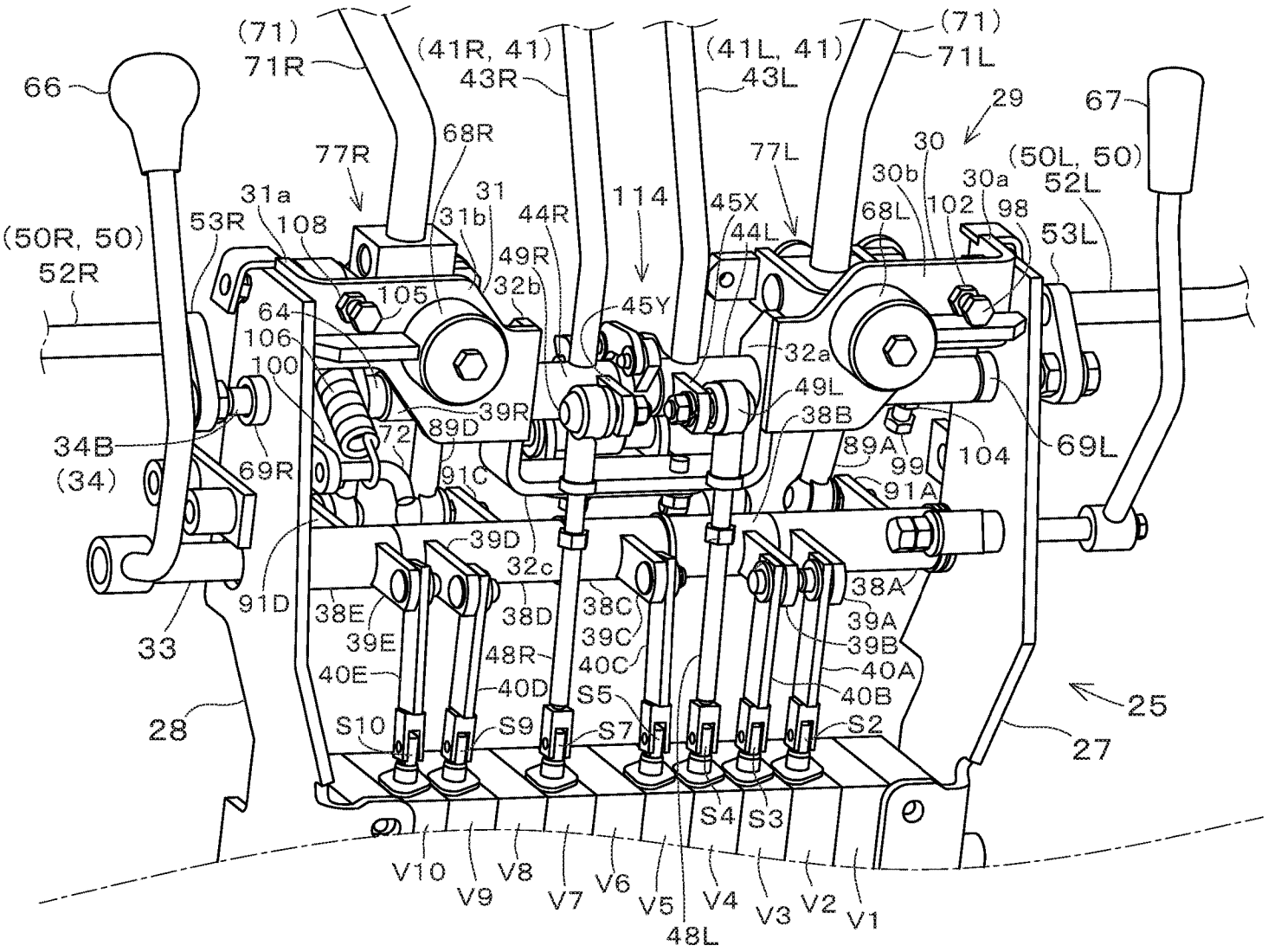
FIG. 5 is a front perspective view of the upper portion of the inner structure of the manipulator base according to the first embodiment.
Figure 6:
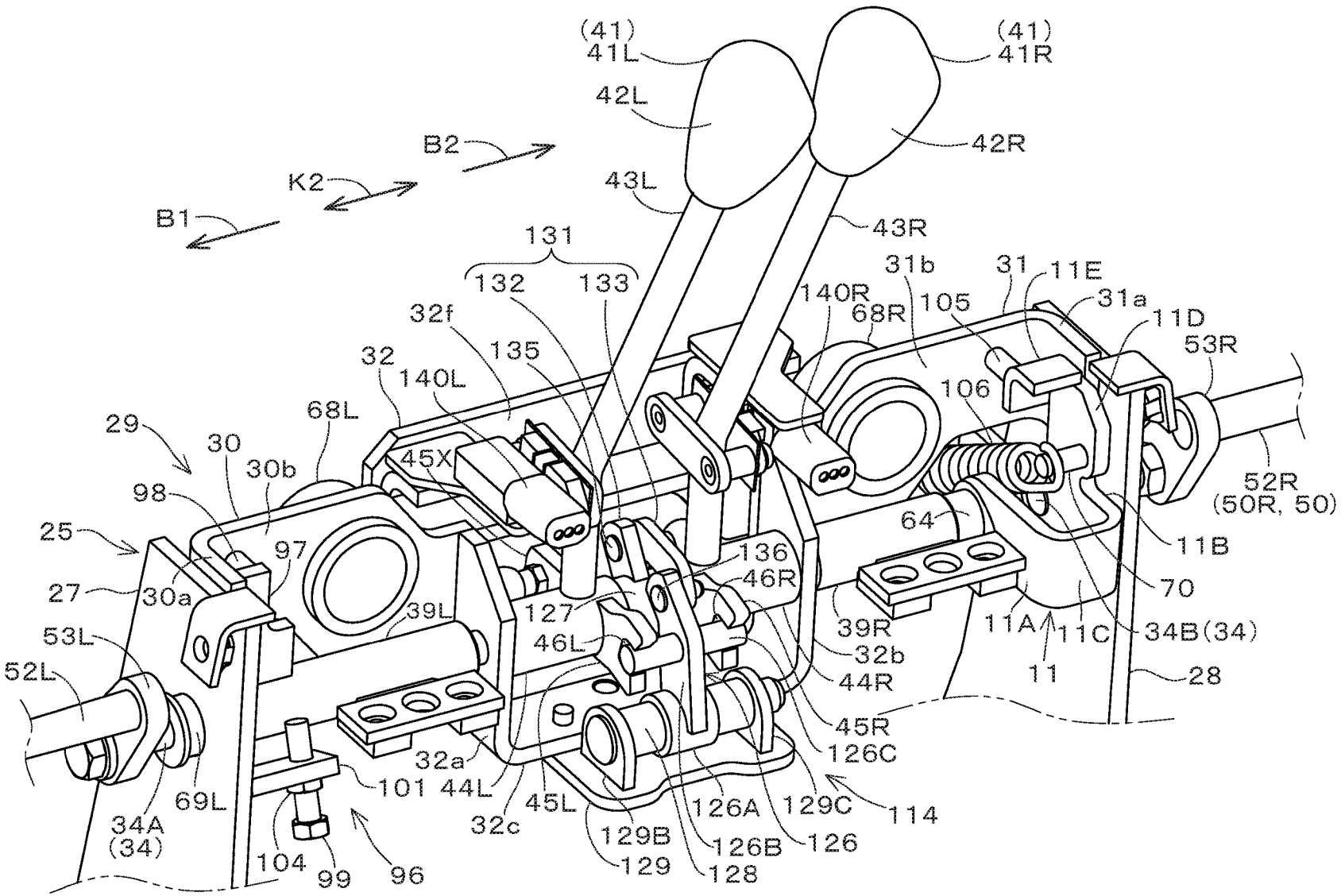
FIG. 6 is a rear perspective view of an upper portion of a support frame according to the first embodiment.

FIG. 3 is a perspective view of an upper portion of the inner structure of the manipulator base 23 viewed obliquely from behind (from the side where the operator's seat 6 is located). FIG. 4 is a front view of the upper portion of the inner structure of the manipulator base 23. FIG. 5 is a perspective view of the upper portion of the inner structure of the manipulator base 23 viewed obliquely from ahead of the machine body 2 (from the side where the working device 4 is located). FIG. 6 is a rear perspective view of an upper portion of the support frame 25.

As illustrated in FIGS. 2 to 6, the support frame 25 of the manipulator base 23 includes the first vertical member 27, which is a left portion thereof, the second vertical member 28, which is a right portion thereof, and a connecting body 29, which connects these two vertical members 27 and 28 to each other. The first vertical member 27 and the second vertical member 28 have a plate shape. The first vertical member 27 and the second vertical member 28 are provided upright on the machine body 2, with their respective plate surfaces oriented in the machine-body width direction K2. The first vertical member 27 and the second vertical member 28 face each other, with a predetermined distance therebetween in the machine-body width direction K2.

The connecting body 29 is provided between an upper portion of the first vertical member 27 and an upper portion of the second vertical member 28. The connecting body 29 includes a first connecting member 30, a second connecting member 31, and a third connecting member 32.

The first connecting member 30 is connected to the upper portion of the first vertical member 27. The second connecting member 31 is connected to the upper portion of the second vertical member 28. The first connecting member 30 and the second connecting member 31 are provided at a distance from each other in the machine-body width direction K2. The third connecting member 32 connects the first connecting member 30 and the second connecting member 31 to each other.

As illustrated in FIG. 6, etc., the first connecting member 30 is disposed at a position closer to the second vertical member 28 than the first vertical member 27 is to the second vertical member 28, and is connected to the first vertical member 27. The first connecting member 30 includes a first wall 30*a* and a second wall 30*b*. The first wall 30*a* is fixed along the first vertical member 27. A first bushing 69L is disposed below the first wall 30*a*. The first bushing 69L is provided through the first vertical member 27 and has an axis extending in the machine-body width direction K2.

The second wall 30*b* extends from the front end portion of the first wall 30*a* inward with respect to the machine body. A first support sleeve 68L is provided through the second wall 30*b*. The first support sleeve 68L has an axis extending in the front-rear direction K1.

The second connecting member 31 is disposed at a position closer to the first vertical member 27 than the second vertical member 28 is to the first vertical member 27, and is connected to the second vertical member 28. The second connecting member 31 includes a first wall 31*a* and a second wall 31*b*. The first wall 31*a* is fixed along the second vertical member 28. As illustrated in FIGS. 4 and 5, a second bushing 69R is disposed below the first wall 31*a*. The second bushing 69R is provided through the second vertical member 28 and has an axis extending in the machine-body width direction K2.

The second wall 31*b* extends from the front end portion of the first wall 31*a* inward with respect to the machine body. A second support sleeve 68R is provided through the second wall 31*b*. The second support sleeve 68R has an axis extending in the front-rear direction K1.

As illustrated in FIG. 6, the third connecting member 32 includes a first wall portion 32*a*, a second wall portion 32*b*, and a lower base portion 32*c* provided rearward of (closer to the operator's seat 6) the first connecting member 30 and the second connecting member 31. The first wall portion 32*a* is fixed in such a way as to protrude rearward from the rear face of the right end portion of the second wall 30*b* of the first connecting member 30. The second wall portion 32*b* is fixed in such a way as to protrude rearward from the rear face of the left end portion of the second wall 31*b* of the second connecting member 31. The first wall portion 32*a* and the second wall portion 32*b* protrude down in relation to the first connecting member 30 and the second connecting member 31. The lower base portion 32*c* connects the lower end portion of the first wall portion 32*a* and the lower end portion of the second wall portion 32*b* to each other. The lower base portion 32*c* has a shape like a plate. Each face of the plate is oriented up/down.

In addition, as illustrated in FIG. 4, the third connecting member 32 includes a third wall portion 32*d*, a fourth wall portion 32*e*, and a front base portion 32*f* provided forward of (closer to the working device 4) the first connecting member 30 and the second connecting member 31. The third wall portion 32*d* is fixed in such a way as to protrude forward from the front surface of the second wall 30*b* of the first connecting member 30. The fourth wall portion 32*e* is fixed in such a way as to protrude forward from the front surface of the second wall 31*b* of the second connecting member 31. The front base portion 32*f* connects the front end portion of the third wall portion 32*d* and the front end portion of the fourth wall portion 32*e* to each other. The front base portion 32*f* has a shape like a plate. Each face of the plate is oriented forward/rearward. In FIG. 5, for simple illustration, the third wall portion 32*d*, the fourth wall portion 32*e*, and the front base portion 32*f* are not illustrated.

The third wall portion 32*d*, the fourth wall portion 32*e*, and the front base portion 32*f* are configured as a discrete structure that is separated from the first wall portion 32*a*, the second wall portion 32*b*, and the lower base portion 32*c* of the third connecting member 32. However, the wall portions 32*a*, 32*b*, 32*d*, and 32*e* and the base portions 32*c* and 32*f* may be formed integrally for the purpose of enhancing the rigidity of the third connecting member 32 and the support frame 25.

An operation support shaft 34 is provided on the upper portion of the support frame 25. The operation support shaft 34 has an axis extending in the machine-body width direction K2. The operation support shaft 34 is supported by the support frame 25 in such a way as to be able to rotate on its axis. The operation support shaft 34 is located above the lower base portion 32*c* of the third connecting member 32.

Base plates 53L and 53R are connected to the two ends of the operation support shaft 34 respectively. As illustrated in FIG. 24, the base plate 53L, which is the left one, is disposed at a position closer to the second cover 26B than the root portion 19*t* of the vertical portion 19L connected to the mount portion 19A of the protection member 19 is to the second cover 26B. Similarly, the base plate 53R, which is the right one, is disposed at a position closer to the second cover 26B than the root portion 19*t* of the vertical portion 19R is to the second cover 26B (not illustrated). Therefore, the operation support shaft 34 is also disposed at a position closer to the second cover 26B than the root portion 19*t* of the vertical portion 19L, 19R is to the second cover 26B.

As illustrated in FIG. 4, the operation support shaft 34 includes a first shaft 34A and a second shaft 34B. The first shaft 34A is inserted through the first bushing 69L, the first wall 30*a* of the first connecting member 30, the first wall 31*a* of the second connecting member 31, and the first wall portion 32*a* and the second wall portion 32*b* of the third connecting member 32. The first shaft 34A is supported by the first bushing 69L and the first wall portion 32*a* and the second wall portion 32*b* of the third connecting member 32 in such a way as to be able to rotate on the axis of the first bushing 69L.

The second shaft 34B is disposed coaxially to the right of the first shaft 34A. The second shaft 34B is inserted through the second bushing 69R. The second shaft 34B is supported by the second bushing 69R in such a way as to be able to rotate on the axis of the second bushing 69R.

The first shaft 34A and the second shaft 34B are disposed at a distance from each other in the machine-body width direction K2. As illustrated in FIG. 6, etc., a connection member 11 is provided between the first shaft 34A and the second shaft 34B. The first shaft 34A and the second shaft 34B are connected to each other by the connection member 11 in such a way as to be able to rotate together.

As described above, the operation support shaft 34, which is made up of the first shaft 34A and the second shaft 34B, is supported by the first vertical member 27, the second vertical member 28, the first connecting member 30, the second connecting member 31, and the first wall portion 32*a* of the third connecting member 32. The operation support shaft 34 may have a single-shaft structure.

The connection member 11 includes a first sidewall 11A connected to the first shaft 34A, a second sidewall 11B connected to the second shaft 34B, a connecting wall 11C providing continuity between the first sidewall 11A and the second sidewall 11B, and an extending portion 11D extending upward from the second sidewall 11B. The first sidewall 11A and the second sidewall 11B are disposed at a predetermined distance from each other in the machine-body width direction K2. The connecting wall 11C connects the rear end portion of the first sidewall 11A and the rear end portion of the second sidewall 11B to each other.

A connection sleeve 64 is provided on the first sidewall 11A. The right end portion of the first shaft 34A is inserted in the connection sleeve 64 and is fixed to the connection sleeve 64. Because of this structure, the first shaft 34A and the first sidewall 11A are capable of rotating together.

The second shaft 34B is fixed to the second sidewall 11B by welding or the like. A contact plate 11E and a first spring hook portion 70 are provided on the extending portion 11D. The first spring hook portion 70 is a pin, and protrudes from the extending portion 11D toward the first shaft 34A.

As illustrated in FIGS. 4 and 5, a second spring hook portion 72 is provided below the second wall 31*b* of the second connecting member 31. The second spring hook portion 72 is a bent pin, and is fixed to a holding plate 100. The holding plate 100 is fixed to the machine-body-inward surface of the second vertical member 28 and protrudes forward of the second vertical member 28. The second spring hook portion 72 protrudes from the holding plate 100 toward the first shaft 34A and is bent forward.

As illustrated in FIG. 6, etc., a sleeve 39L is fitted on the left portion (between the first wall 30*a* of the first connecting member 30 and the first wall portion 32*a* of the third connecting member 32) of the first shaft 34A. The sleeve 39L is fixed to the first shaft 34A by means of pins or the like and is capable of rotating together with the first shaft 34A. A sleeve-shaped spacer 39R is fitted on the right portion (between the second wall portion 32*b* of the third connecting member 32 and the connection member 11) of the first shaft 34A. The spacer 39R is fixed to the first shaft 34A by means of pins or the like.

As illustrated in FIG. 2, a control valve 35 is provided in the manipulator base 23. The control valve 35 is a collective concept comprised of a plurality of control valves V1 to V10 for controlling hydraulic actuators of the working machine 1. The control valve 35 is provided between a lower portion of the first vertical member 27 and a lower portion of the second vertical member 28.

Each control valve V1 to V10 is a linear-movement-spool-type direction-switching valve. The spool of each control valve V1 to V10 is held at its neutral position by an urging force applied by an urging spring housed inside a valve body, and is operated up/down from the neutral position against the urging force applied by the urging spring. These plural control valves are first to tenth control valves V1 to V10. The first to tenth control valves V1 to V10 are mechanical-operation-type direction-switching valves whose spool position is switched manually.

The first control valve V1 is a transmission control valve for controlling a swash-plate cylinder (not illustrated) configured to change the tilt angle of the swash plate of the first traveling motor M1 and that of the second traveling motor M2 (FIG. 25). The second control valve V2 is a swiveling control valve for controlling the swiveling motor M3 (FIG. 24). The third control valve V3 is an arm control valve for controlling the arm cylinder C4 (FIG. 24). The fourth control valve V4 is a first traveling control valve (traveling control valve) for controlling the first traveling motor M1 (FIG. 24). The fifth control valve V5 is a dozer control valve for controlling the dozer cylinder C1 (FIG. 24). The sixth control valve V6 is a spare control valve for controlling a hydraulic attachment. The seventh control valve V7 is a second traveling control valve (traveling control valve) for controlling the second traveling motor M2 The eighth control valve V8 is a swing control valve for controlling the swing cylinder C2 (FIG. 24). The ninth control valve V9 is a bucket control valve for controlling the bucket cylinder C5 (FIG. 24). The tenth control valve V10 is a boom control valve for controlling the boom cylinder C3 (FIG. 24). The third control valve V3, the ninth control valve V9, and the tenth control valve V10 are work control valves for controlling hydraulic actuators configured to drive the working device 4 (FIG. 24).

An operation shaft 33 is provided on the manipulator base 23. The operation shaft 33 is provided under the connecting body 29 and the operation support shaft 34 and over the control valve 35. The operation shaft 33 has an axis extending in the machine-body width direction K2 and is provided from the first vertical member 27 to the second vertical member 28. In addition, the operation shaft 33 is supported by the first vertical member 27 and the second vertical member 28 in such a way as to be able to rotate on its axis. The right portion of the operation shaft 33 protrudes beyond the second vertical member 28 outward with respect to the machine body.

As illustrated in FIGS. 2 and 3, first to fifth rotary sleeves 38A to 38E are fitted on the operation shaft 33. The third rotary sleeve 38C rotates together with the operation shaft 33. The other rotary sleeves 38A, 38B, 38D, and 38E rotate relatively in relation to the operation shaft 33.

As illustrated in FIG. 3, a first relaying strip 91A is provided on the rear portion of the first rotary sleeve 38A in such a way as to protrude rearward. A second relaying strip 91B is provided on the rear portion of the second rotary sleeve 38B in such a way as to protrude rearward. A third relaying strip 91C is provided on the rear portion of the fourth rotary sleeve 38D in such a way as to protrude rearward. A fourth relaying strip 91D is provided on the rear portion of the fifth rotary sleeve 38E in such a way as to protrude rearward.

As illustrated in FIG. 5, a first arm 39A is provided on the front portion of the first rotary sleeve 38A in such a way as to protrude forward. A second arm 39B is provided on the front portion of the second rotary sleeve 38B in such a way as to protrude forward. A third arm 39C is provided on the front portion of the third rotary sleeve 38C in such a way as to protrude forward. A fourth arm 39D is provided on the front portion of the fourth rotary sleeve 38D in such away as to protrude forward. A fifth arm 39E is provided on the front portion of the fifth rotary sleeve 38E in such a way as to protrude forward.

The first rotary sleeve 38A is linked to the spool S2 of the second control valve V2 via the arm 39A and a link 40A. The second rotary sleeve 38B is linked to the spool S3 of the third control valve V3 via the arm 39B and a link 40B. The third rotary sleeve 38C is linked to the spool S5 of the fifth control valve V5 via the arm 39C and a link 40C. The fourth rotary sleeve 38D is linked to the spool S9 of the ninth control valve V9 via the arm 39D and a link 40D. The fifth rotary sleeve 38E is linked to the spool S10 of the tenth control valve V10 via the arm 39E and a link 40E.

A plurality of levers, pedals, and the like for operating the working device 4, the traveling device 3, and other devices of the working machine 1 respectively are provided on the manipulator base 23. A dozer lever 66 for operating the dozer device 7 (FIG. 24) is provided to the right of (B2) the manipulator base 23. The base portion of the dozer lever 66 is fixed to the right portion of the operation shaft 33. Swinging the dozer lever 66 forward/rearward causes the operation shaft 33 and the third rotary sleeve 38C to rotate, resulting in that the spool S5 of the fifth control valve V5 is pushed/pulled via the arm 39C and the link 40C. The dozer cylinder C1 is controlled by this operation, and the dozer device 7 is therefore driven.

An accelerator lever 67 for operating the number of revolutions of the prime mover Eg is provided to the left of (B1) the manipulator base 23. As illustrated in FIG. 2, a first pedal supporting portion 74 and a second pedal supporting portion 75 are provided at the lower portion of the first vertical member 27. The first pedal supporting portion 74 supports a transmission pedal (not illustrated) for operating the first control valve V1. The second pedal supporting portion 75 supports an SP pedal (not illustrated) for operating the sixth control valve V6. A third pedal supporting portion 76 is provided at the lower portion of the second vertical member 28. The third pedal supporting portion 76 supports a swing pedal (not illustrated) for operating the eighth control valve V8.

An operation member 41 and a manipulation member 71 are provided over the manipulator base 23. The operation member 41 is comprised of traveling levers for operating the traveling device 3 (traveling control valves). The operation member 41 is disposed over the top portion of the manipulator base 23 and at the center portion thereof in the machine-body width direction K2. The operation member 41 includes a first traveling lever 41L, the left one, and a second traveling lever 41R, the right one. The first traveling lever 41L and the second traveling lever 41R are disposed next to each other in the machine-body width direction K2. The first traveling device 3L is operated by manipulating the first traveling lever 41L. The second traveling device 3R is operated by manipulating the second traveling lever 41R. The first traveling lever 41L is located at a machine-body-inward position in relation to a first manipulation lever 71L, which will be described later. The second traveling lever 41R is located at a machine-body-inward position in relation to a second manipulation lever 71R, which will be described later.

The first traveling lever 41L includes a lever body 43L, which has a grip 42L on its head end (top), and a first base portion 44L, which has a sleeve shape and is provided on the bottom of the lever body 43L. As illustrated in FIGS. 5 and 6, etc., the first base portion 44L is disposed between the first connecting member 30 and the second connecting member 31. The first shaft 34A of the operation support shaft 34 is inserted through the first base portion 44L. That is, the first base portion 44L is disposed around the first shaft 34A. The first base portion 44L is supported such that the first base portion 44L is rotatable about the axis of the first shaft 34A relative to the first shaft 34A. Because of this structure, the first traveling lever 41L is supported by the operation support shaft 34 in such a way as to be able to rotate around the axis of the operation support shaft 34, and is thus able to be manipulated pivotally in the front-rear direction K1.

A first arm portion 45X that is a plate member is provided on the first base portion 44L in such a way as to protrude forward. The first arm portion 45X rotates together with the first traveling lever 41L. One end (top portion) of a connecting rod 48L is connected to the first arm portion 45X, with a ball-and-socket joint 49L interposed therebetween. The other end (bottom portion) of the connecting rod 48L is connected to the spool S4 of the fourth control valve V4. Swinging the first traveling lever 41L forward/rearward causes the first arm portion 45X to pivot up/down, resulting in that the spool S4 of the fourth control valve V4 is pushed/pulled via the connecting rod 48L. The first traveling motor M1 is controlled by this operation, and the first traveling device 3L is therefore driven.

As illustrated in FIG. 2, the second traveling lever 41R includes a lever body 43R, which has a grip 42R on its head end (top), and a second base portion 44R, which has a sleeve shape and is provided on the base portion (bottom) of the lever body 43R. As illustrated in FIGS. 5 and 6, etc., the second base portion 44R is disposed between the first connecting member 30 and the second connecting member 31. The first shaft 34A of the operation support shaft 34 is inserted through the second base portion 44R. That is, the second base portion 44R is disposed around the first shaft 34A. The second base portion 44R is supported such that it can rotate relatively on the axis of the first shaft 34A in relation to the first shaft 34A. Because of this structure, the second traveling lever 41R is supported by the operation support shaft 34 in such a way as to be able to rotate around the axis of the operation support shaft 34, and is thus able to be manipulated pivotally forward and rearward.

A first arm portion 45Y that is a plate member is provided on the second base portion 44R in such a way as to protrude forward. The second arm portion 45Y is disposed adjacent to the first arm portion 45X in a direction parallel to the axis of the operation support shaft 34. The second arm portion 45Y rotates together with the second traveling lever 41R. One end (top portion) of a connecting rod 48R is connected to the second arm portion 45Y, with a ball-and-socket joint 49R interposed therebetween. The other end (bottom portion) of the connecting rod 48R is connected to the spool S7 of the seventh control valve V7. Swinging the second traveling lever 41R forward/rearward causes the second arm portion 45Y to pivot up/down, resulting in that the spool S7 of the seventh control valve V7 is pushed/pulled via the connecting rod 48R. The second traveling motor M2 is controlled by this operation, and the second traveling device 3R is therefore driven.

The manipulation member 71 illustrated in FIG. 2 is a lever member for operating the working device 4 and the machine body 2. The manipulation member 71 includes a (left) first manipulation lever 71L provided on one side in the machine-body width direction K2 and a (right) second manipulation lever 71R provided on the other side in the machine-body width direction K2. The first manipulation lever 71L and the second manipulation lever 71R are disposed over the top portion of the manipulator base 23 and at a machine-body-outward position in relation to the operation member 41. The first manipulation lever 71L is disposed at a machine-body-outward position (to the left of) in relation to the first traveling lever 41L. The second manipulation lever 71R is disposed at a machine-body-outward position (to the right of) in relation to the second traveling lever 41R. The first manipulation lever 71L is manipulated for operating, for example, the arm 16 and the machine body 2. The second manipulation lever 71R is manipulated for operating, for example, the boom 15 and the bucket 17.

The first manipulation lever 71L has a grip 78L on its head end (top). The base portion (bottom portion) of the first manipulation lever 71L is supported indirectly on the support frame 25, with a first support 77L provided therebetween, such that lever swinging in given swing directions can be performed. The second manipulation lever 71R has a grip 78R on its head end (top). The base portion (bottom portion) of the second manipulation lever 71R is supported indirectly on the support frame 25, with a second support 77R provided therebetween, such that lever swinging in given swing directions can be performed. The swing directions of the first manipulation lever 71L and the second manipulation lever 71R are: the front-rear direction K1, the machine-body width direction K2, and oblique directions between the front-rear direction K1 and the machine-body width direction K2. Since the structure for enabling swing motion of the manipulation member 71 is the same as that of related art, an explanation of it is omitted.

In FIGS. 2, 3, and 5, swinging the first manipulation lever 71L in the machine-body width direction K2 causes the pushing/pulling of the spool S2 of the second control valve V2 via a first interlock member 89A, the first relaying strip 91A, the first rotary sleeve 38A, the first arm 39A, the link 40A, and the like. The swiveling motor M3 is controlled by this operation, and the machine body 2 is therefore driven (swivels). Swinging the first manipulation lever 71L in the front-rear direction K1 causes the pushing/pulling of the spool S3 of the third control valve V3 via a second interlock member 89B, the second relaying strip 91B, the second rotary sleeve 38B, the second arm 39B, the link 40B, and the like. The arm cylinder C4 is controlled by this operation, and the arm 16 is therefore driven (moves pivotally).

Swinging the second manipulation lever 71R in the machine-body width direction K2 causes the pushing/pulling of the spool S9 of the ninth control valve V9 via a third interlock member 89C, the third relaying strip 91C, the fourth rotary sleeve 38D, the fourth arm 39D, the link 40D, and the like. The bucket cylinder C5 is controlled by this operation, and the bucket 17 is therefore driven (moves pivotally). Swinging the second manipulation lever 71R in the front-rear direction K1 causes the pushing/pulling of the spool S10 of the tenth control valve V10 via a fourth interlock member 89D, the fourth relaying strip 91D, the fifth rotary sleeve 38E, the fifth arm 39E, the link 40E, and the like. The boom cylinder C3 is controlled by this operation, and the boom 15 is therefore driven (moves pivotally).

As illustrated in FIGS. 2, 3, and 6, etc., an electrical component 140L, 140R is provided between the operation member 41 and the manipulation member 71. In FIG. 5, the electrical components 140L and 140R are not illustrated. The electrical components 140L and 140R are enclosed by the cover 26 because they are provided inside the manipulator base 23. The electrical components 140L and 140R operate in accordance with manipulation of the operation member 41. Specifically, a first electrical component 140L, the left one, is a sensor configured to detect the manipulation position (swing-motion position) of the first traveling lever 41L. A second electrical component 140R, the right one, is a sensor configured to detect the manipulation position (swing-motion position) of the second traveling lever 41R.

The electrical component 140L, 140R is disposed above the operation support shaft 34 and near the base portion 44L, 44R of the operation member 41. Electric wiring (not illustrated) for supplying power to the electrical component 140L, 140R and electric wiring (not illustrated) through which an electric signal outputted by the electrical component 140L, 140R is transmitted to an electronic controller (not illustrated) provided in the working machine 1 are also disposed above the operation support shaft 34 and near the base portion 44L, 44R of the operation member 41.

As illustrated in FIGS. 1 and 2, etc., a lock lever 50 is provided to the left of, and to the right of, the manipulator base 23. The lock lever 50 is a member for locking the operation member 41 and the manipulation member 71 (meaning a manipulation of imposing mechanical restrictions on them to render them immovable) and unlocking them (meaning a manipulation of canceling the mechanical restrictions on them to render them movable). The lock lever 50 includes a first lever 50L, which is located to the left of the manipulator base 23, and a second lever 50R, which is located to the right of the manipulator base 23. The first lever 50L is disposed at a machine-body-outward position in relation to the first manipulation lever 71L. The second lever 50R is disposed at a machine-body-outward position in relation to the second manipulation lever 71R.

As illustrated in FIG. 2, the first lever 50L includes a lever body 52L, which has a grip 51L on its head end (top), and the first base plate 53L, which is fixed to the base portion (bottom end) of the lever body 52L. The second lever 50R includes a lever body 52R, which has a grip 51R on its head end (top), and the second base plate 53R, which is fixed to the base portion (bottom end) of the lever body 52R.

As illustrated in FIGS. 5 and 6, the lever body 52L of the first lever 50L is fixed to one end of the first base plate 53L, and the left end of the first shaft 34A of the operation support shaft 34 is fixed to the other end thereof. The lever body 52R of the second lever 50R is fixed to one end of the second base plate 53R, and the right end of the second shaft 34B of the operation support shaft 34 is fixed to the other end thereof. This structure enables the first lever 50L and the second lever 50R (the lock lever 50) to rotate together with the operation support shaft 34, and enables them to be manipulated pivotally upward and downward as illustrated in FIG. 26.

The lock lever 50 can be switched between a first position X1 and a second position X2 illustrated in FIGS. 26 and 27 by being manipulated pivotally upward and downward.

The first position X1 is a raised position of the lock lever 50 (a state in which the lock lever 50 is directed upward, as viewed from its base portion toward its head end), and is a position of not being obstructive to the operator D getting on and off the vehicle via the passage 22 (a position of allowing the operator D to get on and off the vehicle). In other words, the first position X1 is a position that is lateral to the manipulator base 23 and opens the passage 22.

The second position X2 is a lowered position of the lock lever 50 (a state in which the lock lever 50 is directed rearward, as viewed from its base portion toward its head end), and is a position of being obstructive to the operator D getting on and off the vehicle via the passage 22 (a position of preventing the operator D from getting on and off the vehicle). In other words, the second position X2 is a position of extending toward the rear of the machine body from the manipulator base 23 and blocking the passage 22.

When the lock lever 50 is at the first position X1, the operation member 41 and the manipulation member 71 are locked, and the operation member 41 and the manipulation member 71 cannot be manipulated. When the lock lever 50 is at the second position X2, the operation member 41 and the manipulation member 71 are not locked (unlocked), and the operation member 41 and the manipulation member 71 can be manipulated.

When the operation member 41 and the manipulation member 71 are locked, the first lever 50L and the second lever 50R do not prevent the operator D from sitting on and leaving the operator's seat 6 via the passage 22. When the operation member 41 and the manipulation member 71 are not locked, the first lever 50L and the second lever 50R prevent the operator D from sitting on and leaving the operator's seat 6 via the passage 22. Therefore, it is clear whether the operation member 41 and the manipulation member 71 are locked or not.

As illustrated in FIGS. 4 and 6, etc., a positioning mechanism 96 for the lock lever 50 is provided at a machine-body-inward position in relation to the upper portion of the first vertical member 27. The positioning mechanism 96 includes a contact member 97, a first stopper 98, and a second stopper 99. The contact member 97 is provided in such a way as to protrude radially from the sleeve 39L. The first shaft 34A of the operation support shaft 34 is inserted in the sleeve 39L. The sleeve 39L is fixed to the first shaft 34A. Therefore, the sleeve 39L and the contact member 97 rotate together with the operation support shaft 34.

The first stopper 98 is a bolt. The first stopper 98 is in threaded engagement with a screw hole (not illustrated) formed through the second wall 30*b* of the first connecting member 30. The screw hole is a hole having a female screw in its inner circumferential surface. A first lock nut 102 (FIG. 5) for fixing the position of the first stopper 98 in its axial direction is threaded on the first stopper 98. The contact member 97 is in contact with the first stopper 98 when the lock lever 50 is at the first position X1.

When the contact member 97 is brought into contact with the first stopper 98 by rotating the lock lever 50, the rotational movement of the lock lever 50 in a direction from the second position X2 to the first position X1 (a locking direction F1 illustrated in FIG. 7A, which will be described later) is restricted. As a result, the lock lever 50 is positioned to the first position X1.

The second stopper 99 is a bolt. The second stopper 99 is in threaded engagement with a screw hole (not illustrated) formed through a holding plate 101. The holding plate 101 is fixed to the machine-body-inward surface of the first vertical member 27 in such a way as to protrude inward with respect to the machine body. A second lock nut 104 for fixing the position of the second stopper 99 in its axial direction is threaded on the second stopper 99. The contact member 97 is in contact with the second stopper 99 when the lock lever 50 is at the second position X2.

When the contact member 97 is brought into contact with the second stopper 99 by rotating the lock lever 50, the rotational movement of the lock lever 50 in a direction from the first position X1 to the second position X2 (an unlocking direction F2 illustrated in FIG. 7B, which will be described later) is restricted. As a result, the lock lever 50 is positioned to the second position X2.

The contact position of the contact member 97 and the first stopper 98 is changeable by threaded advancement/retraction of the first stopper 98. With this, it is possible to adjust the position, when at the first position X1, of the lock lever 50 around the operation support shaft 34 (the angle of the lock lever 50). In addition, the contact position of the contact member 97 and the second stopper 99 is changeable by threaded advancement/retraction of the second stopper 99. With this, it is possible to adjust the position, when at the second position X2, of the lock lever 50 around the operation support shaft 34 (the angle of the lock lever 50).

A manipulation force applied to the lock lever 50 is received by a flat plane via a contact plane when the contact member 97 comes into contact with the first stopper 98 or the second stopper 99. Therefore, positional displacement of the lock lever 50 with respect to the operation support shaft 34 around its axis does not occur.

An urging member 106 for keeping the lock lever 50 at the first position X1 and the second position X2 is provided at a machine-body-inward position in relation to the upper portion of the second vertical member 28. The urging member 106 is a tension coil spring. One end of the urging member 106 is hooked on the first spring hook portion 70 (FIG. 6) provided on the connection member 11. The other end of the urging member 106 is hooked on the second spring hook portion 72 (FIGS. 4 and 5), which is fixed indirectly to the second vertical member 28 by means of the holding plate 100.

An urging force of the urging member 106 switches in terms of its direction of acting on the lock lever 50 between when the lock lever 50 is at the first position X1 and when the lock lever 50 is at the second position X2.

That is, when the lock lever 50 is at the first position X1, the axial center of the urging member 106 is located above (closer to the first position X1) the axial center of the operation support shaft 34. Therefore, when the lock lever 50 is at the first position X1, the urging force of the urging member 106 acts in a direction of causing the lock lever 50 to rotate upward (raising direction of the grip 51L, 51R, the locking direction F1 illustrated in FIG. 7A). The lock lever 50 is kept at the first position X1 due to this urging force.

When the lock lever 50 is at the second position X2, the axial center of the urging member 106 is located below (closer to the second position X2) the axial center of the operation support shaft 34. Therefore, when the lock lever 50 is at the second position X2, the urging force of the urging member 106 acts in a direction of causing the lock lever 50 to rotate downward (lowering direction of the grip 51L, 51R, the unlocking direction F2 illustrated in FIG. 7B). The lock lever 50 is kept at the second position X2 due to this urging force.

As illustrated in FIG. 6, a third stopper 105 is provided in front of the contact plate 11E of the connection member 11. The third stopper 105 is a bolt. The third stopper 105 is in threaded engagement with a screw hole (not illustrated) formed through the second wall 31*b* of the second connecting member 31. A third lock nut 108 (FIG. 5) for fixing the position of the third stopper 105 is threaded on the third stopper 105. The contact plate 11E is in contact with the third stopper 105 when the lock lever 50 is at the first position X1. This contact also restricts the upward rotation of the lock lever 50.

When the positional adjustment of the lock lever 50 around the operation support shaft 34 at the first position X1 is made by threaded advancement/retraction of the first stopper 98 as described earlier, the third stopper 105 is also screwed for threaded advancement/retraction.

As illustrated in FIG. 3, etc., the lock mechanism 114 for locking or unlocking the operation member 41 is provided near the center of the operation support shaft 34. Lock mechanisms 112 and 113 for locking or unlocking the manipulation member 71 are provided to the left and right of the lock mechanism 114. The structure and operation of the lock mechanisms 112 and 113 for the manipulation member 71 is the same as that of related art; therefore, an explanation of it is omitted.

Next, the lock mechanism 114 will now be described.

Figure 7A:
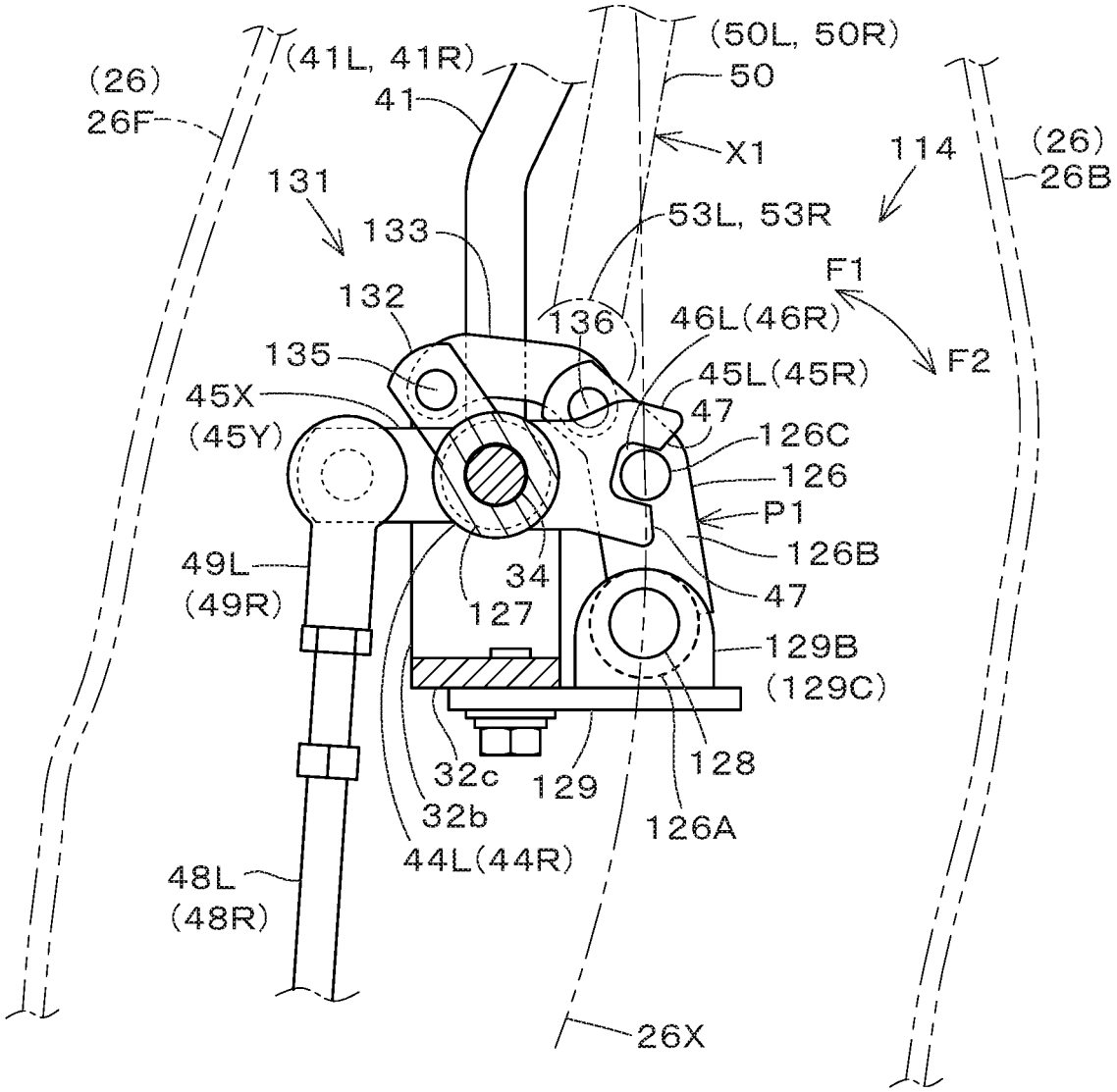
FIG. 7A is a sectional view illustrating a locking state of a lock mechanism according to the first embodiment.
Figure 7B:
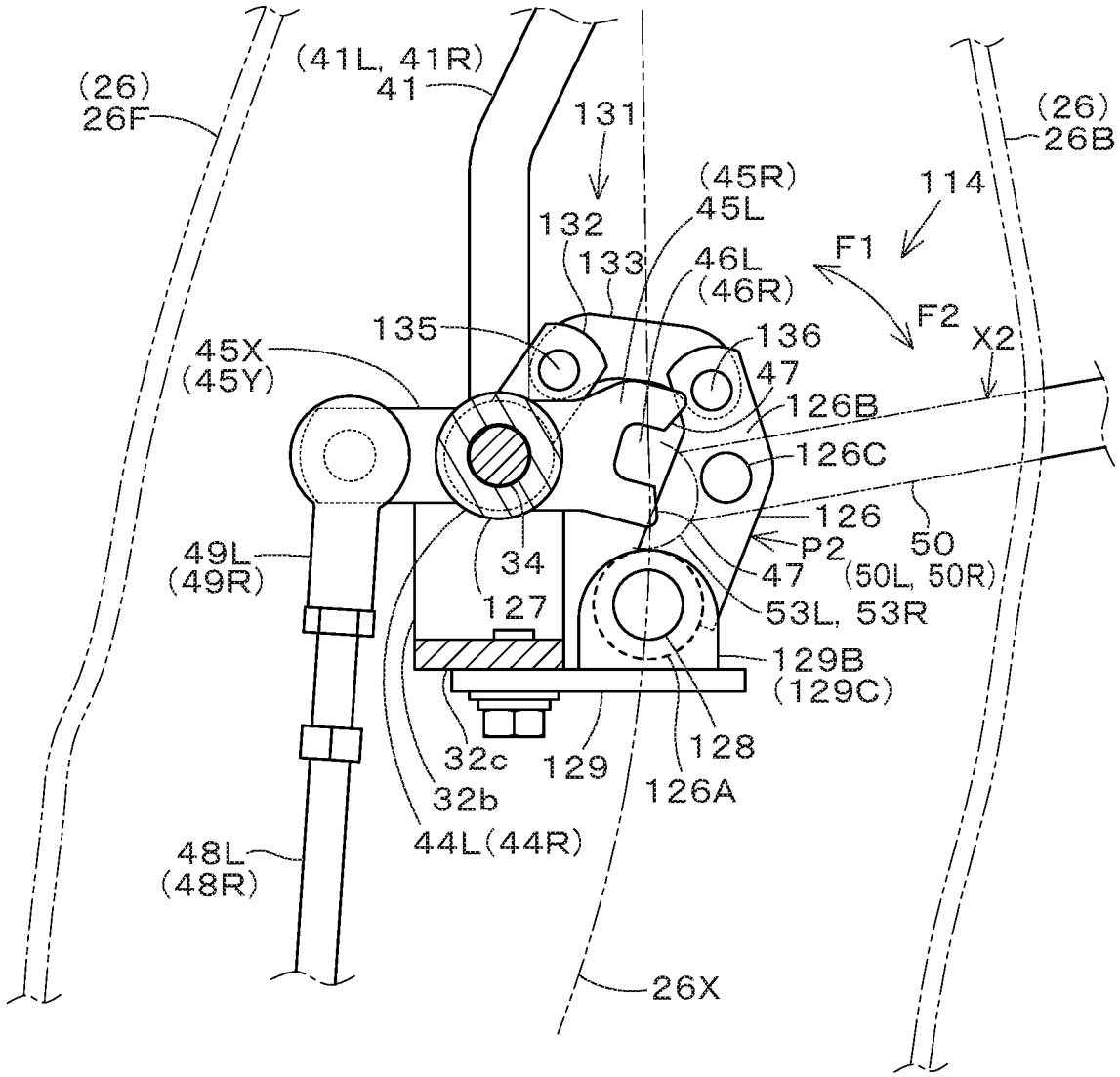
FIG. 7B is a sectional view illustrating an unlocking state of the lock mechanism according to the first embodiment.

FIG. 7A is a sectional view illustrating a locking state of the lock mechanism 114. FIG. 7B is a sectional view illustrating an unlocking state of the lock mechanism 114. The lock mechanism 114 is switchable between a locking state in which the movement of the operation member 41 is restricted, and an unlocking state in which the movement of the operation member 41 is allowed. As illustrated in FIGS. 6 to 7B, the lock mechanism 114 includes engagement portions 45L and 45R, a lock body 126, a lock support shaft 128, and a driving portion 131.

As illustrated in FIG. 6, the first engagement portion 45L is provided in such a way as to protrude rearward from the first base portion 44L of the first traveling lever 41L in a radially outward direction of the first base portion 44L and the operation support shaft 34. The second engagement portion 45R is provided in such a way as to protrude rearward from the second base portion 44R of the second traveling lever 41R radially outward of the second base portion 44R and the operation support shaft 34. Therefore, the first engagement portion 45L rotates together with the first traveling lever 41L, and the second engagement portion 45R rotates together with the second traveling lever 41R. That is, the engagement portion 45L, 45R rotates together with the operation member 41.

A first engagement groove 46L is formed in the head end of the first engagement portion 45L. A second engagement groove 46R is formed in the distal end of the second engagement portion 45R. The first engagement groove 46L and the second engagement groove 46R extend in a radially inward direction of the operation support shaft 34 from the rear toward the front. In other words, the first engagement groove 46L and the second engagement groove 46R are each a groove with an open rear end extending toward the operation support shaft 34 from the distal end of the first engagement portion 45L or the distal end of the second engagement portion 45R. As illustrated in FIGS. 7A and 7B, sloped surfaces 47, which form a taper such that the distance from each other increases in a rearward direction, are provided at an upper head end surface and a lower head end surface of each of the first and second engagement grooves 46L and 46R.

As illustrated in FIG. 6, a mount plate 129 is fixed to the lower base portion 32*c* of the third connecting member 32. The mount plate 129 protrudes rearward from the lower base portion 32*c*. Each plate face of the mount plate 129 is oriented up/down. A first supporting strip 129B and a second supporting strip 129C protruding upward are fixed to the top face of the mount plate 129. The first supporting strip 129B and the second supporting strip 129C are provided at a distance from each other in the machine-body width direction K2.

By being inserted through the first supporting strip 129B and the second supporting strip 129C, the lock support shaft 128 is supported indirectly by the lower base portion 32*c* by means of the mount plate 129. The lock support shaft 128 is disposed lower than the operation support shaft 34. Moreover, the lock support shaft 128 has an axis extending in the machine-body width direction K2 and is disposed in parallel with the operation support shaft 34.

The lock body 126 includes a base sleeve 126A, a lock arm 126B, and a lock pin 126C. The base sleeve 126A constitutes a lower end portion (one end portion) of the lock body 126. The base sleeve 126A is mounted around the lock support shaft 128 in such a way as to be able to rotate on the axis thereof. That is, one of opposite end portions of the lock body 126 is rotatably supported by the lock support shaft 128. The lock body 126 is disposed below the electrical components 140L and 140R, with a predetermined distance therefrom.

The lock arm 126B is provided on the base sleeve 126A in such a way as to protrude radially outward and upward. The lock arm 126B is bent forward as it goes upward. The lock arm 126B and the base sleeve 126A are provided at a corresponding position between the first engagement portion 45L and the second engagement portion 45R. The lock arm 126B moves pivotally in the front-rear direction due to rotation of the base sleeve 126A on the axis of the lock support shaft 128.

The lock pin 126C is provided at an intermediate portion between one of the opposite end portions of the lock arm 126B that is a lower portion and the other of the opposite end portions of the lock arm 126B that is an upper portion. The lock pin 126C is fixed to the lock arm 126B in a state of being inserted through the middle portion of the lock arm 126B to the left and right. That is, the lock pin 126C protrudes to both sides in the machine-body width direction K2 from the intermediate portion of the lock arm 126B. The left protrusion length of the lock pin 126C from the lock arm 126B is equal to the right protrusion length thereof.

A sleeve 127 is provided between the first base portion 44L of the first traveling lever 41L and the second base portion 44R of the second traveling lever 41R. The sleeve 127 is mounted around the first shaft 34A of the operation support shaft 34 and is fixed to the first shaft 34A.

The driving portion 131 applies a driving force to an upper end portion (the other end portion) of the lock body 126. The driving portion 131 includes an interlock portion 132 and a linking member 133. The interlock portion 132 is provided on the sleeve 127 mounted around the operation support shaft 34 in such a way as to protrude radially outward of the sleeve 127 and obliquely upward. That is, the interlock portion 132 is provided indirectly on the operation support shaft 34, with the sleeve 127 interposed therebetween. The sleeve 127 and the interlock portion 132 rotate together with the operation support shaft 34. As another example, the interlock portion 132 may be provided on the operation support shaft 34 itself.

The linking member 133 is disposed higher than the operation support shaft 34 and links the interlock portion 132 to the lock body 126. More particularly, the front end portion of the linking member 133 is rotatably connected to the interlock portion 132 by means of a pin 135. The rear end portion of the linking member 133 is rotatably connected to the upper end portion of the lock body 126 by means of a pin 136.

As illustrated in FIG. 7A, when the lock lever 50 is at the first position X1, the lock pin 126C is engaged with (inserted in) the first engagement groove 46L and the second engagement groove 46R. Since this restricts (prevents) the motion of the first engagement portion 45L and the second engagement portion 45R in the vertical direction, the motion of the first traveling lever 41L and the second traveling lever 41R is also restricted, and the swinging of the operation member 41 is impossible.

That is, in FIG. 7A, the lock body 126 is in an engagement position P1 in which it is in engagement with the first engagement portion 45L and the second engagement portion 45R and restricts the movement of the operation member 41. Moreover, the lock mechanism 114 is in a locking state in which it restricts the movement of the operation member 41.

It is possible to adjust the position of the lock pin 126C with respect to the first engagement groove 46L and the second engagement groove 46R by adjusting the position where the mount plate 129 is mounted to the lower base portion 32*c* of the third connecting member 32. Moreover, it is possible to adjust the depth of insertion of the lock pin 126C into the first engagement groove 46L and the second engagement groove 46R by adjusting the contact position of the first stopper 98 and the contact member 97.

The lock lever 50 is turned rearward to the second position X2 (toward the operator's seat 6 illustrated in FIG. 24, etc.) from the locking state illustrated in FIG. 7A. Upon this lever manipulation being performed, the driving portion 131 transmits a manipulation force for changing the position of the lock lever 50 as a driving force to the upper end portion of the lock body 126 to cause the lock body 126 to rotate about the axis of the lock support shaft 128. Specifically, due to the manipulation force applied to the lock lever 50, the operation support shaft 34, the sleeve 127, and the interlock portion 132 rotate in the unlocking direction F2. Then, as illustrated in FIG. 7B, the interlock portion 132 causes the linking member 133 to move rearward, and the linking member 133 causes the upper end portion of the lock arm 126B to move rearward. Therefore, the lock arm 126B rotates (pivots) around the axis of the lock support shaft 128 in the unlocking direction F2. The lock pin 126C moves rearward to become disengaged from the first engagement groove 46L and the second engagement groove 46R.

Since this allows (cancels the restrictions on) the motion of the first engagement portion 45L and the second engagement portion 45R in the vertical direction, the motion of the first traveling lever 41L and the second traveling lever 41R is also allowed, and the swinging of the operation member 41 is possible. That is, in FIG. 7B, the lock body 126 is at a disengagement position P2 in which it is not in engagement with the first engagement portion 45L and the second engagement portion 45R and allows the motion of the operation member 41. Moreover, the lock mechanism 114 is in an unlocking state, in which it allows the motion of the operation member 41.

The lock lever 50 is raised to the first position X1 from the unlocking state illustrated in FIG. 7B. Upon this lever manipulation being performed, the driving portion 131 transmits a manipulation force for changing the position of the lock lever 50 as a driving force to the upper end portion of the lock body 126 to cause the lock body 126 to rotate around the axis of the lock support shaft 128. Specifically, due to the manipulation force applied to the lock lever 50, the operation support shaft 34, the sleeve 127, and the interlock portion 132 rotate in the locking direction F1. Then, as illustrated in FIG. 7A, the interlock portion 132 causes the linking member 133 to move forward, and the linking member 133 causes the upper end portion of the lock arm 126B to move forward. Therefore, the lock arm 126B rotates (pivots) around the axis of the lock support shaft 128 in the locking direction F1. The lock pin 126C moves forward to become engaged with the first engagement groove 46L and the second engagement groove 46R.

This restricts the motion of the first engagement portion 45L and the second engagement portion 45R in the vertical direction and the motion of the first traveling lever 41L and the second traveling lever 41R, and makes the swinging of the operation member 41 impossible. That is, the lock body 126 changes its position (moves) from the disengagement position P2 illustrated in FIG. 7B to the engagement position P1, at which it restricts the motion of the operation member 41 by being in engagement with the first engagement portion 45L and the second engagement portion 45R as illustrated in FIG. 7A. Moreover, the lock mechanism 114 returns to a state of locking the operation member 41. As described above, the lock body 126 is capable of changing its position between the engagement position P1 illustrated in FIG. 7A and the disengagement position P2 illustrated in FIG. 7B.

In the unlocking state illustrated in FIG. 7B, the lock mechanism 114 is at a position shifted toward the second cover 26B away from the operation support shaft 34, that is, toward the operator's seat 6 (rearward). That is, as viewed in the machine-body width direction K2, the lock mechanism 114 is at a position shifted toward the operator's seat 6 (rearward) away from roughly the same position (position in the front-rear direction K1) as the operation support shaft 34. Still in other words, in the unlocking state, the lock mechanism 114 is at a position shifted toward the second cover 26B, that is, toward the operator's seat 6 (rearward), with respect to a front-most (closest to the first cover 26F) portion (front end portion) of the operation support shaft 34.

In the present embodiment, as illustrated in FIG. 7B, in the unlocking state, a part (the front end portion of the interlock portion 132) of the lock mechanism 114 overlaps with the operation support shaft 34 in the front-rear direction K1 but is located behind the front end portion of the operation support shaft 34.

In the locking state illustrated in FIG. 7A, except for the interlock portion 132 and the front end portion of the linking member 133, the members and portions of the lock mechanism 114 are at a position closer to the second cover 26B (the operator's seat 6) than from the operation support shaft 34. That is, as viewed in the machine-body width direction K2, the middle portion and rear end portion of the linking member 133, the lock body 126, the lock support shaft 128, and the engagement portions 45L and 45R are at a position closer to the operator's seat 6 than from roughly the same position as the operation support shaft 34. Still in other words, in the locking state, except for the interlock portion 132 and the front end portion of the linking member 133, the members and portions of the lock mechanism 114 are at a position closer to the second cover 26B, that is, the operator's seat 6 (rear position), with respect to the front end portion of the operation support shaft 34.

As illustrated in FIGS. 7A and 7B, the lock body 126, the lock support shaft 128, and the engagement portions 45L and 45R are always disposed at a position closer to the second cover 26B with respect to the operation support shaft 34. That is, as viewed in the machine-body width direction K2, the lock support shaft 128 and the engagement portions 45L and 45R are always located closer to the operator's seat 6 (rear position) than the operation support shaft 34 is. In addition, each portion of the lock mechanism 114 is disposed near a joint 26X between the first cover 26F and the second cover 26B.

As another example, each portion of the lock mechanism 114 may be at a position closer to the second cover 26B (the operator's seat 6) than from the operation support shaft 34 both in the locking state and in the unlocking state by changing the shape of each portion of the lock mechanism 114. Each portion of the lock mechanism 114 may be at a position closer to the operator's seat 6 than from the operation support shaft 34 in at least one of the locking and unlocking states. As still another example, the whole or the most part of the lock mechanism 114 may be disposed closer to the second cover 26B than the joint 26X between the first cover 26F and the second cover 26B.

The lock mechanism 114 is usually covered by the cover 26. As illustrated in FIG. 2, the lock mechanism 114 becomes exposed when the second cover 26B is detached from the support frame 25, the first cover 26F, and the like. In addition, the lock mechanism 114 becomes exposed also when the window 26*c* is opened as illustrated in FIG. 1 by opening the lid 26*g* provided on the rear surface 26*a* of the second cover 26B. That is, the second cover 26B is configured such that the lock mechanism 114 is able to be exposed toward the operator's seat 6.

In the embodiment described above, the force of swinging the lock lever 50 is used as the driving force of the driving portion 131. Instead, as illustrated in FIGS. 8A and 8B, the driving force may be generated by an actuator 139 provided in the driving portion 131.

Figure 8A:
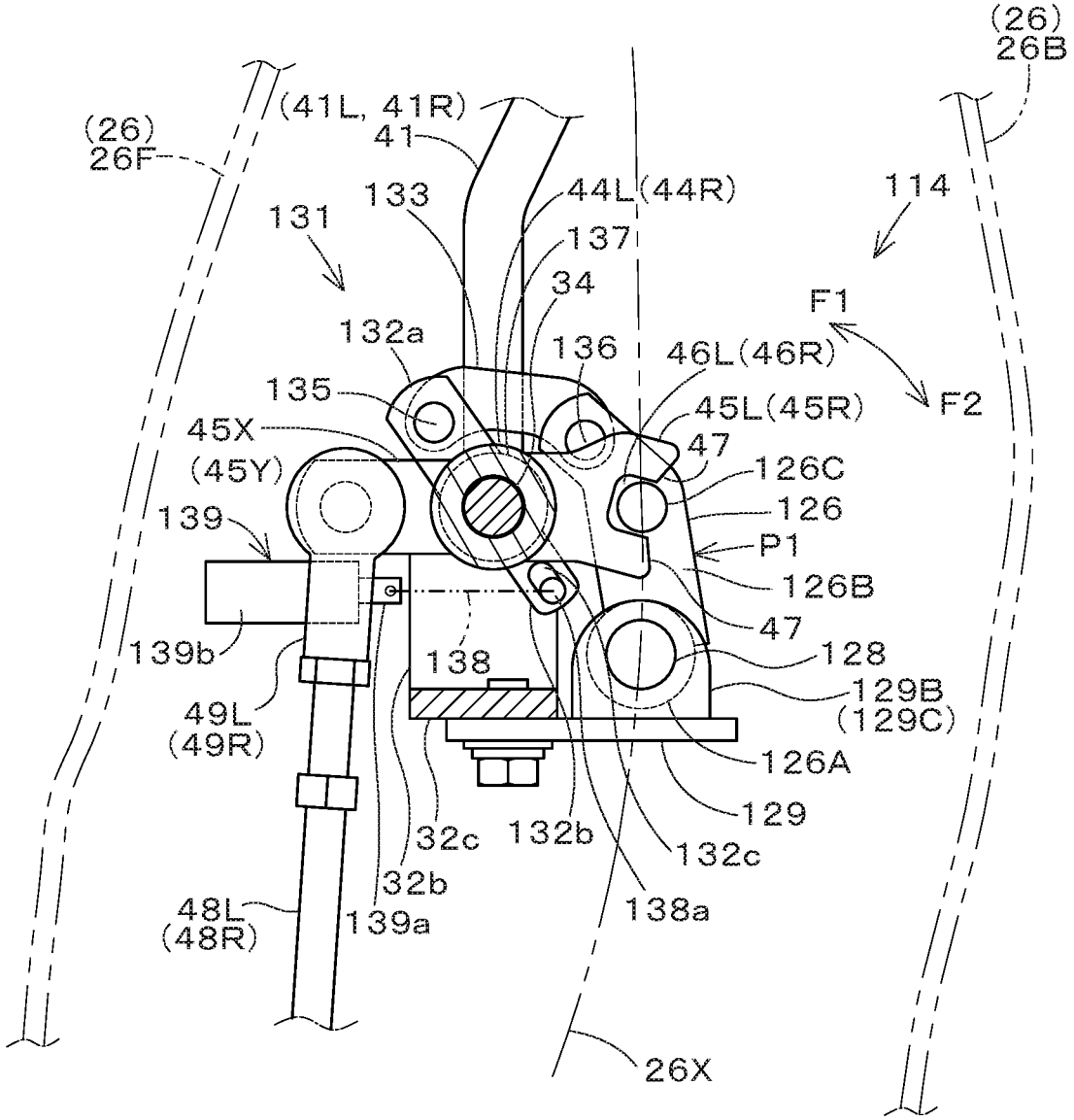
FIG. 8A is a sectional view illustrating a locking state of a lock mechanism according to a modification example of the first embodiment.
Figure 8B:
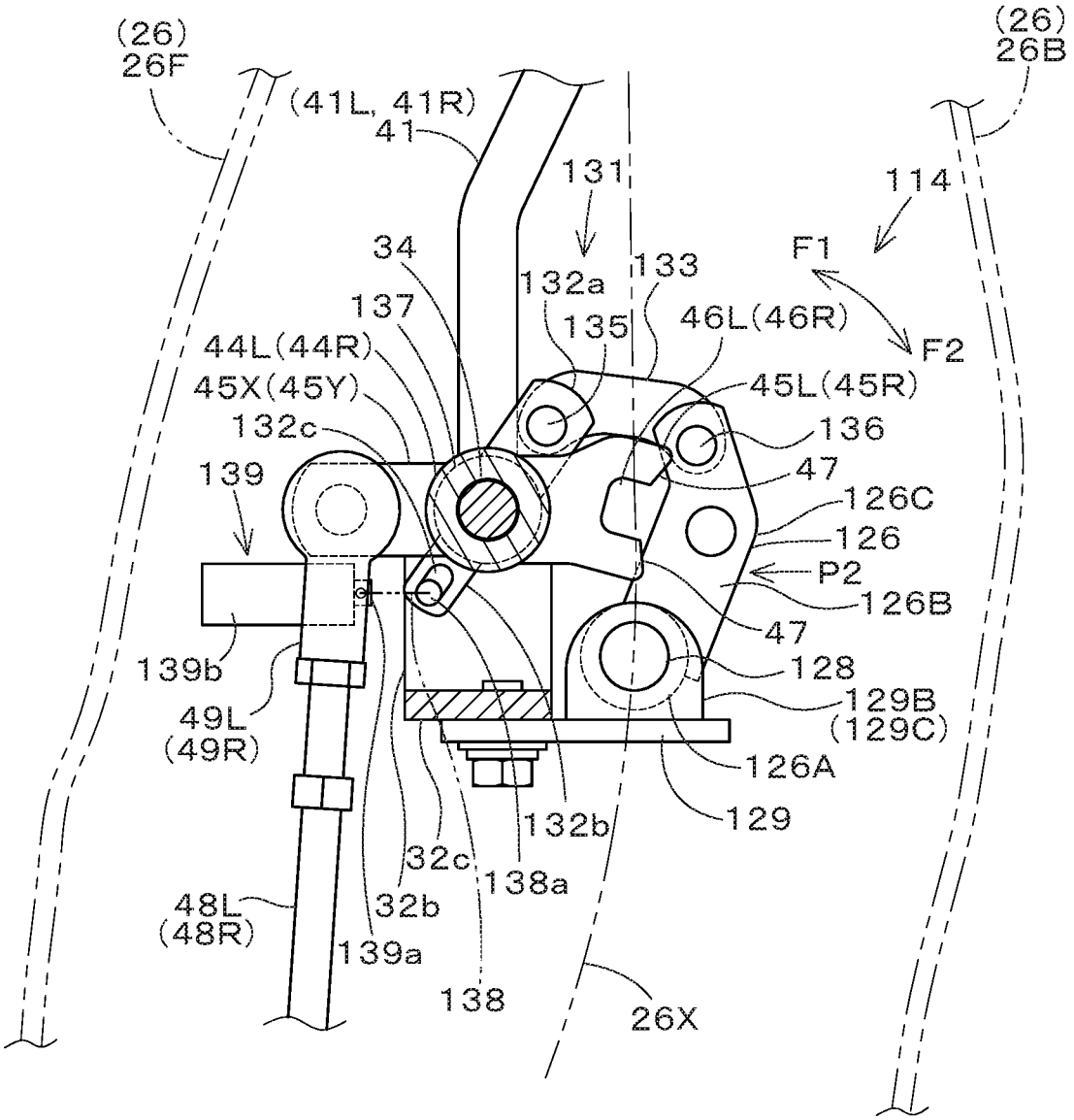
FIG. 8B is a sectional view illustrating an unlocking state of the lock mechanism according to the modification example of the first embodiment.

FIG. 8A is a sectional view illustrating a locking state of the lock mechanism 114 according to a modification example. FIG. 8B is a sectional view illustrating an unlocking state of the lock mechanism 114 according to the modification example. The driving portion 131 of the lock mechanism 114 illustrated in FIGS. 8A and 8B includes an actuator 139 for generating a driving force. The actuator 139 may be, for example, a hydraulic actuator such as a hydraulic cylinder, or an electric actuator such as a solenoid.

A sleeve 137 is provided around the operation support shaft 34. The sleeve 137 is able to rotate relatively in relation to the operation support shaft 34. Interlock portions 132*a* and 132*b* are provided on the sleeve 137. The interlock portion 132*a* protrudes radially outward of the sleeve 137 and obliquely upward. The front end portion of the linking member 133 is rotatably connected to the interlock portion 132*a* by means of the pin 135.

The interlock portion 132*b* protrudes radially outward of the sleeve 137 and obliquely downward. A pin 138*a* included in a link mechanism 138 is in engagement with an oblong hole 132*c* formed in the interlock portion 132*b*. The link mechanism 138 is connected to an operator 139*a* of the actuator 139. The link mechanism 138 transmits a driving force generated by the actuator 139 to the interlock portion 132*b*. A body portion 139*b* of the actuator 139 is fixed to, for example, the front base portion 32*f* of the third connecting member 32 (FIG. 4).

An operation actuator such as a button, a switch, a lever, or the like for driving the actuator 139 may be provided on the manipulator base 23 or the like. A controller for controlling the operation of the actuator 139 also may be provided in the manipulator base 23.

In a state illustrated in FIG. 8A, the actuator 139 generates a driving force for causing the operator 139*a* to protrude toward the rear A2 of the machine body 2 by its elastic member such as, for example, a built-in spring (not illustrated). Therefore, the driving force of the actuator 139 is transmitted to the link mechanism 138, the interlock portion 132*b*, the sleeve 137, the interlock portion 132*a*, the linking member 133, and the lock body 126 sequentially in this order, and the lock body 126 is in a state of being rotated in the locking direction F1. In addition, the lock pin 126C is in engagement with the engagement grooves 46L and 46R. That is, in FIG. 8A, the lock body 126 is at the engagement position P1, and the lock mechanism 114 is in a state of locking the operation member 41.

From the state in which the operation member 41 is locked by the lock mechanism 114, the actuator 139 drives to cause the operator 139*a* to move toward the front A1 of the machine body 2 (a state of being pulled into the body portion 139*b*). Accordingly, the driving force is transmitted to the interlock portion 132*b*, the sleeve 137, the interlock portion 132*a*, the linking member 133, and the lock body 126 sequentially in this order to cause the lock body 126 to rotate in the unlocking direction F2 as illustrated in FIG. 8B. The lock pin 126C becomes disengaged from the engagement grooves 46L and 46R. That is, in FIG. 8B, the operation member 41 is not locked by the lock mechanism 114 due to movement of the lock body 126 to the disengagement position P2.

Instead of the structure described above, for example, the link mechanism 138, the interlock portions 132*a* and 132*b*, the sleeve 137, and the linking member 133 may be omitted, and the operator 139*a* of the actuator 139 may be connected directly or indirectly to the upper end portion of the lock body 126. In this case, the driving force of the actuator 139 is applied directly or indirectly to the lock body 126, and the lock body 126 rotates in the locking direction F1 or the unlocking direction F2 to bring the lock pin 126C into, or out of, engagement with the engagement grooves 46L and 46R.

Next, a second embodiment will now be described.

Figure 9:
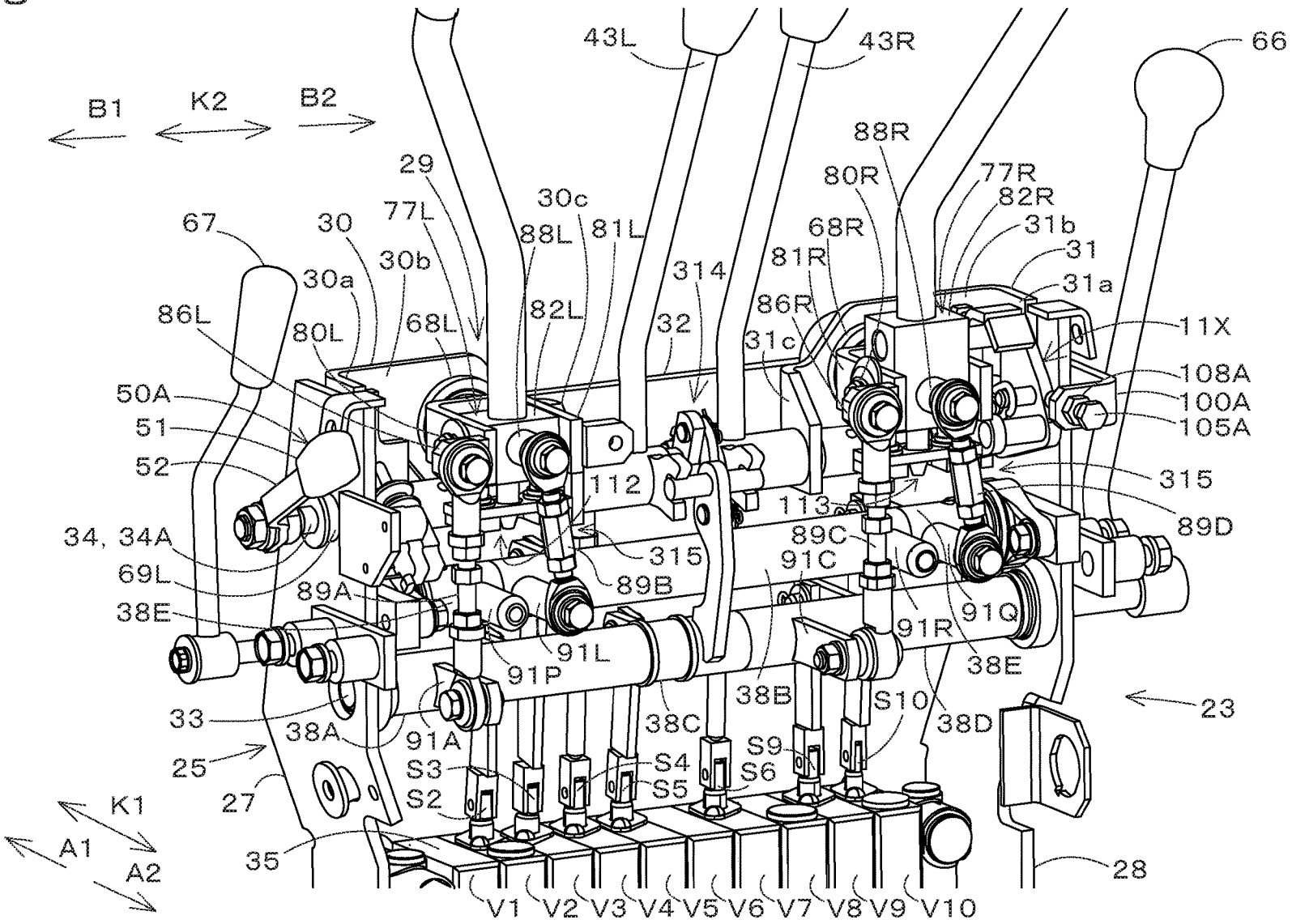
FIG. 9 is a rear perspective view of an upper portion of an inner structure of a manipulator base according to a second embodiment.
Figure 10:
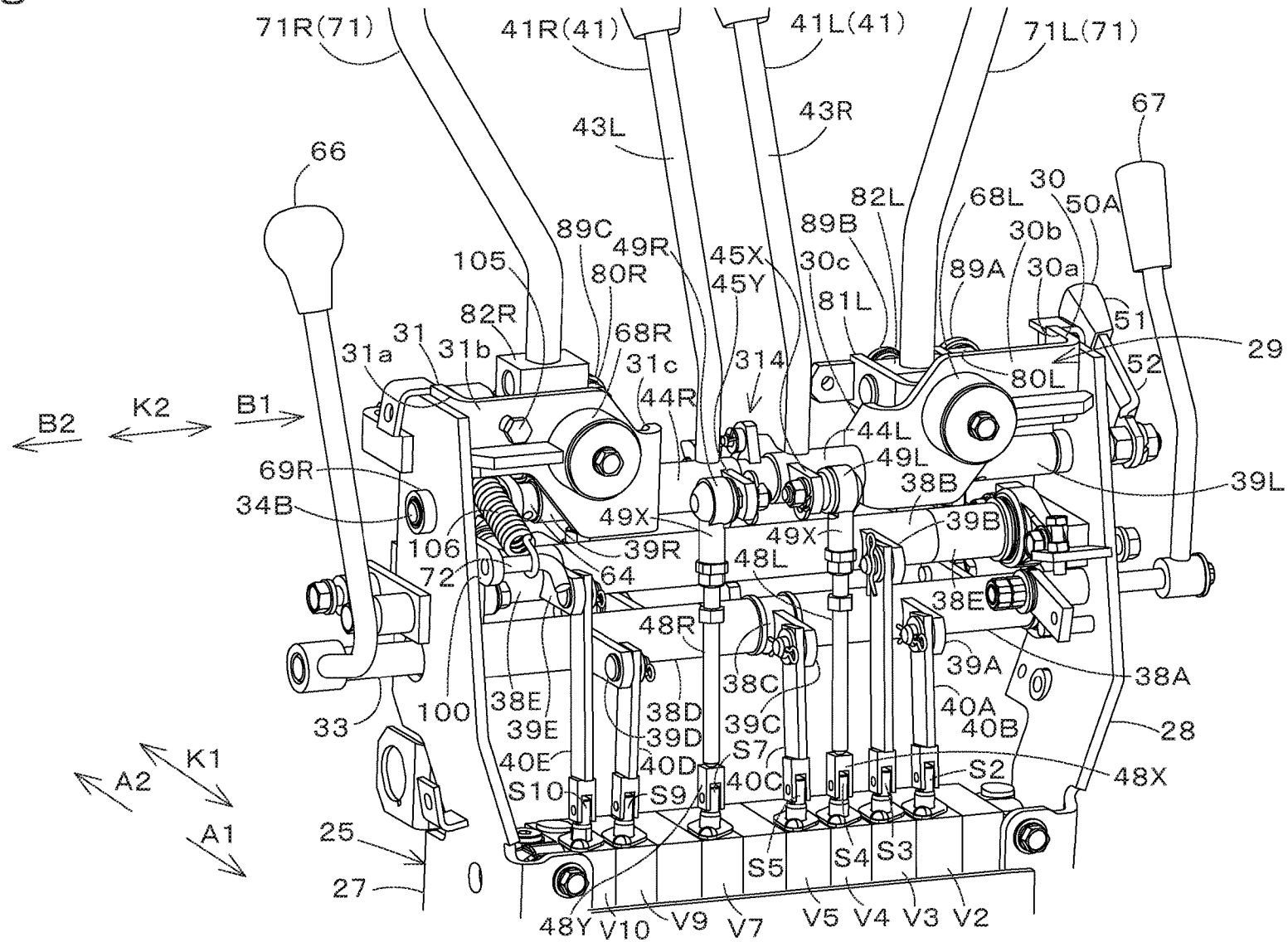
FIG. 10 is a front perspective view of the upper portion of the inner structure of the manipulator base according to the second embodiment.
Figure 11:
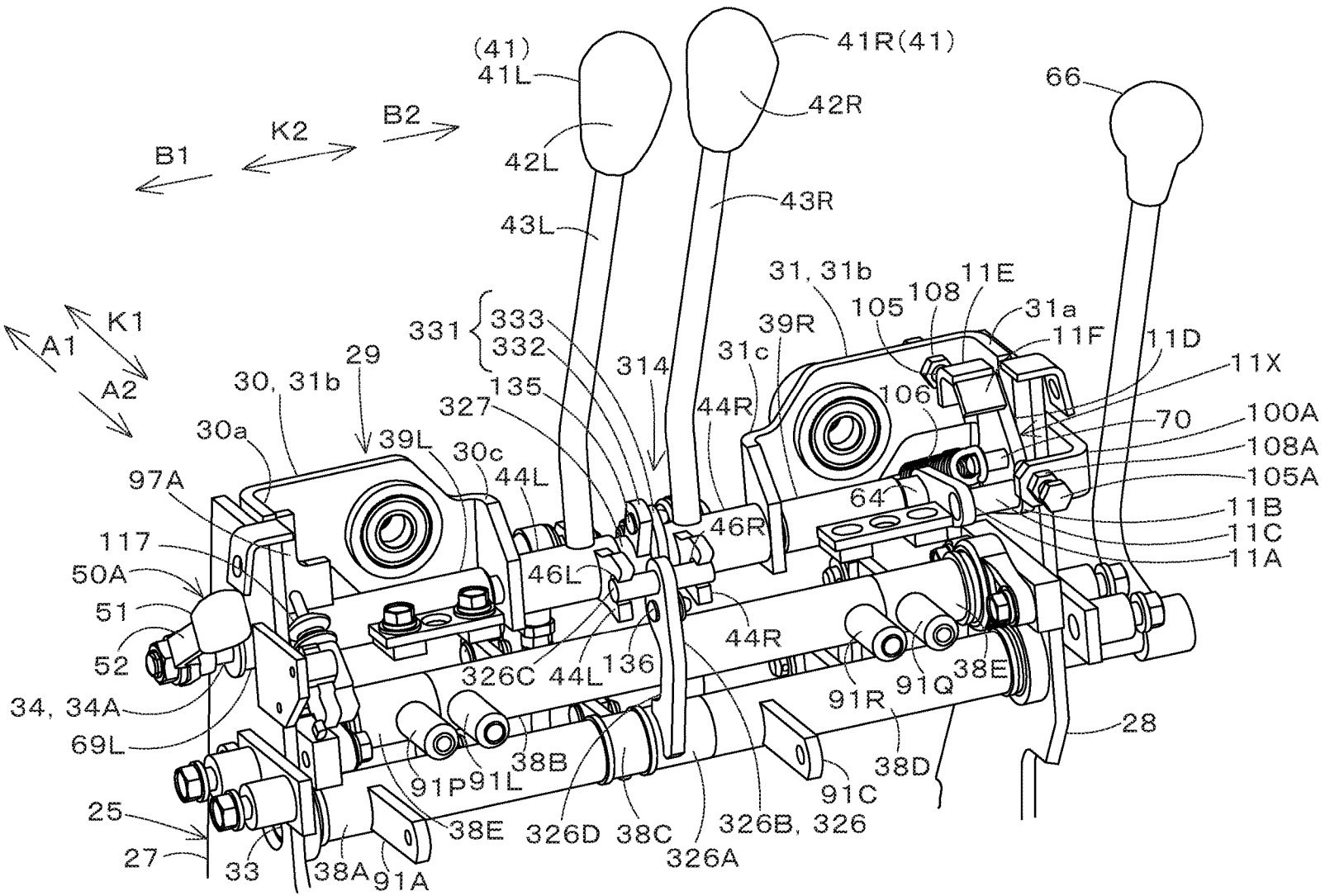
FIG. 11 is a rear perspective view of a lock mechanism according to the second embodiment.

FIG. 9 is a perspective view of an upper portion of the inner structure of the manipulator base 23 viewed obliquely from behind (A2) (from the side where the operator's seat 6 is located). FIG. 10 is a perspective view of the upper portion of the inner structure of the manipulator base 23 viewed obliquely from ahead (A1) of the machine body 2 (from the side where the working device 4 is located). FIG. 11 is an enlarged perspective view of a lock mechanism 314 illustrated in FIG. 9.

A support frame 25 forming the skeleton of the manipulator base 23 is included in the inner structure of the manipulator base 23. The first cover 26F and the second cover 26B illustrated in FIG. 1, etc. are fixed to the support frame 25 by means of fastening members (not illustrated) such as bolts and nuts.

As illustrated in FIG. 9, the support frame 25 includes the first vertical member 27, which is a left portion thereof, the second vertical member 28, which is a right portion thereof, and the connecting body 29, which connects these two vertical members 27 and 28 to each other. The first vertical member 27 and the second vertical member 28 have a plate shape. The first vertical member 27 and the second vertical member 28 are provided upright on the machine body 2, with their respective plate surfaces oriented in the machine-body width direction K2. The first vertical member 27 and the second vertical member 28 face each other, with a predetermined distance therebetween in the machine-body width direction K2. The connecting body 29 is provided between an upper portion of the first vertical member 27 and an upper portion of the second vertical member 28. The connecting body 29 includes a first connecting member 30, a second connecting member 31, and a third connecting member 32 (FIG. 9). In FIGS. 10 and 11, for simple illustration, the third connecting member 32 is not illustrated.

The first connecting member 30 is connected to the upper portion of the first vertical member 27. The second connecting member 31 is connected to the upper portion of the second vertical member 28. The first connecting member 30 and the second connecting member 31 are provided at a distance from each other in the machine-body width direction K2. The third connecting member 32 connects the first connecting member 30 and the second connecting member 31 to each other. The first connecting member 30 is disposed at a position closer to the second vertical member 28 than the first vertical member 27 is to the second vertical member 28, and is connected to the first vertical member 27. The first connecting member 30 includes the first wall 30*a*, the second wall 30*b*, and a third wall 30*c*. The first wall 30*a* is fixed along the first vertical member 27. A first bushing 69L is disposed below the first wall 30*a*. The first bushing 69L is provided through the first vertical member 27 and has an axis extending in the machine-body width direction K2. The second wall 30*b* extends from the front end portion of the first wall 30*a* inward with respect to the machine body. A first support sleeve 68L is provided through the second wall 30*b*. The first support sleeve 68L has an axis extending in the front-rear direction K1.

The second connecting member 31 is disposed at a position closer to the first vertical member 27 than the second vertical member 28 is to the first vertical member 27, and is connected to the second vertical member 28. The second connecting member 31 includes the first wall 31*a*, the second wall 31*b*, and a third wall 31*c*. The first wall 31*a* is fixed along the second vertical member 28. As illustrated in FIG. 10, a second bushing 69R is disposed below the first wall 31*a*. The second bushing 69R is provided through the second vertical member 28 and has an axis extending in the machine-body width direction K2. The second wall 31*b* extends from the front end portion of the first wall 31*a* inward with respect to the machine body. A second support sleeve 68R is provided through the second wall 31*b*. The second support sleeve 68R has an axis extending in the front-rear direction K1.

The third wall 30*c* of the first connecting member 30 is fixed in such a way as to protrude rearward (A2) from the rear face of the right end portion of the second wall 30*b*. The third wall 31*c* of the second connecting member 31 is fixed in such a way as to protrude rearward (A2) from the rear face of the left end portion of the second wall 31*b*.

An operation support shaft (first shaft) 34 is provided on the upper portion of the support frame 25. The operation support shaft 34 has an axis extending in the machine-body width direction K2. The operation support shaft 34 is supported by the first vertical member 27 and the second vertical member 28 of the support frame 25 in such a way as to be able to rotate on its axis. The operation support shaft 34 includes a first shaft portion 34A and a second shaft portion 34B (FIG. 10).

As illustrated in FIG. 9, etc., the first shaft portion 34A is inserted through the first bushing 69L, the first wall 30*a* and the third wall 30*c* of the first connecting member 30, and the third wall 31*c* of the second connecting member 31. The first shaft portion 34A is supported by the first bushing 69L and the third walls 30*c* and 31*c* in such away as to be able to rotate on the axis of the first bushing 69L. As illustrated in FIG. 10, etc., the second shaft portion 34B is disposed to the right of (B2) and rearward of (A2) the first shaft 34A. The second shaft portion 34B is inserted through the second bushing 69R. The second shaft portion 34B is supported by the second bushing 69R in such a way as to be able to rotate on the axis of the second bushing 69R.

The first shaft portion 34A and the second shaft portion 34B are disposed at a distance from each other in the machine-body width direction K2. As illustrated in FIG. 11, etc., a connection member 11X is provided between the first shaft portion 34A and the second shaft portion 34B. The first shaft portion 34A and the second shaft portion 34B are connected to each other by the connection member 11X in such a way as to be able to rotate together. As described above, the operation support shaft 34, which is made up of the first shaft portion 34A and the second shaft portion 34B, is supported by the first vertical member 27, the second vertical member 28, the first connecting member 30, and the second connecting member 31. The operation support shaft 34 may have a single-shaft structure.

The connection member 11X includes a first sidewall 11A connected to the first shaft portion 34A, a second sidewall 11B connected to the second shaft portion 34B, a connecting portion 11C connecting the first sidewall 11A and the second sidewall 11B to each other, and an extending portion 11D extending upward from the second sidewall 11B. The first sidewall 11A and the second sidewall 11B are disposed at a predetermined distance from each other in the machine-body width direction K2. The connecting portion 11C connects the rear end portion of the first sidewall 11A and the rear end portion of the second sidewall 11B to each other. A connection sleeve 64 is provided on the first sidewall 11A. The right end portion of the first shaft portion 34A is inserted in the connection sleeve 64 and is fixed to the connection sleeve 64. Because of this structure, the first shaft portion 34A and the first sidewall 11A are capable of rotating together.

Contact plates 11E and 11F and a first spring hook portion 70 are provided on the extending portion 11D of the connection member 11X in such a way as to protrude leftward (B1). The first contact plate 11E is disposed in front of (A1)

the second contact plate 11F. The first spring hook portion 70 is a pin, and protrudes from the extending portion 11D toward the first shaft portion 34A (leftward B1). As illustrated in FIG. 10, a second spring hook portion 72 is provided below the second wall 31*b* of the second connecting member 31. The second spring hook portion 72 is a bent pin, and is fixed to a holding plate 100. The holding plate 100 is fixed to the machine-body-inward surface of the second vertical member 28 and protrudes forward A1 of the second vertical member 28. The second spring hook portion 72 protrudes from the holding plate 100 leftward B1 and is then bent forward A1.

As illustrated in FIG. 11, etc., a sleeve 39L is mounted radially outward of the left portion (between the first wall 30*a* and the third wall 30*c* of the first connecting member 30) of the first shaft portion 34A. The sleeve 39L is fixed to the first shaft portion 34A by means of pins or the like and is capable of rotating together with the first shaft portion 34A. A sleeve-shaped spacer 39R is mounted radially outward of the right portion (between the third wall 31*c* of the second connecting member 31 and the connection member 11X) of the first shaft portion 34A. The spacer 39R is fixed to the first shaft portion 34A by means of pins or the like.

As illustrated in FIG. 9, a control valve 35 is provided in the manipulator base 23. The control valve 35 is a collective concept comprised of a plurality of control valves V1 to V10 for controlling hydraulic actuators of the working machine 1. The control valve 35 is provided between a lower portion of the first vertical member 27 and a lower portion of the second vertical member 28.

Each control valve V1 to V10 is a linear-movement-spool-type direction-switching valve. The spool of each control valve V1 to V10 is held at its neutral position by an urging force applied by an urging spring housed inside a valve body, and is operated up/down from the neutral position against the urging force applied by the urging spring. These plural control valves are first to tenth control valves V1 to V10. The first to tenth control valves V1 to V10 are mechanical-operation-type direction-switching valves whose spool position is switched manually.

The first control valve V1 is a transmission control valve for controlling a swash-plate cylinder (not illustrated) configured to change the tilt angle of the swash plate of the first traveling motor M1 and that of the second traveling motor M2 (FIG. 25). The second control valve V2 is a swiveling control valve for controlling the swiveling motor M3 (FIG. 24). The third control valve V3 is an arm control valve for controlling the arm cylinder C4 (FIG. 24). The fourth control valve V4 is a first traveling control valve (traveling control valve) for controlling the first traveling motor M1 (FIG. 24). The fifth control valve V5 is a dozer control valve for controlling the dozer cylinder C1 (FIG. 24). The sixth control valve V6 is a spare control valve for controlling a hydraulic attachment. The seventh control valve V7 is a second traveling control valve (traveling control valve) for controlling the second traveling motor M2 The eighth control valve V8 is a swing control valve for controlling the swing cylinder C2 (FIG. 24). The ninth control valve V9 is a bucket control valve for controlling the bucket cylinder C5 (FIG. 24). The tenth control valve V10 is a boom control valve for controlling the boom cylinder C3 (FIG. 24). The third control valve V3, the ninth control valve V9, and the tenth control valve V10 are work control valves for controlling hydraulic actuators configured to drive the working device 4 (FIG. 24).

The operation shaft 33 (FIG. 9, etc.) and a support shaft 37 (FIG. 12A, etc. described later) are provided on the manipulator base 23. The operation shaft (second shaft) 33 is provided under the connecting body 29 and the operation support shaft 34 and over the control valve 35. The support shaft (third shaft) 37 is provided between the operation support shaft 34 and the operation shaft 33. Each of the operation shaft 33 and the support shaft 37 has an axis extending in the machine-body width direction K2 and is provided from the first vertical member 27 to the second vertical member 28. That is, the operation shaft 33 and the support shaft 37 are provided in parallel with the operation support shaft 34. In addition, the operation shaft 33 is supported by the first vertical member 27 and the second vertical member 28 in such a way as to be able to rotate on its axis. The right portion of the operation shaft 33 protrudes beyond the second vertical member 28 outward with respect to the machine body. The support shaft 37 is supported by the first vertical member 27 and the second vertical member 28.

A first rotary sleeve 38A, a third rotary sleeve 38C, and a fourth rotary sleeve 38D are mounted radially outward of the operation shaft 33. The third rotary sleeve 38C rotates together with the operation shaft 33. The first rotary sleeve 38A and the fourth rotary sleeve 38D rotate relatively in relation to the operation shaft 33. A fifth rotary sleeve 38E is mounted radially outward of the support shaft 37. A second rotary sleeve 38B is mounted radially outward of the middle portion of the fifth rotary sleeve 38E (see FIG. 12A, etc.).

As illustrated in FIG. 9, a first relaying strip 91A is provided on the rear portion of the first rotary sleeve 38A in such a way as to protrude rearward A2. Connecting portions 91L and 91R are provided on the left and right end portions of the second rotary sleeve 38B in such a way as to protrude rearward A2. A third relaying strip 91C is provided on the rear portion of the fourth rotary sleeve 38D in such a way as to protrude rearward A2. Connecting portions 91P and 91Q are provided on the left and right end portions of the fifth rotary sleeve 38E in such a way as to protrude rearward A2.

As illustrated in FIG. 10, a first arm 39A is provided on the front portion of the first rotary sleeve 38A in such a way as to protrude forward A1. A second arm 39B is provided on the front portion of the second rotary sleeve 38B in such a way as to protrude forward A1. A third arm 39C is provided on the front portion of the third rotary sleeve 38C in such a way as to protrude forward A1. A fourth arm 39D is provided on the front portion of the fourth rotary sleeve 38D in such a way as to protrude forward A1. A fifth arm 39E is provided on the front portion of the fifth rotary sleeve 38E in such a way as to protrude forward A1.

The first rotary sleeve 38A is connected to the spool S2 of the second control valve V2 via the arm 39A and a link 40A. The second rotary sleeve 38B is connected to the spool S3 of the third control valve V3 via the arm 39B and a link 40B. The third rotary sleeve 38C is connected to the spool S5 of the fifth control valve V5 via the arm 39C and a link 40C. The fourth rotary sleeve 38D is connected to the spool S9 of the ninth control valve V9 via the arm 39D and a link 40D. The fifth rotary sleeve 38E is connected to the spool S10 of the tenth control valve V10 via the arm 39E and a link 40E.

A plurality of levers, pedals, and the like for operating the working device 4, the dozer device 7, the traveling device 3 (FIG. 24), and other devices of the working machine 1 respectively are provided on the manipulator base 23. A dozer lever (second operation member) 66 for operating the dozer device 7 is provided to the right of (B2) the manipulator base 23. The base portion of the dozer lever 66 is fixed to the right portion of the operation shaft 33. Swinging the dozer lever 66 forward/rearward causes the operation shaft 33 and the third rotary sleeve 38C to rotate, resulting in that the spool S5 of the fifth control valve V5 is pushed/pulled via the arm 39C and the link 40C. The dozer cylinder C1 is controlled by this operation, and the dozer device 7 is therefore driven.

An accelerator lever 67 for operating the number of revolutions of the prime mover Eg is provided to the left of (B1) the manipulator base 23. A first pedal supporting portion and a second pedal supporting portion are provided at the lower portion of the first vertical member 27 (see FIG. 24, numerals omitted). The first pedal supporting portion supports a transmission pedal (not illustrated) for operating the first control valve V1 (FIG. 9). The second pedal supporting portion supports an SP pedal (not illustrated) for operating the sixth control valve V6 (FIG. 9). A third pedal supporting portion is provided at the lower portion of the second vertical member 28 (not illustrated). The third pedal supporting portion supports a swing pedal (not illustrated) for operating the eighth control valve V8 (FIG. 9).

As illustrated in FIG. 1, etc., an operation member (first operation member) 41 and a manipulation member (third operation member) 71 are provided over the manipulator base 23. The operation member 41 is comprised of traveling levers for operating the traveling device 3 (traveling control valves). The operation member 41 is disposed over the top portion of the manipulator base 23 and at the center portion thereof in the machine-body width direction K2. The operation member 41 includes a first traveling lever 41L and a second traveling lever 41R. The first traveling lever 41L and the second traveling lever 41R are disposed next to each other in the machine-body width direction K2. The first traveling device 3L is operated by manipulating the first traveling lever 41L. The second traveling device 3R is operated by manipulating the second traveling lever 41R. The first traveling lever 41L is located at a machine-body-inward position in relation to a first manipulation lever 71L, which will be described later. The second traveling lever 41R is located at a machine-body-inward position in relation to a second manipulation lever 71R, which will be described later, and to the right of (B2) the first traveling lever 41L.

The first traveling lever 41L includes a lever body 43L, which has a grip 42L on its head end (top), and a first base portion 44L (FIG. 10, etc.), which has a sleeve shape and is provided on the bottom of the lever body 43L. The first base portion 44L is disposed between the first connecting member 30 and the second connecting member 31. The first shaft portion 34A of the operation support shaft 34 is inserted through the first base portion 44L. That is, the first base portion 44L is disposed around the first shaft portion 34A. The first base portion 44L is supported such that it can rotate relatively on the axis of the first shaft portion 34A in relation to the first shaft portion 34A. Because of this structure, the first traveling lever 41L is supported by the operation support shaft 34 in such a way as to be able to rotate around the axis of the operation support shaft 34, and is thus able to be manipulated pivotally in the front-rear direction K1.

As illustrated in FIG. 10, a first arm protrusion portion 45X that is a plate member is provided on the first base portion 44L in such a way as to protrude forward A1. The first arm protrusion portion 45X rotates together with the first traveling lever 41L. One end (top portion) of a connecting rod 48L is connected to the first arm protrusion portion 45X, with a ball-and-socket joint 49L interposed therebetween. The other end (bottom portion) of the connecting rod 48L is connected to the spool S4 of the fourth control valve V4, with a connecting block 48X interposed therebetween. Swinging the first traveling lever 41L forward/rearward causes the first arm protrusion portion 45X to pivot up/down, resulting in that the spool S4 of the fourth control valve V4 is pushed/pulled via the connecting rod 48L. The first traveling motor M1 is controlled by this operation, and the first traveling device 3L is therefore driven.

As illustrated in FIG. 1, etc., the second traveling lever 41R includes a lever body 43R, which has a grip 42R on its head end (top), and a second base portion 44R (FIG. 10, etc.), which has a sleeve shape and is provided on the base portion (bottom) of the lever body 43R. The second base portion 44R is disposed between the first connecting member 30 and the second connecting member 31. The first shaft portion 34A of the operation support shaft 34 is inserted through the second base portion 44R. That is, the second base portion 44R is disposed around the first shaft portion 34A. The second base portion 44R is supported such that it can rotate relatively on the axis of the first shaft portion 34A in relation to the first shaft portion 34A. Because of this structure, the second traveling lever 41R is supported by the operation support shaft 34 in such a way as to be able to rotate around the axis of the operation support shaft 34, and is thus able to be manipulated pivotally forward and rearward.

As illustrated in FIG. 10, a second arm protrusion portion 45Y that is a plate member is provided on the second base portion 44R in such a way as to protrude forward A1. The second arm protrusion portion 45Y is disposed adjacent to the first arm protrusion portion 45X in a direction parallel to the axis of the operation support shaft 34. The second arm protrusion portion 45Y rotates together with the second traveling lever 41R. One end (top portion) of a connecting rod 48R is connected to the second arm protrusion portion 45Y, with a ball-and-socket joint 49R interposed therebetween. The other end (bottom portion) of the connecting rod 48R is connected to the spool S7 of the seventh control valve V7, with a connecting block 48Y interposed therebetween. Swinging the second traveling lever 41R forward/rearward causes the second arm protrusion portion 45Y to pivot up/down, resulting in that the spool S7 of the seventh control valve V7 is pushed/pulled via the connecting rod 48R. The second traveling motor M2 is controlled by this operation, and the second traveling device 3R is therefore driven.

The manipulation member 71 is a lever manipulated to operate the working device 4 and the machine body 2. The manipulation member 71 includes a first manipulation lever 71L and a second manipulation lever 71R provided to the right of (B2) the first manipulation lever 71L. The first manipulation lever 71L and the second manipulation lever 71R are disposed over the top portion of the manipulator base 23 and at a machine-body-outward position in relation to the operation member 41. More particularly, the first manipulation lever 71L is disposed at a machine-body-outward position (to the left of) in relation to the first traveling lever 41L. The second manipulation lever 71R is disposed at a machine-body-outward position (to the right of) in relation to the second traveling lever 41R. The machine body 2, the arm 16, the boom 15, and the bucket 17 are operated by manipulating the manipulation levers 71L and 71R.

The first manipulation lever 71L has a grip 78L (FIG. 2) on its head end (top). The base portion (bottom portion) of the first manipulation lever 71L is supported indirectly on the support frame 25, with a first support 77L (FIG. 9) provided therebetween, such that lever swinging in given swing directions can be performed. The second manipulation lever 71R has a grip 78R (FIG. 2) on its head end (top). The base portion (bottom portion) of the second manipulation lever 71R is supported indirectly on the support frame 25, with a second support 77R (FIG. 9) provided therebetween, such that lever swinging in given swing directions can be performed. The swing directions of the first manipulation lever 71L and the second manipulation lever 71R are: the front-rear direction K1, the machine-body width direction K2, and oblique directions between the front-rear direction K1 and the machine-body width direction K2.

As illustrated in FIG. 9, the first support 77L disposed under the first manipulation lever 71L includes a first bracket 81L and a first lever fixing portion 82L. The first bracket 81L is supported rotatably on the first bushing 68L via a first pivot (not illustrated) parallel to the front-rear direction K1. The first lever fixing portion 82L, in a state of being inserted in the first bracket 81L, is supported rotatably on the first bracket 81L via a second pivot 80L parallel to the machine-body width direction K2. The base portion of the first manipulation lever 71L is fixed to the top face of the first lever fixing portion 82L. A connecting portion 88L is provided on the rear face of the first lever fixing portion 82L in such a way as to protrude rearward A2. The above structure enables the first manipulation lever 71L to be manipulated pivotally in the machine-body width direction K2 around the first pivot parallel to the front-rear direction K1 (or the first bushing 68L) and to be manipulated pivotally in the front-rear direction K1 around the second pivot 80L.

A connecting strip 86L is provided on the rear left portion of the first bracket 81L in such a way as to protrude leftward B1. The upper end portion of the first interlock member 89A is connected to the connecting strip 86L. The lower end portion of the first interlock member 89A is connected to the first relaying strip 91A. Therefore, swinging the first manipulation lever 71L in the machine-body width direction K2 causes the pushing/pulling of the spool S2 of the second control valve V2 via the first interlock member 89A, the first relaying strip 91A, the first rotary sleeve 38A, the first arm 39A, the link 40A, and the like. Then, the swiveling motor M3 is controlled, and the machine body 2 swivels to the left/right.

The second support 77R disposed under the second manipulation lever 71R includes a second bracket 81R and a second lever fixing portion 82R. The second bracket 81R is supported rotatably on the second bushing 68R via a third pivot (not illustrated) parallel to the front-rear direction K1. The second lever fixing portion 82R, in a state of being inserted in the second bracket 81R, is supported rotatably on the second bracket 81R via a fourth pivot 80R parallel to the machine-body width direction K2. The base portion of the second manipulation lever 71R is fixed to the top face of the second lever fixing portion 82R. A connecting portion 88R is provided on the rear face of the second lever fixing portion 82R in such a way as to protrude rearward A2. The above structure enables the second manipulation lever 71R to be manipulated pivotally in the machine-body width direction K2 around the third pivot parallel to the front-rear direction K1 (or the second bushing 68R) and to be manipulated pivotally in the front-rear direction K1 around the fourth pivot 80R.

A connecting strip 86R is provided on the rear left portion of the second bracket 81R in such a way as to protrude leftward B1. The upper end portion of the third interlock member 89C is connected to the connecting strip 86R. The lower end portion of the third interlock member 89C is connected to the third relaying strip 91C. Therefore, when the second manipulation lever 71R is swung in the machine-body width direction K2, the spool S9 of the ninth control valve V9 is pushed/pulled via the third interlock member 89C, the third relaying strip 91C, the fourth rotary sleeve 38D, the fourth arm 39D, the link 40D, and the like. Then, the bucket cylinder C5 is controlled, and the bucket 17 pivots up/down.

An operation switching mechanism 315 is provided under the manipulation levers 71L, 71R. The operation switching mechanism 315 is a mechanism that transmits a force of swing manipulation of the first and second manipulation levers 71L, 71R in the front-rear direction K1 to the control valves V3 and V10 and switches the objects to be operated by the first and second manipulation levers 71L, 71R. The operation switching mechanism 315 is also called TPSS (Two Pattern Selective System).

The operation switching mechanism 315 includes the second rotary sleeve (rotary member) 38B, the fifth rotary sleeve (rotary member) 38E, the second interlock member (link member) 89B, and the fourth interlock member (link member) 89D. The upper end portion of the second interlock member 89B is connected to the connecting portion 88L of the first lever fixing portion 82L. The lower end portion of the second interlock member 89B can be connected to either the connecting portion 91L of the second rotary sleeve 38B or the connecting portion 91P of the fifth rotary sleeve 38E in a selectable manner. The upper end portion of the fourth interlock member 89D is connected to the connecting portion 88R of the second lever fixing portion 82R. The lower end portion of the fourth interlock member 89D can be connected to either the connecting portion 91Q of the fifth rotary sleeve 38E or the connecting portion 91R of the second rotary sleeve 38B in a selectable manner.

As illustrated in FIG. 9, etc., the lower end portion of the second interlock member 89B is connected to the connecting portion 91L of the second rotary sleeve 38B, and the lower end portion of the fourth interlock member 89D is connected to the connecting portion 91Q of the fifth rotary sleeve 38E. In this case, when the first manipulation lever 71L is swung in the front-rear direction K1, the spool S3 of the third control valve V3 is pushed/pulled via the second interlock member 89B, the second rotary sleeve 38B, the second arm 39B, the link 40B, and the like. Then, the arm cylinder C4 is controlled, and the arm 16 moves pivotally forward/rearward. When the second manipulation lever 71R is swung in the front-rear direction K1, the spool S10 of the tenth control valve V10 is pushed/pulled via the fourth interlock member 89D, the fifth rotary sleeve 38E, the fifth arm 39E, the link 40E, and the like. Then, the boom cylinder C3 is controlled, and the boom 15 moves pivotally forward/rearward. That is, the target of operation by swinging the first manipulation lever 71L forward/rearward in this case is the third control valve V3, the arm cylinder C4, and the arm 16. The target of operation by swinging the second manipulation lever 71R forward/rearward is the tenth control valve V10, the boom cylinder C3, and the boom 15.

On the other hand, the lower end portion of the second interlock member 89B is connected to the connecting portion 91P of the fifth rotary sleeve 38E, and the lower end portion of the fourth interlock member 89D is connected to the connecting portion 91R of the second rotary sleeve 38B. In this case, when the first manipulation lever 71L is swung in the front-rear direction K1, the spool S10 of the tenth control valve V10 is pushed/pulled via the second interlock member 89B, the fifth rotary sleeve 38E, the fifth arm 39E, the link 40E, and the like. Then, the boom cylinder C3 is controlled, and the boom 15 moves pivotally forward/rearward. When the second manipulation lever 71R is swung in the front-rear direction K1, the spool S3 of the third control valve V3 is pushed/pulled via the fourth interlock member 89D, the second rotary sleeve 38B, the second arm 39B, the link 40B, and the like. Then, the arm cylinder C4 is controlled, and the arm 16 moves pivotally forward/rearward. That is, the target of operation by swinging the first manipulation lever 71L forward/rearward in this case is the tenth control valve V10, the boom cylinder C3, and the boom 15. The target of operation by swinging the second manipulation lever 71R forward/rearward is the third control valve V3, the arm cylinder C4, and the arm 16.

A lock lever 50A is provided to the left of the manipulator base 23. The lock lever 50A is a member for locking the operation member 41 and the manipulation member 71 (mechanically restricting them to render them immovable) and unlocking them (canceling the mechanical restrictions on them to render them movable). The lock lever 50A is disposed at a machine-body-outward position in relation to the first manipulation lever 71L. The lock lever 50A includes a lever body 52, on the head end of which a grip 51 is mounted. As illustrated in FIG. 9, etc., the base portion (bottom portion) of the lever body 52 is fixed to the left end of the first shaft portion 34A of the operation support shaft 34. Therefore, the lock lever 50A can be rotated together with the operation support shaft 34 and be manipulated pivotally upward and downward.

Figure 12A:
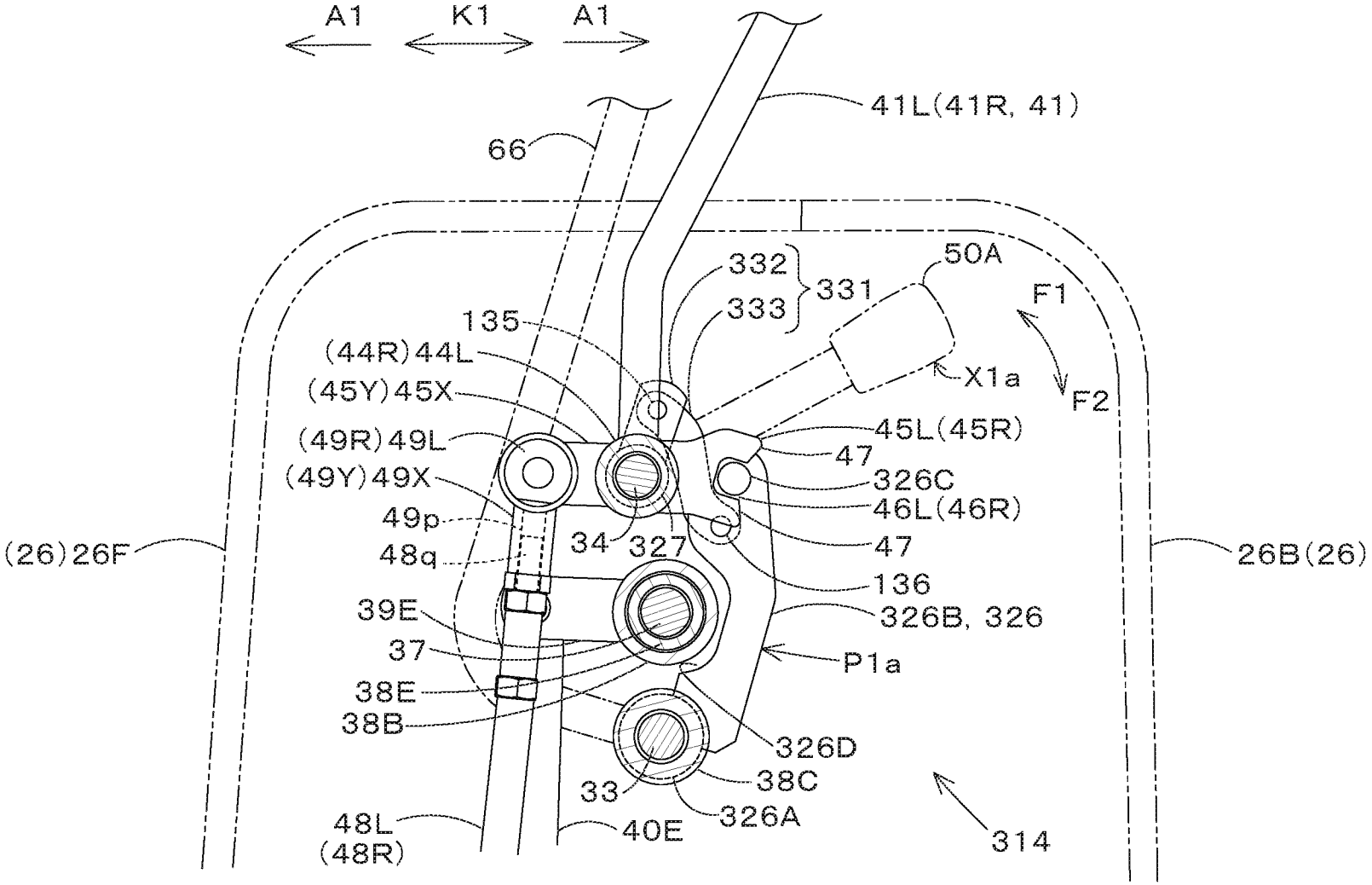
FIG. 12A is a sectional view illustrating a locking state of the lock mechanism according to the second embodiment.
Figure 12B:
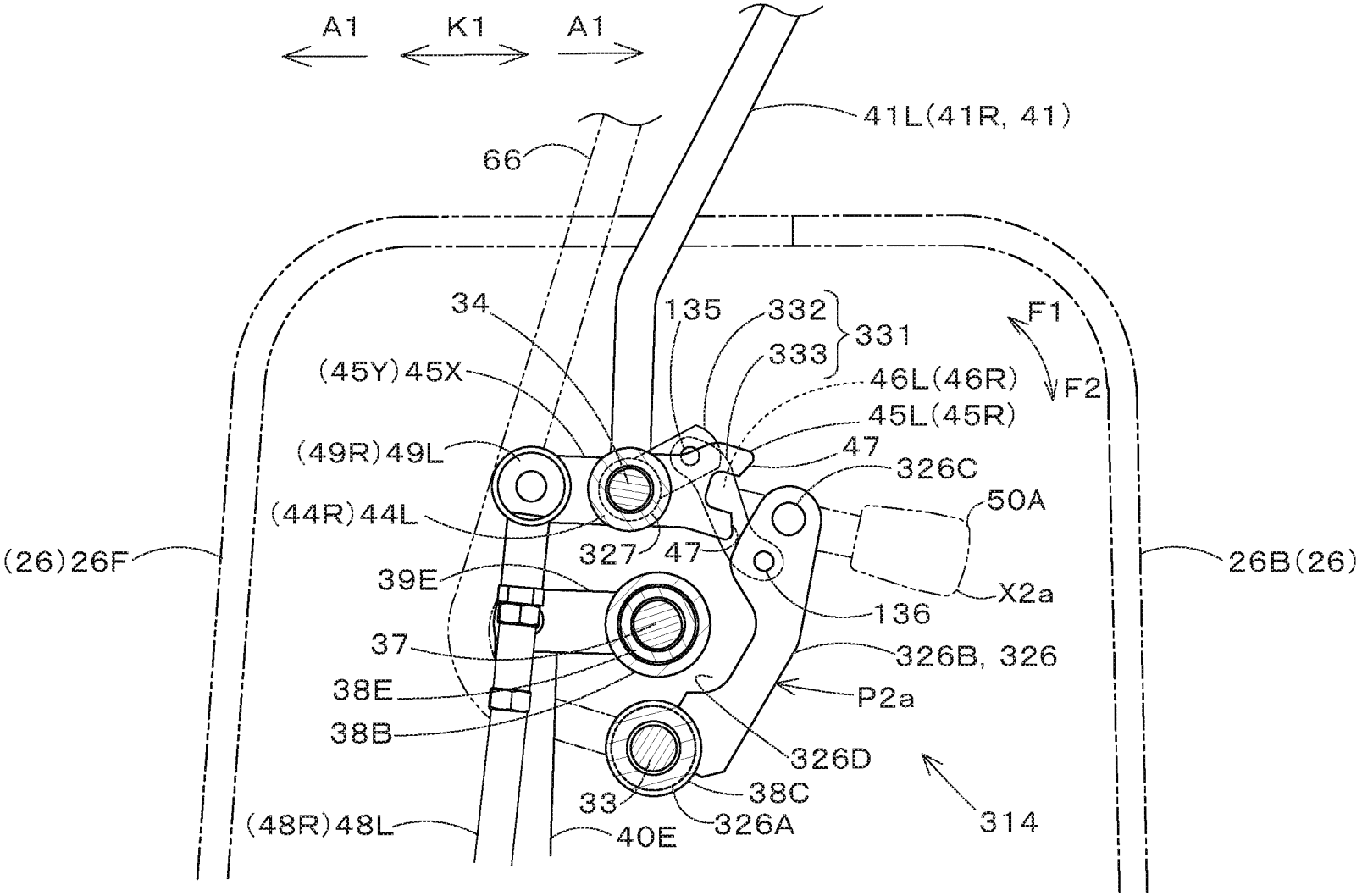
FIG. 12B is a sectional view illustrating an unlocking state of the lock mechanism according to the second embodiment.

By being manipulated pivotally upward and downward, the lock lever 50A is capable of changing its position between a first position X1*a* (FIG. 12A to be described later) and a second position X2*a* (FIG. 12B to be described later). The first position X1*a* is a raised position of the lock lever 50A (a state in which the head end of the lever body 52 is directed obliquely upward rearward). The second position X2*a* is a lowered position of the lock lever 50A (a state in which the head end of the lever body 52 is directed obliquely downward rearward). The length of the lock lever 50A (the length from the base portion to the head end of the lever body 52) is less than that of related-art lock levers such as one disclosed in Japanese Unexamined Patent Application Publication No. 2018-199917. Therefore, no matter which of the first position X1*a* and the second position X2*a* the lock lever 50A is at, it does not protrude to the passage 22 (FIG. 24) and is not obstructive to the operator getting on and off the machine body 2 via the passage 22.

When the lock lever 50A is at the first position X1*a*, the operation member 41 and the manipulation member 71 are locked, and the operation member 41 and the manipulation member 71 cannot be manipulated. When the lock lever 50A is at the second position X2*a*, the operation member 41 and the manipulation member 71 are not locked (unlocked), and the operation member 41 and the manipulation member 71 can be manipulated.

As illustrated in FIG. 11, etc., a limit switch 117 is provided at a machine-body-inward position in relation to the upper portion of the first vertical member 27. A contact member 97A is provided on the circumferential surface of the left end portion of the sleeve 39L in such a way as to protrude in a radially outward direction of the sleeve 39L and upward. The first shaft portion 34A of the operation support shaft 34 is inserted in the sleeve 39L. The sleeve 39L is fixed to the first shaft portion 34A. Therefore, the sleeve 39L and the contact member 97 rotate together with the operation support shaft 34.

When the lock lever 50A is at the first position X1*a* (the position for locking the operation member 41 and the manipulation member 71), the contact member 97A is not in contact with the limit switch 117, and the limit switch 117 is in an OFF state (the state illustrated in FIGS. 9 and 11). When the lock lever 50A is at the second position X2*a* (the position for unlocking the operation member 41 and the manipulation member 71), the contact member 97A is in contact with the limit switch 117, and the limit switch 117 is in an ON state.

An ON signal is transmitted from the limit switch 117 to an electronic controller (not illustrated) provided in the working machine 1 when the limit switch 117 is in an ON state. An ON signal is not transmitted from the limit switch 117 to the electronic controller when the limit switch 117 is in an OFF state. Therefore, based on whether there is an ON signal coming from the limit switch 117 or not, the electronic controller is capable of detecting the position of the lock lever 50A.

An urging member 106 for keeping the lock lever 50A at the first position X1*a* and the second position X2*a* is provided at a machine-body-inward position in relation to the upper portion of the second vertical member 28. The urging member 106 is a tension coil spring. The rear end of the urging member 106 is hooked on the first spring hook portion 70 provided on the connection member 11X. As illustrated in FIG. 10, the front end of the urging member 106 is hooked on the second spring hook portion 72, which is fixed indirectly to the second vertical member 28 by means of the holding plate 100.

An urging force of the urging member 106 switches in terms of its direction of acting on the lock lever 50A between when the lock lever 50A is at the first position X1*a* and when the lock lever 50A is at the second position X2*a*. That is, when the lock lever 50A is at the first position X1*a*, the axial center of the urging member 106 is located above the axial center of the operation support shaft 34. Therefore, when the lock lever 50A is at the first position X1*a* (the state illustrated in FIG. 12A), the urging force of the urging member 106 acts in a direction of causing the lock lever 50A to rotate upward (raising direction of the grip 51, the locking direction F1 illustrated in FIG. 12A, etc.). The lock lever 50A is kept at the first position X1*a* due to this urging force.

When the lock lever 50A is at the second position X2*a*, the axial center of the urging member 106 is located below the axial center of the operation support shaft 34. Therefore, when the lock lever 50A is at the second position X2*a* (the state illustrated in FIG. 12B), the urging force of the urging member 106 acts in a direction of causing the lock lever 50A to rotate downward (lowering direction of the grip 51, the unlocking direction F2 illustrated in FIG. 12B, etc.). The lock lever 50A is kept at the second position X2*a* due to this urging force.

As illustrated in FIG. 11, a stopper 105 is provided in front of (A1) the contact plate 11E of the connection member 11X. The stopper 105 is a bolt. The stopper 105 is in threaded engagement with a screw hole (not illustrated) formed through the second wall 31*b* of the second connecting member 31. A lock nut 108 for fixing the position of the stopper 105 is threaded on the stopper 105. The contact plate 11E is in contact with the stopper 105 when the lock lever 50A is at the first position X1*a*. This restricts upward rotation of the lock lever 50A (in the locking direction F1 illustrated in FIG. 12A, etc.).

A stopper 105A is provided behind (A2) the connection member 11X. The stopper 105A is a bolt. The stopper 105A is fixed indirectly to the second vertical member 28 by means of a holding plate 100A. The stopper 105A is in threaded engagement with a screw hole (not illustrated) formed through the holding plate 100A. A third lock nut 108A for fixing the position of the stopper 105A is threaded on the stopper 105A. A contact plate 11F is in contact with the stopper 105A when the lock lever 50A is at the second position X2*a*. This restricts downward rotation of the lock lever 50A (in the unlocking direction F2 illustrated in FIG. 12B, etc.).

It is possible to adjust the position, when at the first position X1*a* and at the second position X2*a*, of the lock lever 50A around the operation support shaft 34 by threaded advancement/retraction of the stoppers 105 and 105A. The swingable angle (the angle of movement from one to the other of the first position X1*a* and the second position X2*a*) of the lock lever 50A, which is limited by the stopper 105, 105A as described above, is less than that of related-art lock levers such as one disclosed in Japanese Unexamined Patent Application Publication No. 2018-199917.

As illustrated in FIGS. 9 and 11, etc., the lock mechanism 314 for locking or unlocking the operation member 41 is provided near the center of the operation support shaft 34. Lock mechanisms 112 and 113 for locking or unlocking the manipulation member 71 are provided to the left and right of the lock mechanism 314. The structure and operation of the lock mechanisms 112 and 113 for the manipulation member 71 is the same as that of related art; therefore, an explanation of it is omitted.

Next, the lock mechanism 314 will now be described.

FIG. 12A is a sectional view illustrating a locking state of the lock mechanism 314. FIG. 12B is a sectional view illustrating an unlocking state of the lock mechanism 314. The lock mechanism 314 is switchable between a locking state, in which it restricts the motion of the operation member 41, and an unlocking state, in which it allows the motion of the operation member 41. As illustrated in FIGS. 11 to 12B, the lock mechanism 314 includes engagement portions 45L and 45R, a lock body 326, and a driving portion 331.

As illustrated in FIG. 11, the first engagement portion 45L is provided in such a way as to protrude rearward A2 from the first base portion 44L of the first traveling lever 41L radially outward of the first base portion 44L and the operation support shaft 34. The second engagement portion 45R is provided in such a way as to protrude rearward A2 from the second base portion 44R of the second traveling lever 41R radially outward of the second base portion 44R and the operation support shaft 34. Therefore, the first engagement portion 45L rotates together with the first traveling lever 41L, and the second engagement portion 45R rotates together with the second traveling lever 41R. That is, the engagement portion 45L, 45R rotates together with the operation member 41.

A first engagement groove 46L is formed in the head end of the first engagement portion 45L. A second engagement groove 46R is formed in the head end of the second engagement portion 45R. The first engagement groove 46L and the second engagement groove 46R are recessed radially inward of the operation support shaft 34 from the rear (A2) toward the front (A1). In other words, the first engagement groove 46L and the second engagement groove 46R are open-rearward (A2) grooves recessed toward the operation support shaft 34 from the head end of the first engagement portion 45L and the head end of the second engagement portion 45R. As illustrated in FIGS. 12A and 12B, sloped surfaces 47, which form a taper such that the distance from each other becomes longer as it goes rearward A2, are provided at an upper head-end surface and a lower head-end surface of each of the first engagement groove 46L and the second engagement groove 46R.

The lock body 326 includes a base sleeve 326A, a lock arm 326B, a lock pin 326C, and a cavity portion 326D. The base sleeve 326A constitutes a lower end portion (one end portion) of the lock body 326. The base sleeve 326A is located between the third rotary sleeve 38C and the fourth rotary sleeve 38D and is mounted around the operation shaft 33 in such a way as to be able to rotate on the axis thereof. That is, the operation shaft 33 supports the lock body 326 such that it can rotate relatively in relation to the operation shaft 33.

The lock arm 326B is provided on the base sleeve 326A in such a way as to protrude radially outward and upward. The lock arm 326B and the base sleeve 326A are formed integrally. The lock arm 326B moves pivotally in the front-rear direction K1 due to relative rotation of the base sleeve 326A on the axis of the operation shaft 33. The upper end portion of the lock arm 326B is located between the first engagement portion 45L and the second engagement portion 45R. The lock body 326 is disposed to extend from the operation shaft 33 radially outward around, and behind (A2), the second rotary sleeve 38B to the operation support shaft 34. The cavity portion 326D recessed rearward A2 is provided at the middle portion of the lock arm 326B.

The lock pin (engaged portion) 326C is provided on the upper end portion of the lock arm 326B. The lock pin 326C is fixed to the lock arm 326B in a state of being inserted through the upper end portion of the lock arm 326B to the left and right. That is, the lock pin 326C protrudes to both sides in the machine-body width direction K2 from the lock arm 326B. The left protrusion length of the lock pin 326C from the lock arm 326B is equal to the right protrusion length thereof.

A sleeve 327 (FIG. 11) is provided between the first base portion 44L of the first traveling lever 41L and the second base portion 44R of the second traveling lever 41R. The sleeve 327 is mounted around the first shaft portion 34A of the operation support shaft 34 and is fixed to the first shaft portion 34A.

The driving portion 331 applies a driving force to the lock body 326, and includes an interlock portion 332 and a linking member 333. The interlock portion 332 is provided on the sleeve 327 mounted around the operation support shaft 34 in such a way as to protrude radially outward of the sleeve 327 and obliquely upward rearward. That is, the interlock portion 332 is provided indirectly on the operation support shaft 34, with the sleeve 327 interposed therebetween. The sleeve 327, the interlock portion 332, and the operation support shaft 34 rotate together. As another example, the interlock portion 332 may be provided on the operation support shaft 34 itself.

As illustrated in FIGS. 12A and 12B, the linking member 333 is disposed to extend from above, and to below, while going behind (A2) (radially outward of), the operation support shaft 34. The linking member 333 is connected to the interlock portion 332 and the lock body 326 in a relatively-rotatable manner. More particularly, the upper end portion of the linking member 333 is rotatably connected to the interlock portion 332 by means of a pin 135. The lower end portion of the linking member 333 is rotatably connected to the lock body 326 by means of a pin 136.

The junction (pin 135) of the interlock portion 332 and the linking member 333 is located at an upper position that is more distant from the operation shaft 33 than the lock pin 326C of the lock body 326 is. The junction (pin 136) of the lock body 326 and the linking member 333 is located at a lower position that is closer to the operation shaft 33 than the lock pin 326C is.

As illustrated in FIG. 12A, when the lock lever 50A is at the first position X1*a*, the lock pin 326C is engaged with (inserted in) the first engagement groove 46L and the second engagement groove 46R. Since this restricts (prevents) the motion of the first engagement portion 45L and the second engagement portion 45R in the vertical direction, the motion of the first traveling lever 41L and the second traveling lever 41R is also restricted, and the swinging of the operation member 41 is impossible.

That is, in FIG. 12A, the lock body 326 is at an engagement position P1*a*, at which it is in engagement with the first engagement portion 45L and the second engagement portion 45R and restricts the motion of the operation member 41. That is, the lock mechanism 314 is in a locking state, in which it restricts the motion of the operation member 41. In addition, when in this state, the second rotary sleeve 38B is located inside the cavity portion 326D without being in contact with the lock body 326.

It is possible to adjust the depth of insertion of the lock pin 326C into the first engagement groove 46L and the second engagement groove 46R by adjusting the contact position of the stopper 105, 105A and the contact plate 11E, 11F of the connection member 11X (FIG. 11).

The lock lever 50A is swung downward to the second position X2*a* from the locking state illustrated in FIG. 12A. Upon this lever manipulation being performed, the driving portion 331 transmits a manipulation force for changing the position of the lock lever 50A as a driving force to the lock body 326 to cause the lock body 326 to rotate around the axis of the operation shaft 33. Specifically, due to the manipulation force applied to the lock lever 50A, the operation support shaft 34, the sleeve 327, and the interlock portion 332 rotate in the unlocking direction F2. Then, as illustrated in FIG. 12B, the interlock portion 332 causes the linking member 333 to move obliquely downward rearward, and the linking member 333 causes the lock arm 326B to rotate downward. Therefore, the lock arm 326B rotates (pivots) around the axis of the operation shaft 33 in the unlocking direction F2. The lock pin 326C moves obliquely downward rearward to become disengaged from the first engagement groove 46L and the second engagement groove 46R.

Since this allows (cancels the restrictions on) the motion of the first engagement portion 45L and the second engagement portion 45R in the vertical direction, the motion of the first traveling lever 41L and the second traveling lever 41R is also allowed, and the swinging of the operation member 41 is possible.

That is, in FIG. 12B, the lock body 326 is at a disengagement position P2*a*, at which it is not in engagement with the first engagement portion 45L and the second engagement portion 45R and allows the motion of the operation member 41. That is, the lock mechanism 314 is in an unlocking state, in which it allows the motion of the operation member 41. In addition, when in this state, the second rotary sleeve 38B has almost gotten out of the cavity portion 326D of the lock body 326.

The lock lever 50A is swung upward to the first position X1*a* from the unlocking state illustrated in FIG. 12B. Upon this lever manipulation being performed, the driving portion 331 transmits a manipulation force for changing the position of the lock lever 50A as a driving force to the lock body 326 to cause the lock body 326 to rotate around the axis of the operation shaft 33. Specifically, due to the manipulation force applied to the lock lever 50A, the operation support shaft 34, the sleeve 327, and the interlock portion 332 rotate in the locking direction F1. Then, as illustrated in FIG. 12A, the interlock portion 332 causes the linking member 333 to move obliquely upward forward, and the linking member 333 causes the lock arm 326B to rotate upward. Therefore, the lock arm 326B rotates (pivots) around the axis of the operation shaft 33 in the locking direction F1. The lock pin 326C moves forward A1 to become engaged with the first engagement groove 46L and the second engagement groove 46R.

This restricts the motion of the first engagement portion 45L and the second engagement portion 45R in the vertical direction and the motion of the first traveling lever 41L and the second traveling lever 41R, and makes the swinging of the operation member 41 impossible. That is, the lock body 326 changes its position (moves) from the disengagement position P2*a* illustrated in FIG. 12B to the engagement position P1*a*, at which it restricts the motion of the operation member 41 by being in engagement with the first engagement portion 45L and the second engagement portion 45R as illustrated in FIG. 12A. Moreover, the lock mechanism 314 returns to a state of locking the operation member 41. As described above, the lock body 326 is capable of changing its position between the engagement position P1*a* illustrated in FIG. 12A and the disengagement position P2*a* illustrated in FIG. 12B.

In the embodiment described above, the force of manipulating the lock lever 50A is used as the driving force of the driving portion 331. Instead, as illustrated in FIGS. 13A and 13B, the driving force may be generated by an actuator 339 provided in the driving portion 331.

Figure 13A:
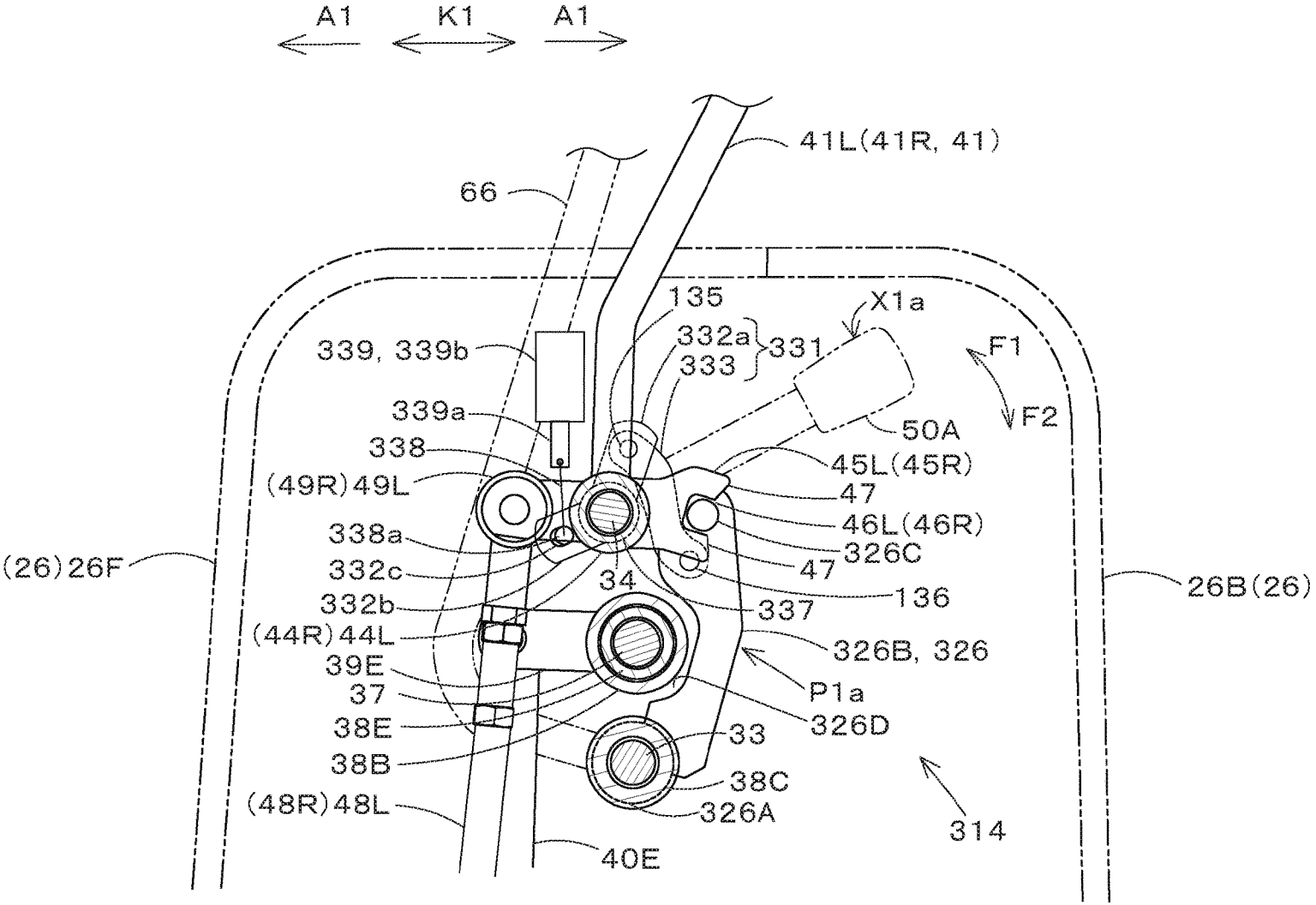
FIG. 13A is a sectional view illustrating a locking state of a lock mechanism according to a modification example of the second embodiment.
Figure 13B:
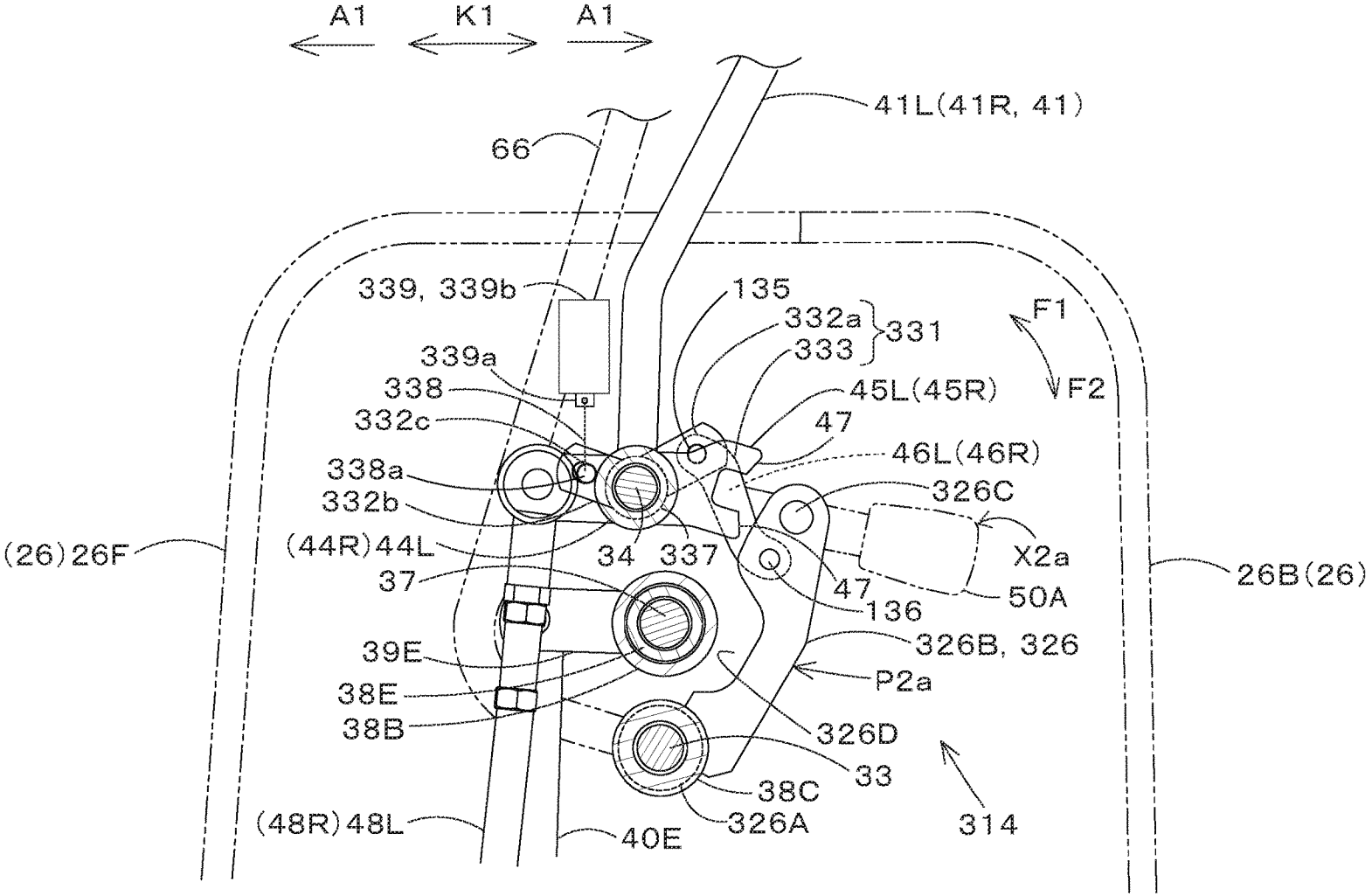
FIG. 13B is a sectional view illustrating an unlocking state of the lock mechanism according to the modification example of the second embodiment.

FIG. 13A is a sectional view illustrating a locking state of the lock mechanism 314 according to a modification example. FIG. 13B is a sectional view illustrating an unlocking state of the lock mechanism 314 according to the modification example. The driving portion 331 of the lock mechanism 314 illustrated in FIGS. 13A and 13B includes an actuator 339 for generating a driving force. The actuator 339 may be, for example, a hydraulic actuator such as a hydraulic cylinder, or an electric actuator such as a solenoid. The actuator 339 is disposed above and ahead of (A1) the operation support shaft 34.

A sleeve 337 is provided around the operation support shaft 34. The sleeve 337 is able to rotate relatively in relation to the operation support shaft 34. Interlock portions 332*a* and 332*b* are provided on the sleeve 337. The interlock portion 332*a* protrudes radially outward of the sleeve 337 and obliquely upward rearward. The front end portion of the linking member 333 is rotatably connected to the interlock portion 332*a* by means of the pin 135.

The interlock portion 332*b* protrudes radially outward of the sleeve 337 and obliquely downward forward. That is, the interlock portion 332*b* is disposed below and ahead of (A1) the interlock portion 332*a*. A pin 338*a* included in a link mechanism 338 is in engagement with an oblong hole 332*c* formed in the interlock portion 332*b*. The link mechanism 338 is connected to the pin 338*a* and an operator 339*a* protruding down from the actuator 339. The link mechanism 338 transmits a driving force generated by the actuator 339 to the interlock portion 332*b*. A body portion 339*b* of the actuator 339 is fixed to the third connecting member 32 (FIG. 9) by means of, for example, a bracket.

An operation actuator such as a button, a switch, a lever, or the like for driving the actuator 339 may be provided on the manipulator base 23 or the like. A controller for controlling the operation of the actuator 339 also may be provided in the manipulator base 23.

In a state illustrated in FIG. 13A, the actuator 339 generates a driving force for causing the operator 339*a* to protrude down by its elastic member such as, for example, a built-in spring (not illustrated). Therefore, the driving force of the actuator 339 is transmitted to the link mechanism 338, the interlock portion 332*b*, the sleeve 337, the interlock portion 332*a*, the linking member 333, and the lock body 326 sequentially in this order, and the lock body 326 is in a state of being rotated in the locking direction F1. In addition, the lock pin 326C is in engagement with the engagement grooves 46L and 46R. That is, in FIG. 13A, the lock body 326 is at the engagement position P1*a*, and the lock mechanism 314 is in a state of locking the operation member 41.

From the state in which the operation member 41 is locked by the lock mechanism 314, the actuator 339 drives to cause the operator 339*a* to move up (a state of being pulled into the body portion 339*b*). Accordingly, the driving force is transmitted to the interlock portion 332*b*, the sleeve 337, the interlock portion 332*a*, the linking member 333, and the lock body 326 sequentially in this order to cause the lock body 326 to rotate in the unlocking direction F2 as illustrated in FIG. 13B. The lock pin 326C becomes disengaged from the engagement grooves 46L and 46R. That is, in FIG. 13B, the operation member 41 is not locked by the lock mechanism 314 due to movement of the lock body 326 to the disengagement position P2*a*.

Instead of the structure described above, for example, the link mechanism 338, the interlock portions 332*a* and 332*b*, the sleeve 337, and the linking member 333 may be omitted, and the operator 339*a* of the actuator 339 may be connected directly or indirectly to an end portion of the lock body 326. In this case, the driving force of the actuator 339 is applied directly or indirectly to the lock body 326, and the lock body 326 rotates in the locking direction F1 or the unlocking direction F2 to bring the lock pin 326C into, or out of, engagement with the engagement grooves 46L and 46R.

As illustrated in FIGS. 12A and 13A, preferably, when the lock mechanism 314 is in a state of locking the operation member (traveling levers) 41, the lock pin 326C should be located (have entered) at the center of the engagement groove 46L, 46R of the engagement portion 45L, 45R. More particularly, preferably, there should be a clearance between the lock pin 326C and the walls of the engagement groove 46L, 46R in a state in which no manipulation force is applied to the operation member 41.

Figure 14:
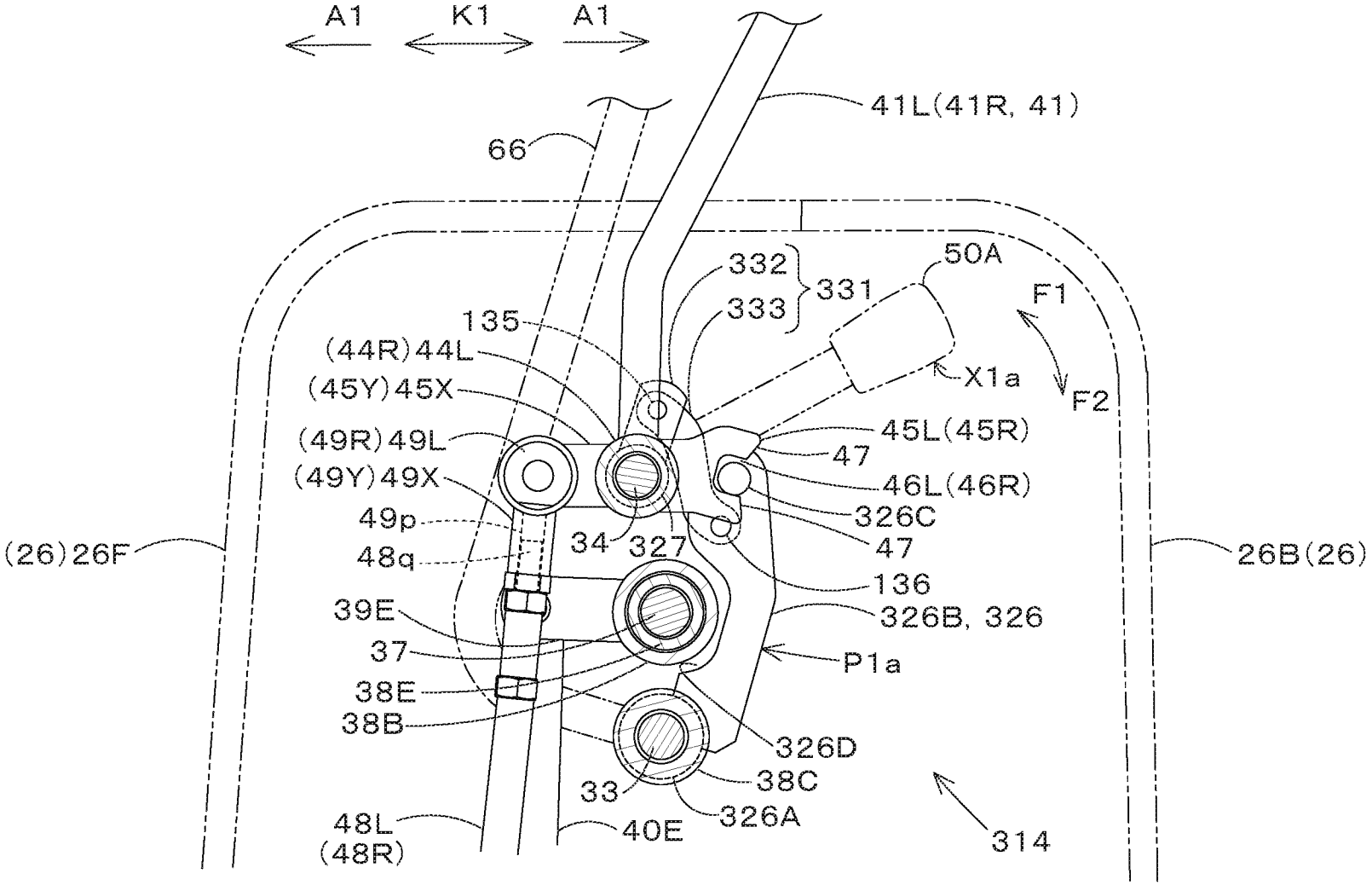
FIG. 14 is a diagram illustrating an example of the locking state of the lock mechanism according to the second embodiment.

In contrast to the above structure, for example, as illustrated in FIG. 14, if the engagement portion 45L, 45R is located at a slightly-more-upward-rotated position and the lock pin 326C is thus in contact with, of sidewalls of the engagement groove 46L, 46R, the one closer to the pin 136 in a state in which no manipulation force is applied to the operation member 41, as compared with a case where the lock pin 326C is not in contact with the sidewall of the engagement groove 46L, 46R as illustrated in FIG. 12A, etc., a greater force of manipulation of the lock lever 50A or driving of the actuator 339 will be required for unlocking, and the lock pin 326C and the engagement portion 45L, 45R will be more susceptible to wear.

Moreover, not only the engagement portion 45L, 45R but also the connecting rod 48L, 48R for operating the spool S4, S7 of the control valve V4, V7 is connected to the base portion 44L, 44R of the operation member 41 via the arm protrusion portion 45X, 45Y and the ball-and-socket joint 49L, 49R. Therefore, if the engagement portion 45L, 45R is located at a slightly-more-upward-rotated position and the lock pin 326C is thus in contact with, of sidewalls of the engagement groove 46L, 46R, the one closer to the pin 136 in a state in which no manipulation force is applied to the operation member 41 as mentioned above, there will be a difference in timing at which the spool S4, S7 of the control valve V4, V7 starts to operate and a difference in manipulation load between when the operation member 41 is swung forward A1 from its neutral position and when the operation member 41 is swung rearward A2 from its neutral position.

To solve the above issue, the manipulator base 23 is equipped with a lock adjustment structure for adjusting the locking state of the lock mechanism 314, that is, the state of engagement of the engagement groove 46L, 46R of the engagement portion 45L, 45R with the lock pin (engaged portion) 326C. The connecting rod 48L, 48R, the ball-and-socket joint 49L, 49R, and the arm protrusion portion 45X, 45Y, and the like, which are illustrated in FIGS. 10 and 13A, etc., are included in the lock adjustment structure.

As illustrated in FIG. 10, each of the arm protrusion portions 45X and 45Y protrudes in a radially outward direction of the operation support shaft 34 and forward A1 from a position different from the position of the engagement portion 45L, 45R on the base portion 44L, 44R of the operation member 41L, 41R. The ball-and-socket joint 49L, 49R is rotatably connected to the arm protrusion portion 45X, 45Y. The upper ends of the connecting rods 48L and 48R are connected to the ball-and-socket joints 49L and 49R, respectively. The lower ends of the connecting rods 48L and 48R are connected to the spools S4 and S7 of the control valves V4 and V7, with the connecting blocks 48X and 48Y interposed therebetween, respectively. Each of the connecting rods 48L and 48R is connected to the connecting block 48X, 48Y in such a way as to be able to rotate on the axis of the connecting rod 48L, 48R. The connecting block 48X, 48Y is rotatably connected to the spool S4, S7.

The connecting rod 48L, 48R is in threaded engagement with the ball-and-socket joint 49L, 49R. More particularly, an external thread portion 48*q* is formed on the outer circumferential surface of the upper end portion of the connecting rod 48L, 48R. A barrel portion 49X, 49Y protruding down is provided on the ball-and-socket joint 49L, 49R. A internal thread portion 49*p* is formed in the inner circumferential surface of the barrel portion 49X, 49Y. The connecting rod 48L, 48 is connected to the ball-and-socket joint 49L, 49R by threaded engagement of the external thread portion 48*q* of the connecting rod 48L, 48R with the internal thread portion 49*p* of the ball-and-socket joint 49L, 49R.

The depth of threaded engagement of the external thread portion 48*q* of the connecting rod 48L, 48R with the internal thread portion 49*p* of the ball-and-socket joint 49L, 49R is adjusted by rotating the connecting rod 48L, 48R on the axis. With this, it is possible to adjust the position of the engagement portion 45L, 45R (FIG. 13A, etc.) of the lock mechanism 314 around the operation support shaft 34 via the ball-and-socket joint 49L, 49R, the arm protrusion portion 45X, 45Y, and the base portion 44L, 44R of the traveling lever 41L, 41R. That is, it is possible to adjust the position of the engagement groove 46L, 46R of the engagement portion 45L, 45R with respect to the lock pin 326C (the state of engagement of the engagement groove 46L, 46R with the lock pin 326C).

Figure 15:
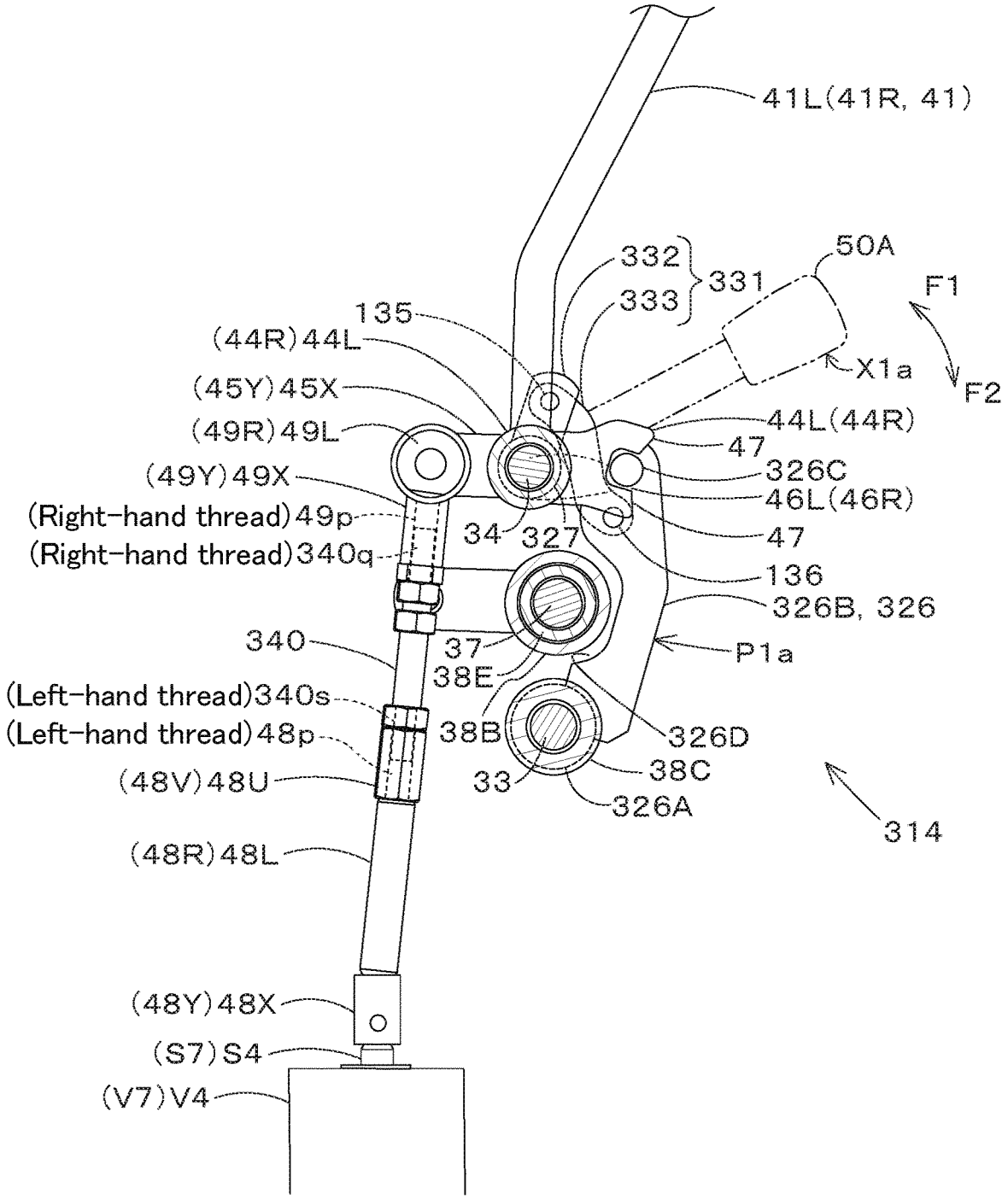
FIG. 15 is a diagram illustrating another example of a lock adjustment structure according to the second embodiment.

FIG. 15 is a diagram illustrating another example of the lock adjustment structure. In the example illustrated in FIG. 15, a relay member 340 is included in the lock adjustment structure, in addition to the connecting rod 48L, 48R, the ball-and-socket joint 49L, 49R, and the arm protrusion portion 45X, 45Y. The structure for connection of the arm protrusion portion 45X, 45Y and the ball-and-socket joint 49L, 49R, and for connection of the connecting rod 48L, 48R, the connecting block 48X, 48Y, and the spool S4, S7 of the control valve V4, V7, is the same as the above-described structure.

A relay member 340 is provided each between the ball-and-socket joint 49L, 49R and the connecting rod 48L, 48R. A barrel portion 48U, 48V is provided on the upper end portion of the connecting rod 48L, 48R. A internal thread portion 48*p* (second threaded connecting portion, not illustrated) is formed in the inner circumferential surface of the barrel portion 48U, 48V. An internal thread portion 49*p* (first threaded connecting portion, not illustrated) is formed in the inner circumferential surface of the barrel portion 49X, 49Y of the ball-and-socket joint 49L, 49R. An external thread portion 340*q* (first threaded connected portion, not illustrated) is formed on the outer circumferential surface of the upper end portion of the relay member 340. An external thread portion 340*s* (second threaded connected portion, not illustrated) is formed on the outer circumferential surface of the lower end portion of the relay member 340. The internal thread portion 49*p* of the barrel portion 49X, 49Y of the ball-and-socket joint 49L, 49R and the external thread portion 340*q* of the upper end portion of the relay member 340 have a right-threaded form. The internal thread portion 48*p* of the barrel portion 48U, 48V of the connecting rod 48L, 48R and the external thread portion 340*s* of the lower end portion of the relay member 340 have a left-threaded form.

The connecting rod 48L, 48, the relay member 340, and the ball-and-socket joint 49L, 49R are connected by threaded engagement of the internal thread portion 48*p* of the connecting rod 48L, 48R with the external thread portion 340*s* of the lower end portion of the relay member 340 and by threaded engagement of the internal thread portion 49*p* of the ball-and-socket joint 49L, 49R with the external thread portion 340*q* of the upper end portion of the relay member 340.

The depth of threaded engagement of the external thread portion 340*s* of the lower end portion of the relay member 340 with the internal thread portion 48*p* of the connecting rod 48L, 48R and the depth of threaded engagement of the external thread portion 340*q* of the upper end portion of the relay member 340 with the internal thread portion 49*p* of the ball-and-socket joint 49L, 49R are adjusted by rotating the relay member 340 on the axis. Alternatively, the depth of threaded engagement of the external thread portion 340*s* of the lower end portion of the relay member 340 with the internal thread portion 48*p* of the connecting rod 48L, 48R is adjusted by rotating the connecting rod 48L, 48R on the axis. With this, it is possible to adjust the position of the engagement portion 45L, 45R of the lock mechanism 314 around the operation support shaft 34 via the ball-and-socket joint 49L, 49R, the arm protrusion portion 45X, 45Y, and the base portion 44L, 44R of the traveling lever 41L, 41R. That is, it is possible to adjust the position of the engagement groove 46L, 46R of the engagement portion 45L, 45R with respect to the lock pin 326C (the state of engagement of the engagement groove 46L, 46R with the lock pin 326C).

Moreover, both of the joint of the connecting rod 48L, 48R and the relay member 340 and the joint of the relay member 340 and the ball-and-socket joint 49L, 49R have a threaded engagement structure, and the threaded engagement structure of one of the two has left hand threads whereas the other has right hand threads. Therefore, with the lock adjustment structure illustrated in FIG. 15, it is possible to adjust the position of the engagement portion 45L, 45R of the lock mechanism 314 around the operation support shaft 34 with a higher precision than achieved by the lock adjustment structure illustrated in FIGS. 10 and 12A, etc. That is, it is possible to enhance the precision in the adjustment of the position of the engagement groove 46L, 46R of the engagement portion 45L, 45R with respect to the lock pin 326C (the state of engagement of the engagement groove 46L, 46R with the lock pin 326C).

Moreover, consequently, as illustrated in FIG. 15, when the lock mechanism 314 is in a state of locking the operation member (traveling levers) 41, it is possible to position the lock pin 326C at the center of the engagement groove 46L, 46R of the engagement portion 45L, 45R without fail. More particularly, it is possible to form a clearance between the lock pin 326C and the walls of the engagement groove 46L, 46R without fail, in a state in which no manipulation force is applied to the operation member 41. Accordingly, it is possible to avoid an increase in the force of manipulation of the lock lever 50A or driving of the actuator 339 for unlocking the operation member 41 by the lock mechanism 314 and thus make the lock pin 326C and the engagement portion 45L, 45R less susceptible to wear. Furthermore, it is possible to reduce a difference in timing at which the spool S4, S7 of the control valve V4, V7 starts to operate and a difference in manipulation load between when the operation member 41 is swung forward A1 from its neutral position and when the operation member 41 is swung rearward A2 from its neutral position.

In the example illustrated in FIG. 15, a single relay member 340 is used for connection of a correspondence set of the connecting rod 48L, 48R and the ball-and-socket joint 49L, 49R. However, a plurality of relay members 340 may be used for connection of a correspondence set of the connecting rod 48L, 48R and the ball-and-socket joint 49L, 49R. This can be embodied by threadably connecting the relay members 340 to each other. In addition, this can be embodied by alternating a right-threaded structure and a left-threaded structure on the manipulation force transmission path from the ball-and-socket joint 49L, 49R to the connecting rod 48L, 48R via the plurality of relay members 340.

Next, a third embodiment will now be described.

Figure 16:
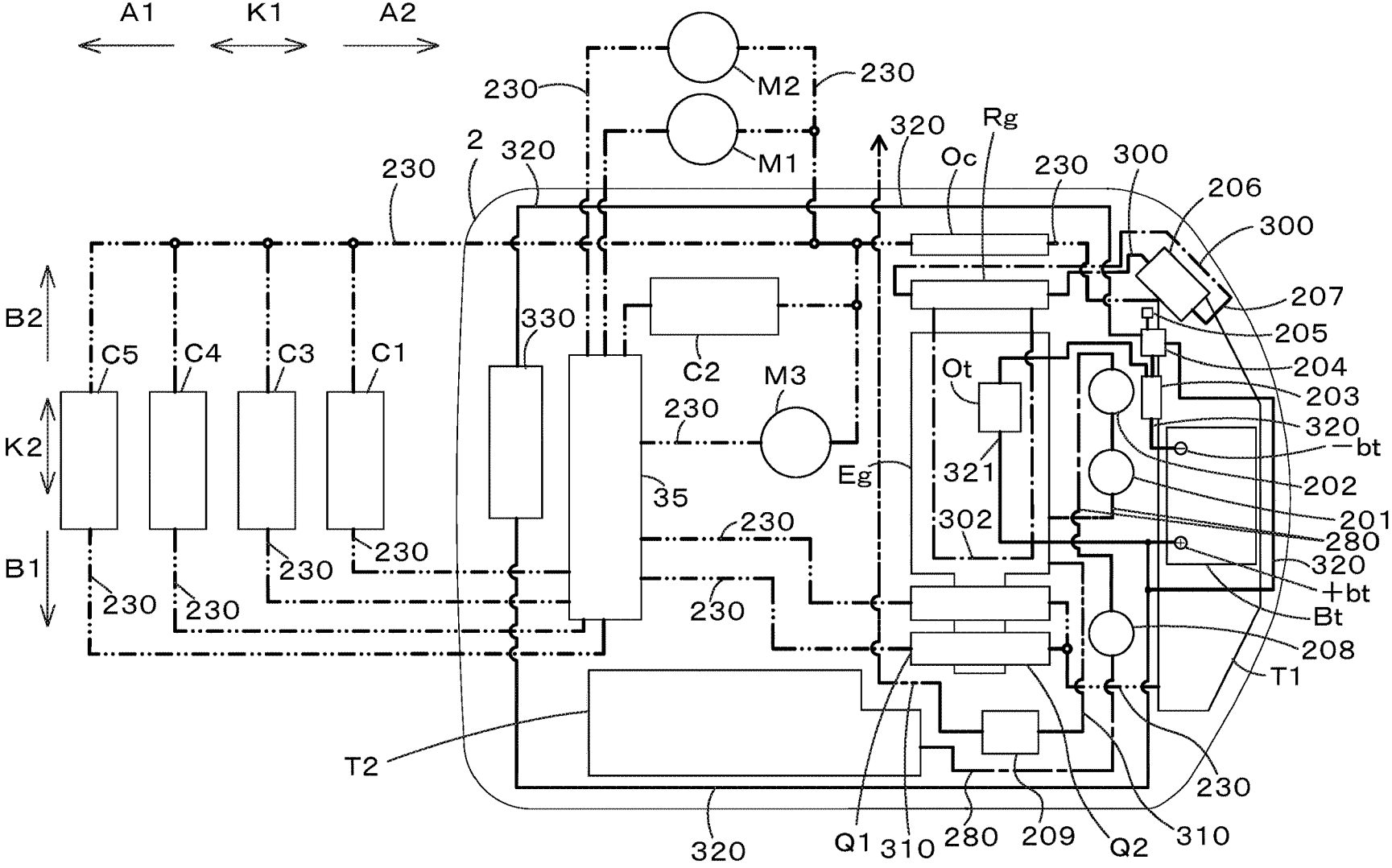
FIG. 16 is a schematic view of an inner structure of a machine body and electric paths and fluid paths according to a third embodiment.

FIG. 16 is a schematic view of the inner structure of the machine body 2 and electric paths and fluid paths.

The swing cylinder C2, the swiveling motor M3, the prime mover Eg, an alternator Ot, a refrigerator Rg, an oil cooler Oc, hydraulic pumps Q1 and Q2, a battery Bt, a hydraulic fluid tank T1, a fuel tank T2, electric paths 320 and 321, fluid paths 230, 280, 300, 302, and 310, and various devices 201 to 209, etc. are provided inside the machine body 2 of the working machine 1. They are fixed by a frame and other members provided inside the machine body 2.

In FIG. 16, the control valve 35 is illustrated inside the machine body 2 for the purpose of explanation; however, the control valve 35 is provided in the manipulator base 23 provided on the machine body 2 as illustrated in FIG. 2, etc. Although electric equipment 330 is also illustrated inside the machine body 2 for the purpose of explanation, the electric equipment 330 includes the electrical components 18*s*, 140L, and 140R (FIGS. 1 and 2, etc.) provided on the manipulator base 23, and other electric devices (not illustrated) such as lamps provided at other positions on the working machine 1.

The swiveling motor M3 is disposed near the center of the machine body 2. The swing cylinder C2 is disposed at a front right portion of the machine body 2. The prime mover Eg is disposed behind the swiveling motor M3. The alternator Ot is disposed over the prime mover Eg. The prime mover Eg is a drive source for driving the hydraulic pumps Q1 and Q2, the alternator Ot, and the like.

The alternator Ot generates electricity by being driven by the driving force of the prime mover Eg. The electricity generated by the alternator Ot flows through the electric path 321 to be charged into the battery Bt. The battery Bt is an electric accumulator. The battery Bt and the alternator Ot are power sources. The electric path 321 is made up of electric harnesses.

The refrigerator Rg is disposed to the right of (B2) the prime mover Eg. The refrigerator Rg is made up of a radiator and a cooling fan. A cooling fluid path 302 is disposed to lead from the radiator of the refrigerator Rg through the periphery of the prime mover Eg. The cooling fluid path 302 is a hose, a steel pipe, or the like. The radiator of the refrigerator Rg cools the prime mover Eg by circulating a cooling fluid through the cooling fluid path 302.

The hydraulic pumps Q1 and Q2 are disposed to the left of (B1) the prime mover Eg. The hydraulic fluid tank T1 is disposed behind (A2) the prime mover Eg at a rear portion of the machine body 2. The hydraulic fluid tank T1 contains a hydraulic fluid for causing hydraulic actuators such as hydraulic motors M1 to M3 (the first traveling motor M1, the second traveling motor M2, and the swiveling motor M3) and hydraulic cylinders C1 to C5 (the dozer cylinder C1, the swing cylinder C2, the boom cylinder C3, the arm cylinder C4, and the bucket cylinder C5) of the working machine 1 to operate, thereby causing the working device 4 and the traveling device 3 to operate. In FIG. 16, for the purpose of illustration, the traveling motors M1 and M2 are shown at a top portion of the sheet, and the hydraulic cylinders C1, C3, C4, and C5 are shown at a left portion of the sheet; however, these hydraulic actuators are provided at positions illustrated in FIGS. 24 and 25.

The hydraulic pump Q1 is driven by the driving force of the prime mover Eg, takes in a hydraulic fluid through a hydraulic fluid path 230 from the hydraulic fluid tank T1, and delivers the hydraulic fluid to the hydraulic actuators M1 to M3 and C1 to C5. The hydraulic actuators M1 to M3 and C1 to C5 are driven by the pressure of the hydraulic fluid delivered by the hydraulic pump Q1. The hydraulic pump Q2 is driven by the driving force of the prime mover Eg, and delivers a pilot hydraulic fluid and a signal hydraulic fluid for actuating the control valve 35 through the hydraulic fluid path 230. The hydraulic fluid path 230 is a hose or a steel pipe.

The oil cooler Oc is disposed to the right of (B2) the refrigerator Rg. The oil cooler Oc cools the hydraulic fluid returning from the hydraulic actuators M1 to M3 and C1 to C5 or the control valve 35 to the hydraulic fluid tank T1 through the hydraulic fluid path 230.

The battery Bt is disposed over the hydraulic fluid tank T1. The battery Bt supplies power to the electric equipment 330 of the working machine 1, an igniter (not illustrated) provided in the prime mover Eg, and electric devices 203, 204, 205 to be described later, etc. The battery Bt is also included in electric devices. The battery Bt, the hydraulic fluid tank T1, and the prime mover Eg are disposed inside the hood 5. The operator's seat 6 (FIG. 24) is disposed over the hood 5.

The fuel tank T2 is disposed at a closer-to-front left portion of the machine body 2. The fuel tank T2 contains fuel for driving the prime mover Eg. A plurality of devices 201, 202, 203, 204, 205, and 208 (a second fuel filter (fuel device) 201, a fuel pump (fuel device) 202, an isolator (electric device) 203, a fuse box (electric device) 204, a timer (electric device) 205, and a first fuel filter (fuel device) 208) is disposed between the hydraulic fluid tank T1 and the prime mover Eg. Among them, the second fuel filter 201, the fuel pump 202, and the first fuel filter 208 are fuel devices provided on a fuel path 280 for supplying fuel to the prime mover Eg from the fuel tank T2. Specifically, the fuel pump 202 sends fuel from the fuel tank T2 to the prime mover Eg through the fuel path 280. The first fuel filter 208 and the second fuel filter 201 trap foreign particles/object contained in the fuel flowing through the fuel path 280. The fuel path 280 is a hose.

The isolator 203, the fuse box 204, and the timer 205 are provided on the electric path 320 leading from the battery Bt. An electric current flows to these electric devices 203, 204, and 205 through the electric path 320. The electric path 320 is made up of electric wires, harnesses, and the like. The isolator 203 shuts off current flow from the battery Bt to other electric equipment 330, etc. at the time of maintenance, in the case of emergency, etc. The fuse box 204 includes a plurality of built-in fuses for preventing overcurrent flow from the battery Bt to other electric equipment 330, etc. The isolator 203 is disposed at a negative terminal −bt of the battery Bt. The fuse box 204 is disposed at a positive terminal +bt of the battery Bt. The timer 205 is used for checking exhausted status of a remaining-amount-of-fuel alarm lamp (not illustrated) and a fluid-temperature alarm lamp (not illustrated).

A reserve tank (cooling device) 206 and a hose 207 are disposed over a right portion of the hydraulic fluid tank T1. The reserve tank 206 contains a cooling fluid for the refrigerator Rg. The hose 207 constitutes a part of a cooling fluid path 300. The cooling fluid path 300 is a passage through which a cooling fluid flows between the reserve tank 206 and the refrigerator Rg. The reserve tank 206 is provided on the cooling fluid path 300.

An air cleaner 209 is disposed behind (A2) the fuel tank T2 and to the left of (B1) the hydraulic pumps Q1 and Q2. The air cleaner 209 cleans air around the prime mover Eg through an air-in passage 310. Exhaust air from the air cleaner 209 flows through an air-out passage 310 to go out via an air vent (not illustrated) provided on a right side portion of the machine body 2.

The plural devices 201 to 209 and Bt described above are categorized into first devices 203, 204, and 205 (the isolator 203, the fuse box 204, the timer 205, and the battery Bt) provided on the electric path 320, through which electric currents flow, and second devices 201, 202, 206, 207, 208, and 209 (the second fuel filter 201, the fuel pump 202, the reserve tank 206, the hose 207, the first fuel filter 208, and the air cleaner 209) provided on the fluid paths 230, 280, 300, and 310, through which fluids such as oil, fuel, coolant, air, and the like flow. That is, these devices 201 to 209 and Bt include devices provided on different piping/wiring systems (piping: the fluid paths 230, 280, 300, and 310) (wiring: the electric path 320). Electric wires and harnesses provided on, and constituting, the electric path 320 are included in the first devices provided on the wiring system. Hoses and steel pipes, etc. provided on, and constituting, the fluid paths 230, 280, 300, and 310 are included in the second devices provided on the piping system.

Figure 17:
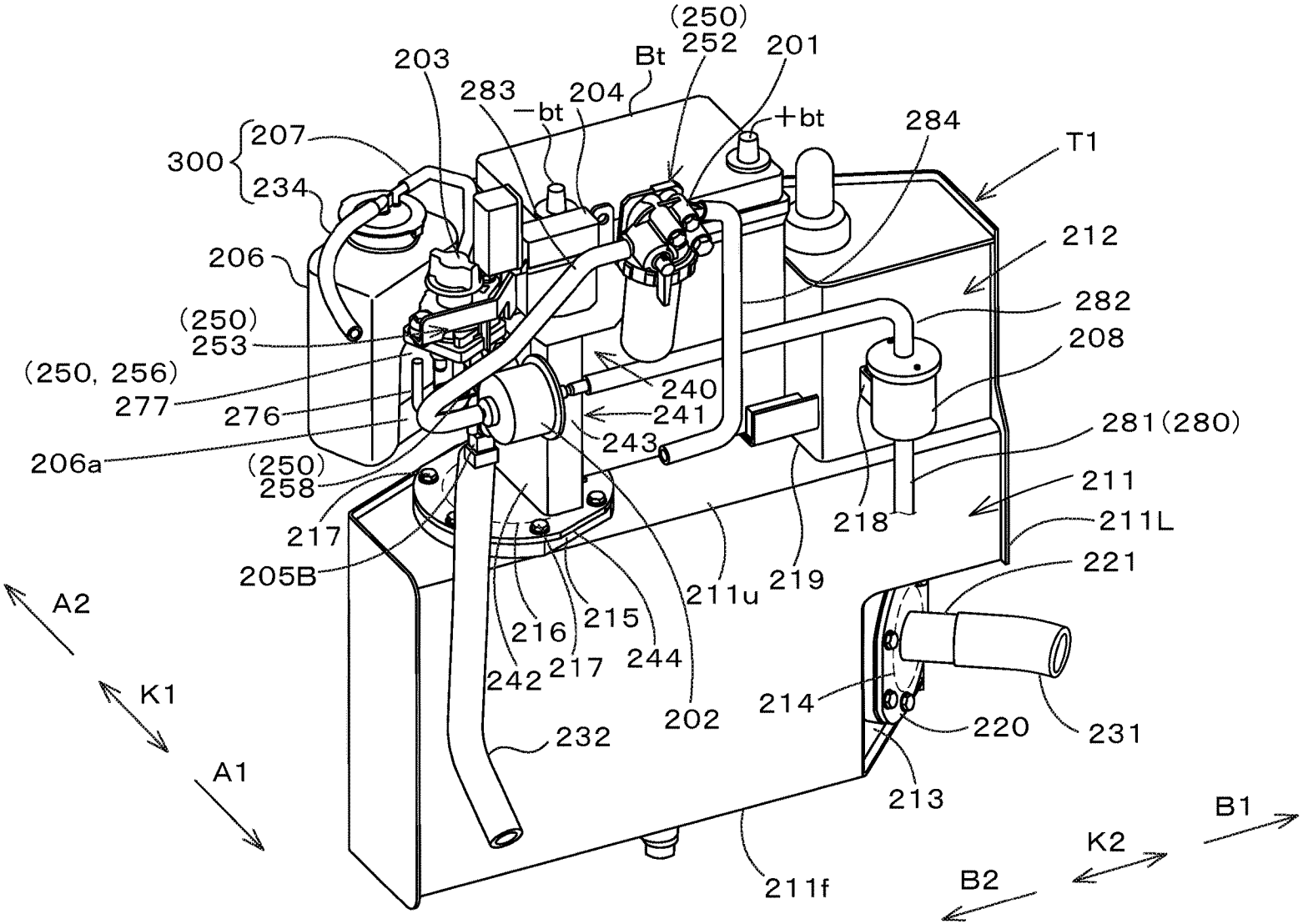
FIG. 17 is a front perspective view of the neighborhood of a hydraulic fluid tank according to the third embodiment.
Figure 18:
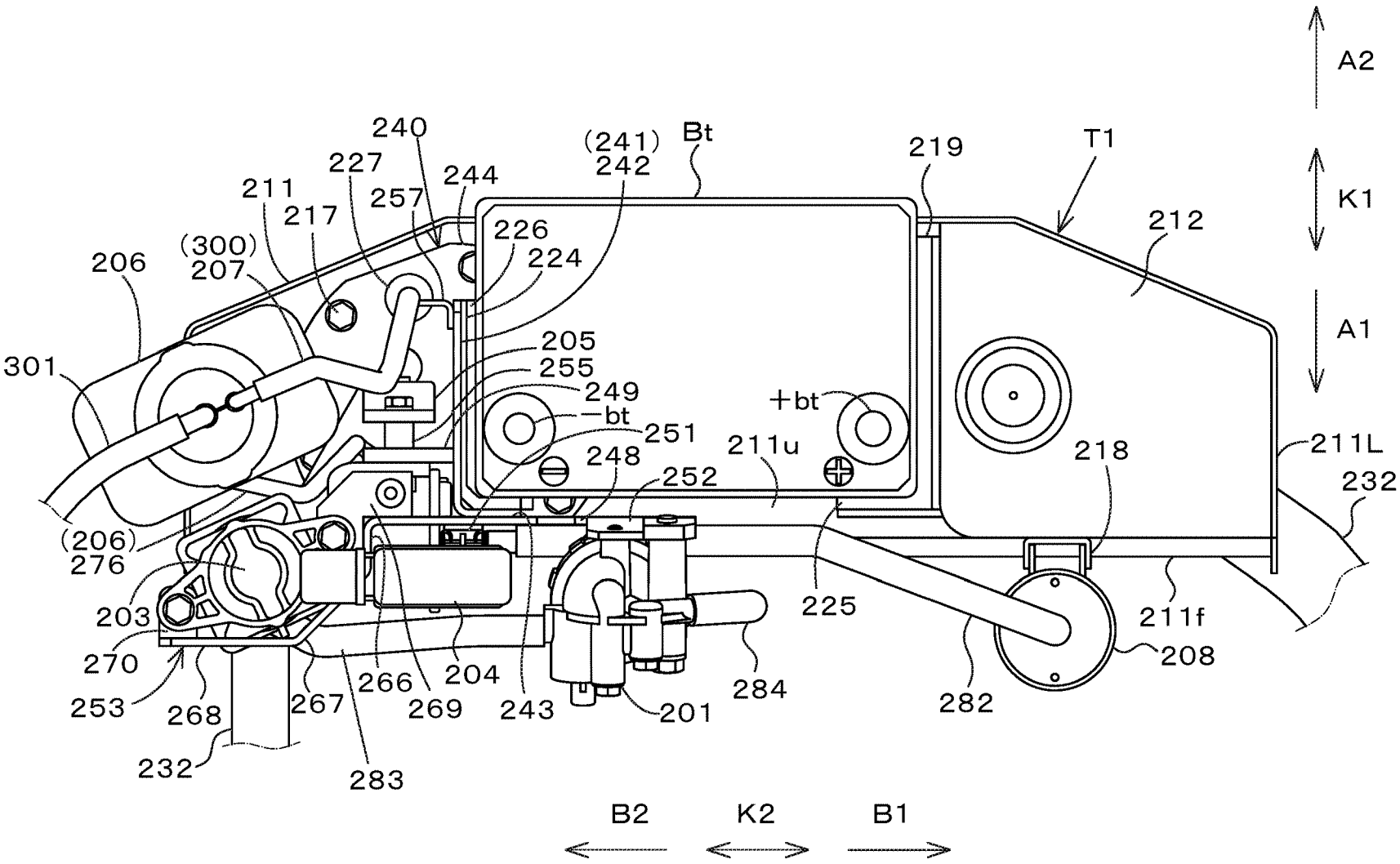
FIG. 18 is a plan view of the neighborhood of the hydraulic fluid tank according to the third embodiment.
Figure 19:
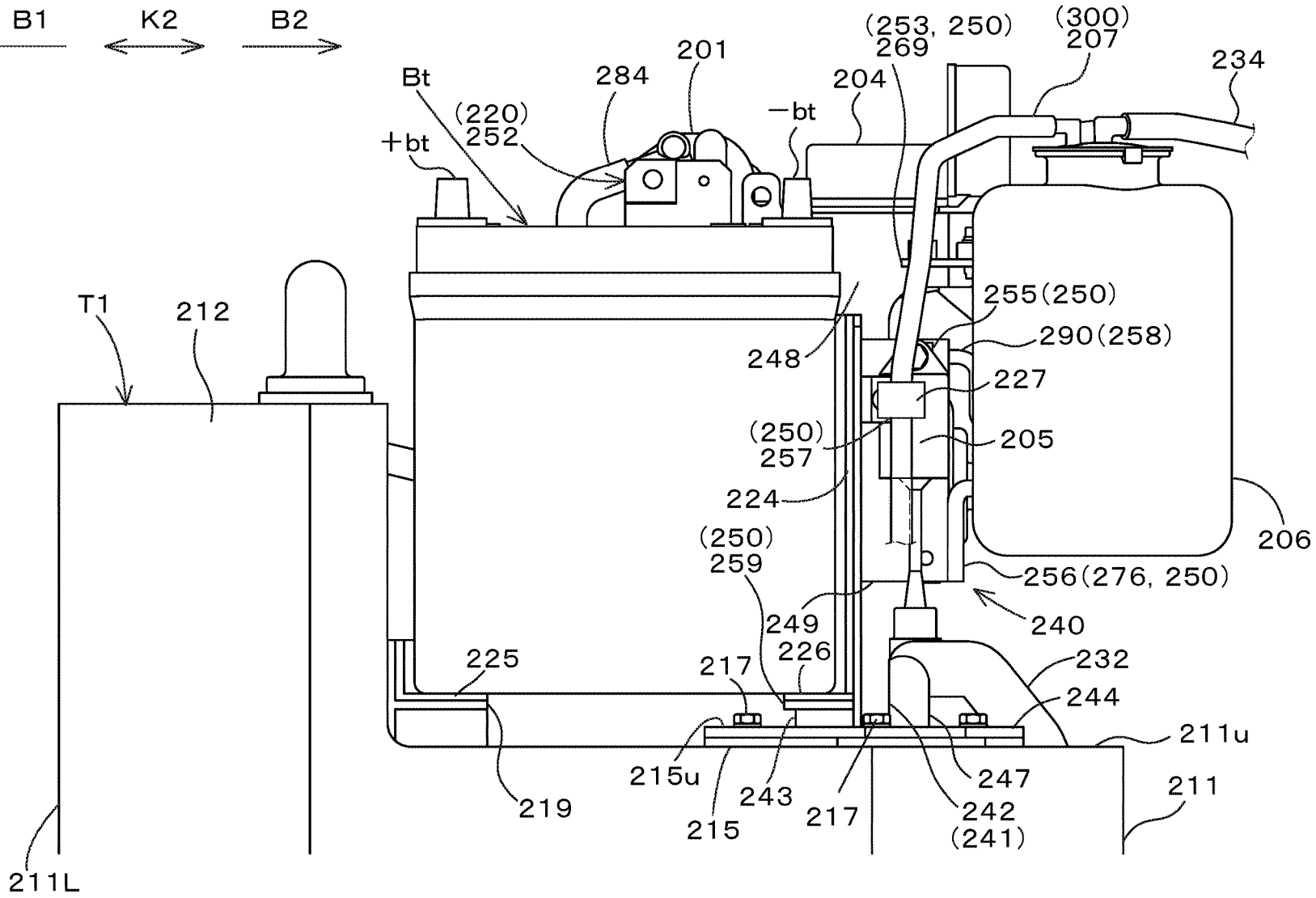
FIG. 19 is a rear view of the neighborhood of the hydraulic fluid tank according to the third embodiment.

FIG. 17 is a front perspective view of the neighborhood of the hydraulic fluid tank T1. FIG. 18 is a plan view of the neighborhood of the hydraulic fluid tank T1. FIG. 19 is a rear view of the neighborhood of the hydraulic fluid tank T1.

As illustrated in FIG. 17, the hydraulic fluid tank T1 has a shape like a letter L as viewed in the front-rear direction K1. The hydraulic fluid tank T1 includes a lower tank portion 211 and an upper tank portion 212. The horizontal width, which is a width parallel to the machine-body width direction K2, of the lower tank portion 211 is greater than that of the upper tank portion 212. The upper tank portion 212 rises from a left portion (B1-directional end portion in FIG. 17) of the lower tank portion 211. As illustrated in FIG. 18, the front-rear width, which is a width parallel to the front-rear direction K1 of the machine body 2, of the lower tank portion 211 is substantially the same as that of the upper tank portion 212. The inner space of the lower tank portion 211 is continuous to that of the upper tank portion 212 (not illustrated).

As illustrated in FIG. 17, the hydraulic fluid tank T1 has an inclined sidewall 213 at a lower left portion of the lower tank portion 211. The inclined sidewall 213 is located at a recessed position closer to the center of the lower tank portion 211 than a front wall 211*f* and a left sidewall 211L of the lower tank portion 211 are, and is oriented obliquely leftward forward with respect to the machine body 2. An opening 214 that is a through hole is formed in the inclined sidewall 213. A cover 220 for closing the opening 214 is mounted on the inclined sidewall 213.

A connection portion 221 having a cylindrical shape is provided integrally at the center portion of the cover 220. The connection portion 221 extends through the cover 220. One end of a hose 231 is connected to one end of the connection portion 221 extending out from the cover 220. The other end of the connection portion 221 protrudes into the inner space of the lower tank portion 211. A filter (not illustrated) for trapping foreign particles/object contained in a hydraulic fluid is attached to the other end of the connection portion 221.

The hose 231 constitutes a part of the hydraulic fluid path 230 illustrated in FIG. 16. The other end of the hose 231 is connected to the hydraulic pumps Q1 and Q2. The inner space of the hose 231 is continuous to the inner space of the connection portion 221, which is continuous to the inner space of the lower tank portion 211. The opening 214 of the lower tank portion 211 is an outlet through which a hydraulic fluid flows out of the hydraulic fluid tank T1. A pedestal 215 rising from the lower tank portion 211 is formed integrally at a right portion of a top wall 211*u* of the lower tank portion 211. An attachment member 240 is mounted on the pedestal 215.

Figure 20A:
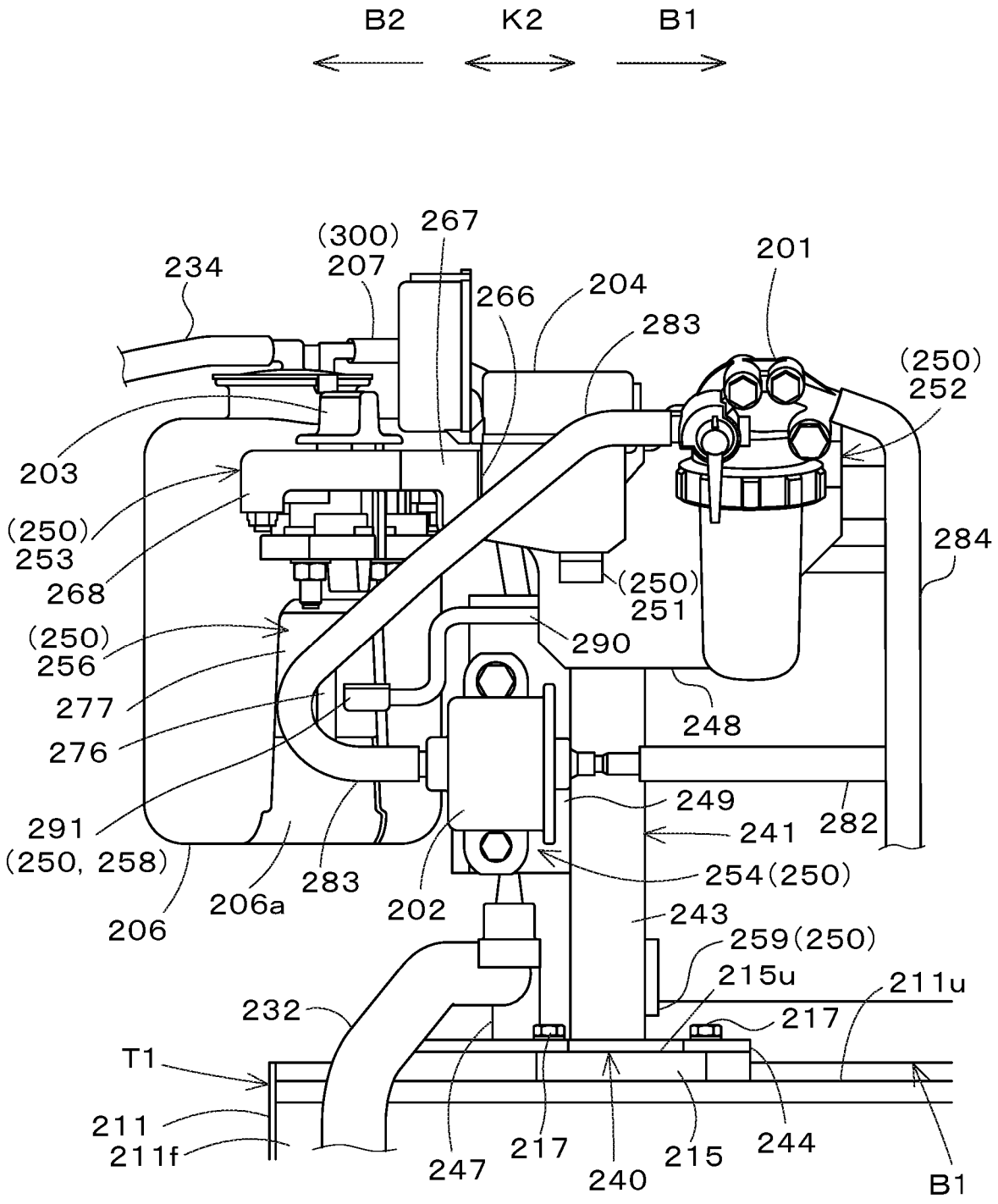
FIG. 20A is a front view of the neighborhood of an attachment member according to the third embodiment.
Figure 21:
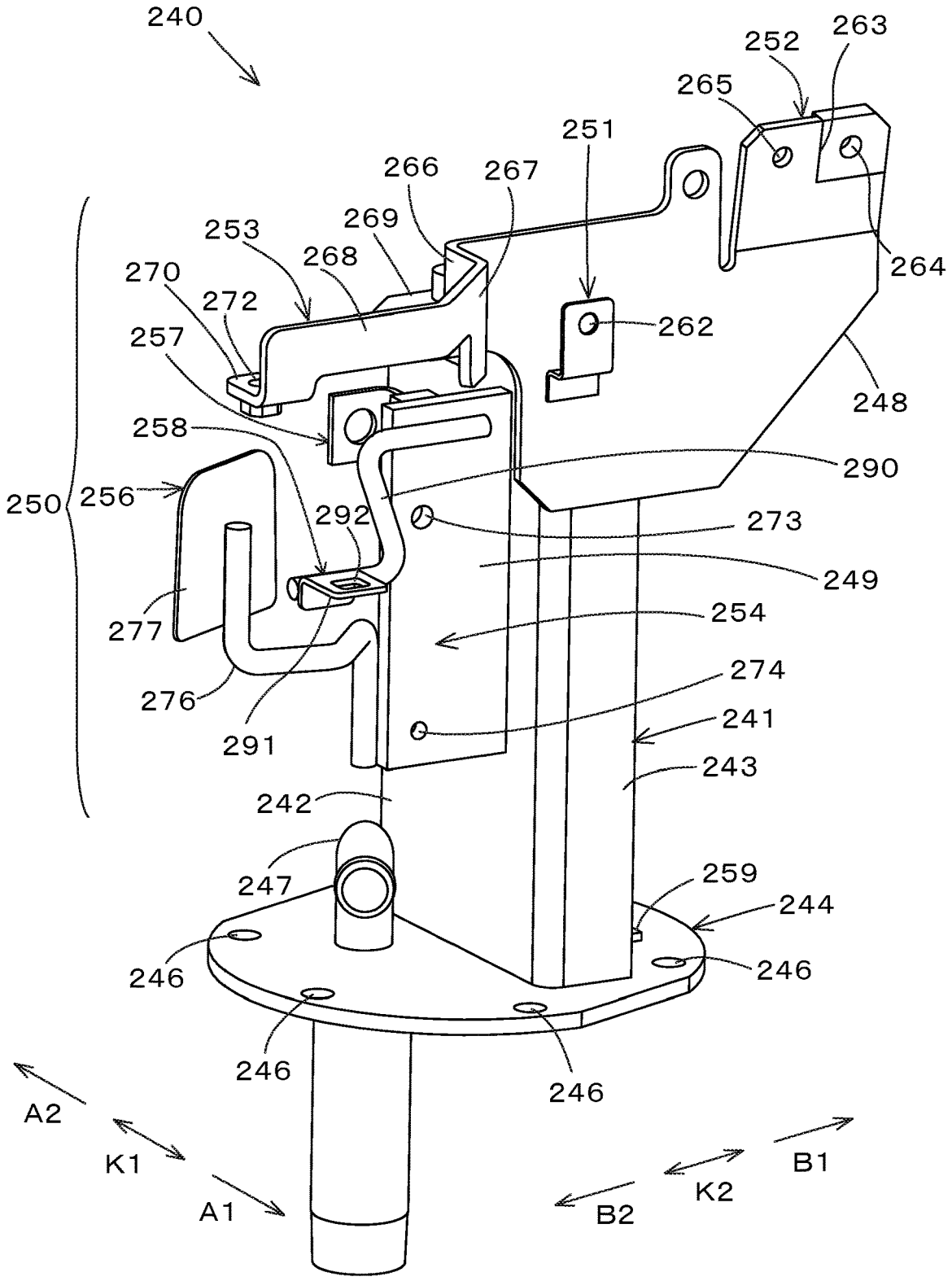
FIG. 21 is a front view of the attachment member according to the third embodiment.
Figure 22:
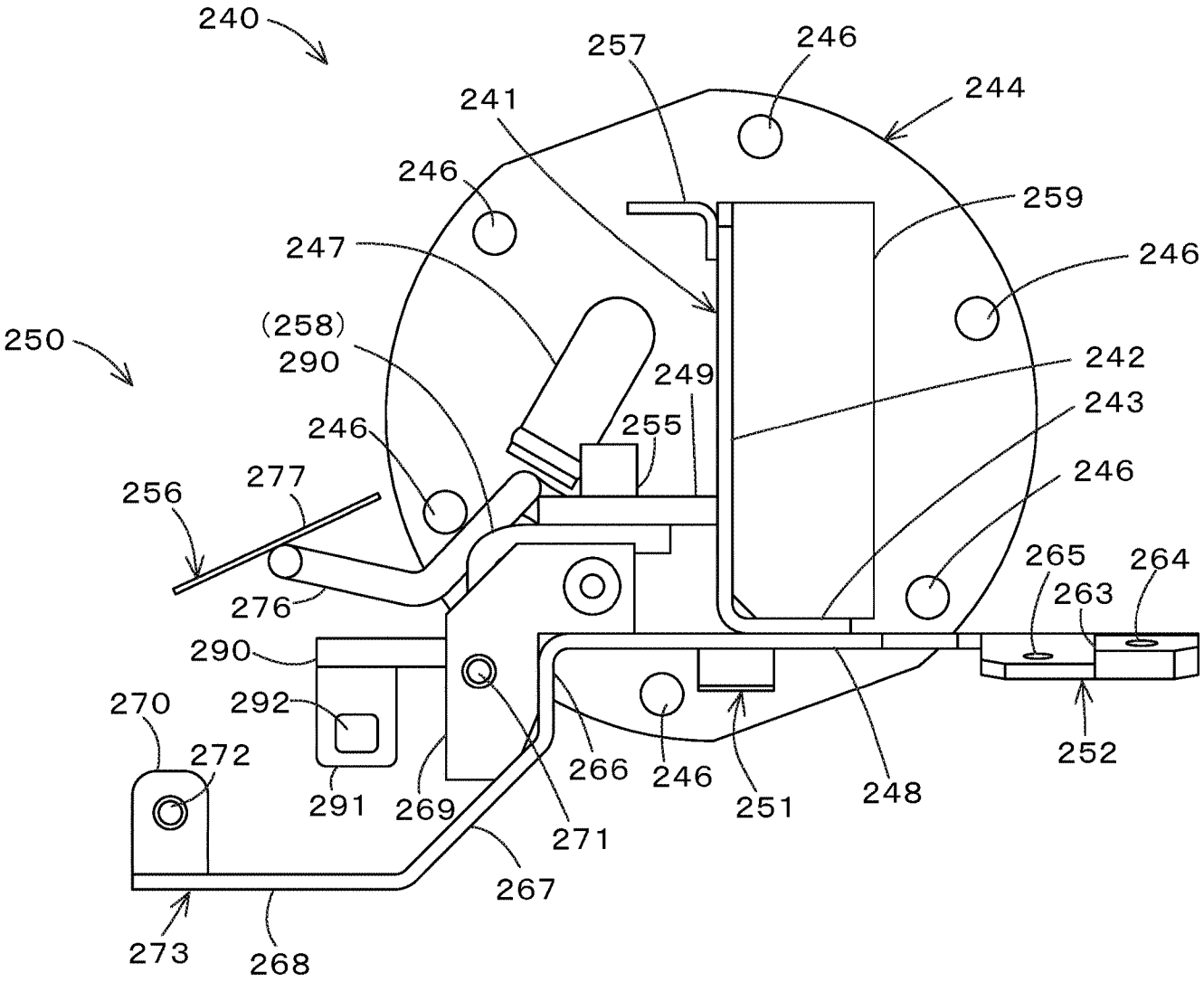
FIG. 22 is a plan view of the attachment member according to the third embodiment.
Figure 23:
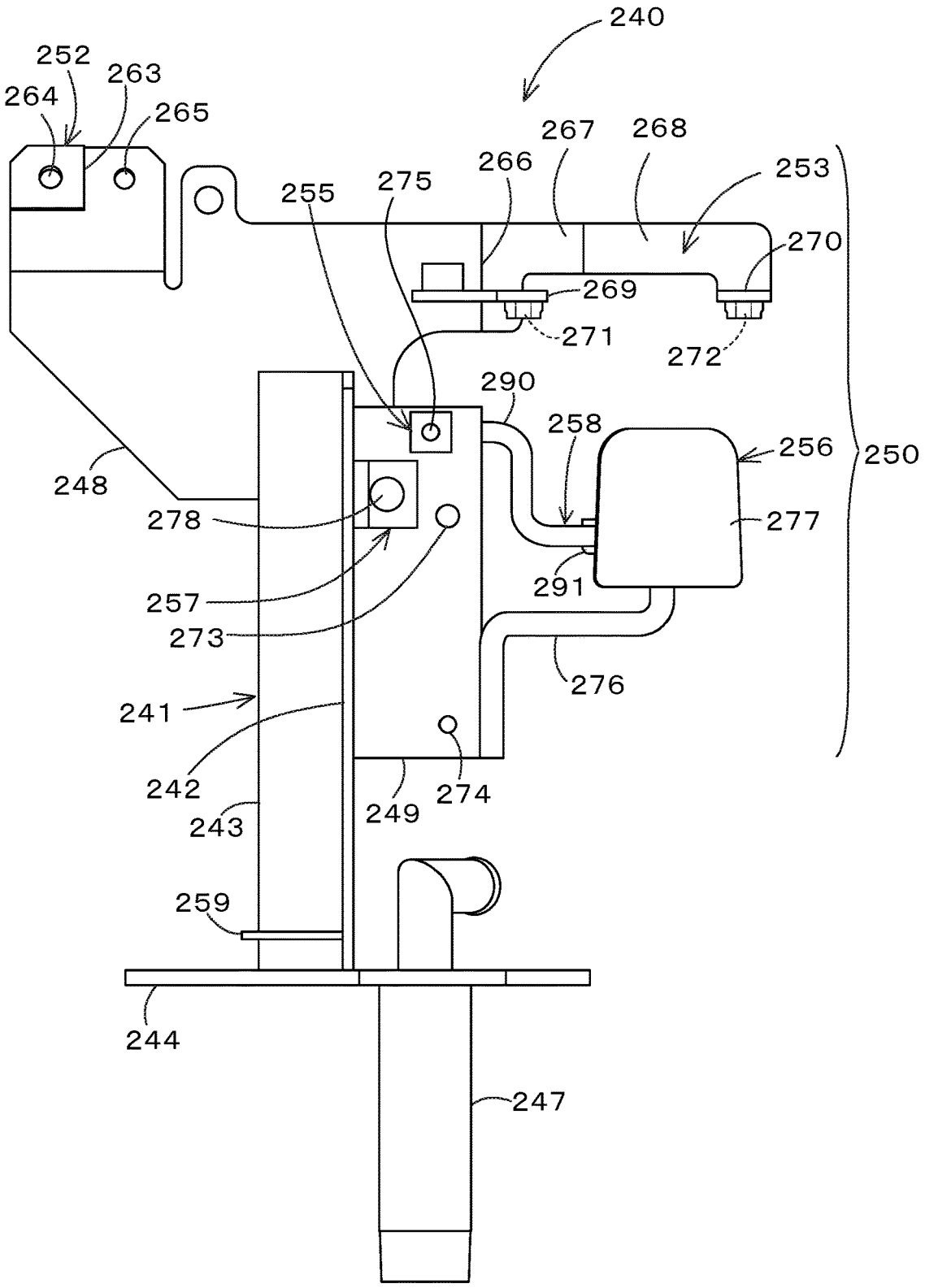
FIG. 23 is a rear view of the attachment member according to the third embodiment.

FIG. 20A is a front view of the neighborhood of the attachment member 240 illustrated in FIG. 17, etc. FIG. 21 is a front perspective view of the attachment member 240. FIG. 22 is a plan view of the attachment member 240. FIG. 23 is a rear view of the attachment member 240.

As illustrated in FIGS. 21 to 23, the attachment member 240 is integral with a cover 244. The attachment member 240 includes a base portion 241 and a support member 250. The base portion 241 is provided between the cover 244 and the support member 250. The cover 244 and the support member 250 are formed integrally with the base portion 241. The cover 244, the support member 250, and the base portion 241 are fixed to each other by welding or the like and are configured as an inseparable integral member. That is, the attachment member 240 is configured as an integral member having a fixed positional relationship between the cover 244, the support member 250, and the base portion 241.

The base portion 241 has a first wall 242 and a second wall 243. The first wall 242 extends in parallel with the front-rear direction K1. The second wall 243 extends leftward B1 from a front end portion of the first wall 242. The cover 244 has a shape that resembles a disc. The first wall 242 and the second wall 243 of the base portion 241 rise from a non-peripheral portion of the cover 244. Four or more through holes 246 are formed at predetermined intervals at a peripheral portion of the cover 244. As illustrated in FIG. 17, an opening 216 that is a through hole is formed in the pedestal 215 of the hydraulic fluid tank T1. A plurality of screw holes (not illustrated) is formed at a peripheral portion around the opening 216 at the same intervals as the intervals of the through holes 246 of the cover 244.

The cover 244 is placed on atop face 215*u* (FIGS. 19 and 20A) of the pedestal 215, and fastening members 217 (numerals partially omitted) such as bolts are inserted into the respective through holes 246 of the cover 244 and are threadably engaged with the respective screw holes around the opening 216. This fastens the cover 244 to the top face 215*u*, closes the opening 216 by the cover 244, and mounts the attachment member 240 onto the pedestal 215 of the hydraulic fluid tank T1. Moreover, it is possible to dismount the attachment member 240 from the hydraulic fluid tank T1 by removing the fastening members 217 from the screw holes around the opening 216 and the through holes 246 of the cover 244 and removing the cover 244 from the top face 215*u* of the pedestal 215. That is, the cover 244 and the attachment member 240 are mountable to and dismountable from the hydraulic fluid tank T1. With the same structure as above, the cover 220 is mounted at the opening 214 formed at the lower left portion of the hydraulic fluid tank T1. The cover 220 is mountable to and dismountable from the hydraulic fluid tank T1.

In a state in which the attachment member 240 is mounted to the hydraulic fluid tank T1 with the cover 244 fixed to the pedestal 215, the base portion 241 protrudes from the cover 244 in an opposite direction away from the top face 215*u* of the pedestal 215. The battery Bt is disposed between the first wall 242 of the base portion 241 and the upper tank portion 212 over the lower tank portion 211. The second wall 243 of the base portion 241 is located ahead of (A1) the battery Bt.

As illustrated in FIGS. 21 and 23, a pipe-like connection portion 247 is formed integrally at a non-peripheral portion of the cover 244 of the attachment member 240. The connection portion 247 extends through the cover 244. One end portion of the connection portion 247 protruding up from the cover 244 is located to the right of (B2) the base portion 241 and is bent obliquely rightward forward. As illustrated in FIGS. 19 and 20A, one end of a hose 232 is connected to one end of the connection portion 247.

As illustrated in FIGS. 21 and 23, the other end of the connection portion 247 protruding down from the cover 244 protrudes through the opening 216 into the inner space of the lower tank portion 211 in a state in which the cover 244 is fixed as illustrated in FIG. 17, etc. A filter (not illustrated) for trapping foreign particles/object contained in a hydraulic fluid is attached to the other end of the connection portion 247.

The hose 232 constitutes a part of the hydraulic fluid path 230 illustrated in FIG. 16. The other end of the hose 232 is connected to the oil cooler Oc (FIG. 16). The inner space of the hose 232 is continuous to the inner space of the connection portion 247, which is continuous to the inner space of the lower tank portion 211. The hose 232 constitutes a part of the fluid path 230 for returning a hydraulic fluid from the oil cooler Oc to the hydraulic fluid tank T1. The opening 216 of the lower tank portion 211 is an inlet through which the hydraulic fluid is returned into the hydraulic fluid tank T1. Moreover, the opening 216 is a replenishment port for hydraulic fluid supply into the hydraulic fluid tank T1.

As illustrated in FIGS. 21 to 23, the support member 250 of the attachment member 240 includes a plurality of supporting plates 248 and 249 and a plurality of supporting portions 251 to 259 (electric device supporting portions 251, 253, and 255, fuel device supporting portions 252 and 254, a tank supporting portion 256, a hose supporting portion 257, and a second battery supporting portion 259).

As illustrated in FIG. 21, the first supporting plate 248 is provided integrally with, and in parallel with, the second wall 243 on the front face of an upper portion of the second wall 243 of the base portion 241. The first supporting plate 248 extends leftward B1, rightward B2, and upward with respect to the second wall 243. The electric device supporting portion (first supporting portion) 251 is provided integrally with the first supporting plate 248 at a central portion of the front face of the first supporting plate 248. That is, the electric device supporting portion 251 is integral with the base portion 241. The electric device supporting portion 251 includes an upper half portion located at a predetermined distance from the first supporting plate 248, and a through hole 262, which goes through the upper half portion in the front-rear direction K1.

The fuse box 204 is supported in front of the first supporting plate 248 by the electric device supporting portion 251 described above as illustrated in FIGS. 17 and 18, etc. Specifically, a protrusion provided on the rear face of the fuse box 204 is inserted through the through hole 262 of the electric device supporting portion 251, and a fastening member such as a nut (not illustrated) is screwed on a screw portion formed on the circumferential surface of the protrusion. The fuse box 204 is fixed to the front face of the electric device supporting portion 251 by this structure. That is, the fuse box 204 is restricted by the electric device supporting portion 251 in orthogonal three-axis directions, which are the front-rear, left-right, and top-bottom directions. The electric device supporting portion 251 is disposed in proximity to the negative terminal −bt of the battery Bt. Therefore, the fuse box 204 is also disposed in proximity to the negative terminal −bt.

As illustrated in FIGS. 21 to 23, the fuel device supporting portion (second supporting portion) 252 is formed integrally with the first supporting plate 248 at a left portion of the front face of the first supporting plate 248. That is, the fuel device supporting portion 252 is integral with the base portion 241. The fuel device supporting portion 252 has a slit 263 and through holes 264 and 265. The slit 263 has a predetermined length downward from the top end of the supporting portion 252. The through holes 264 and 265 are formed to the left and right of the slit 263 respectively (in the machine-body width direction K2).

The fuel device supporting portion 252 is inclined forward A1 at a predetermined angle with respect to the first supporting plate 248. The left portion, which is to the left of the slit 263, of the fuel device supporting portion 252 is inclined rearward A2 at a predetermined angle. Therefore, the left portion, which is to the left of the slit 263, and the right portion, which is to the right thereof, of the fuel device supporting portion 252 are shifted in position from each other in the front-rear direction K1. The second fuel filter 201 is supported in front of the first supporting plate 248 by the fuel device supporting portion 252 described above as illustrated in FIGS. 17 and 18, etc. Specifically, for example, the second fuel filter 201 is fixed on the front face of the second supporting portion 252 by means of fastening members (not illustrated) such as bolts inserted through the through holes 264 and 265 of the fuel device supporting portion 252 respectively and nuts. That is, the second fuel filter 201 is restricted by the fuel device supporting portion 252 in orthogonal three-axis directions.

The purpose of inclination and shift in position of the fuel device supporting portion 252 described above is to support each portion of the second fuel filter 201 at a predetermined angle stably. The second fuel filter 201 and the fuse box 204 are supported respectively by the fuel device supporting portion 252 and the electric device supporting portion 251 near each other in front of the attachment member 240.

As illustrated in FIGS. 21 to 23, the electric device supporting portion (first supporting portion) 253 is formed integrally with the first supporting plate 248 rightward B2 of the first supporting plate 248. That is, the electric device supporting portion 253 is integral with the base portion 241. As illustrated in FIG. 22, the electric device supporting portion 253 includes extending portions 266, 267, and 268, receiving portions 269 and 270, and threaded engagement holes 271 and 272.

The first extending portion 266 extends forward A1 from a right end portion of the first supporting plate 248. The second extending portion 267 extends obliquely rightward forward from the front end of the first extending portion 266. The third extending portion 268 extends rightward B2 from the front end of the second extending portion 267. The first receiving portion 269 is provided at an area extending from behind the rear face of a right portion of the first supporting plate 248 to behind the rear face of a left portion of the second extending portion 267 while extending along the right side face of the first extending portion 266 therebetween. The first receiving portion 269 protrudes perpendicularly to the first supporting plate 248, the first extending portion 266, and the second extending portion 267. The second receiving portion 270 protrudes perpendicularly rearward A2 from the rear face of a right portion of the third extending portion 268.

The threaded engagement hole 271 is made up of a through hole (numeral omitted) formed through a right portion of the first receiving portion 269 and a screw hole (numeral omitted) of a nut fixed to a right portion of the lower face of the first receiving portion 269 continuously to the through hole. The threaded engagement hole 272 is made up of a through hole (numeral omitted) formed through the second receiving portion 270 and a screw hole (numeral omitted) of a nut fixed to the lower face of the second receiving portion 270 continuously to the through hole. The axial direction of each of the threaded engagement holes 271 and 272 is parallel to the vertical direction.

The isolator 203 is supported rightward and forward of the first supporting plate 248 by the electric device supporting portion 253 described above as illustrated in FIGS. 17 and 18, etc. Specifically, left and right side portions of the isolator 203 are placed on the upper face of the first receiving portion 269 and the second receiving portion 270 of the electric device supporting portion 253. Then, fastening members (numerals omitted) such as bolts, after having been inserted into respective through holes (not illustrated) formed in the left and right side portions of the isolator 203, are threadably engaged with the threaded engagement holes 271 and 272 respectively. By this engagement, the isolator 203 is fixed to the upper face of the first receiving portion 269 and the second receiving portion 270 of the electric device supporting portion 253. That is, the isolator 203 is restricted by the electric device supporting portion 253 in orthogonal three-axis directions. The electric device supporting portion 253 is disposed at the negative terminal −bt of the battery Bt. Therefore, the isolator 203 is also disposed at the negative terminal −bt.

As illustrated in FIGS. 21 to 23, a second supporting plate 249 is provided integrally with, and perpendicularly to, the first wall 242 on, and to the right of, the first wall 242 of the base portion 241. The second supporting plate 249 is located at a predetermined distance from the second wall 243 and the first receiving portion 269 and, similarly to the first supporting plate 248, extends rightward B2 (FIG. 22). As illustrated in FIG. 21, the fuel device supporting portion (second supporting portion) 254 is formed integrally with the second supporting plate 249 on the front face of the second supporting plate 249. That is, the fuel device supporting portion 254 is integral with the base portion 241. The fuel device supporting portion 254 is made up of the front face of the second supporting plate 249, and through holes 273 and 274 formed through the second supporting plate 249. The through holes 273 and 274 are formed at a predetermined distance therebetween in the vertical direction at a right end portion of the second supporting plate 249.

The fuel pump 202 is supported in front of the second supporting plate 249 by the fuel device supporting portion 254 described above as illustrated in FIGS. 17 and 20A. Specifically, for example, the fuel pump 202 is fixed on the front face of the second supporting plate 249 by means of fastening members (numerals omitted) such as bolts inserted through the through holes 273 and 274 of the fuel device supporting portion 254 respectively and nuts. That is, the fuel pump 202 is restricted by the fuel device supporting portion 254 in orthogonal three-axis directions.

As illustrated in FIG. 17, one end of a hose 282 and one end of a hose 283 are connected to the fuel pump 202 respectively. The other end of the hose 283 and one end of a hose 284 are connected to the second fuel filter 201 respectively. The other end of the hose 284 is connected to the prime mover Eg (FIG. 16). The other end of the hose 282 and one end of a hose 281 are connected to the first fuel filter 208 respectively. The other end of the hose 281 is connected to the fuel tank T2 (FIG. 16). These hoses 281 to 284 constitute the fuel path 280.

As illustrated in FIGS. 17 and 18, the first fuel filter 208 is supported in front of the upper tank portion 212 by means of a bracket 218 fixed to the front face of the upper tank portion 212 of the hydraulic fluid tank T1. The bracket 218 is integral with the upper tank portion 212. As another example, a fuel device supporting portion for supporting the first fuel filter 208 may be provided integrally with the base portion 241 or the cover 244 of the attachment member 240.

As illustrated in FIGS. 22 and 23, the electric device supporting portion (first supporting portion) 255 is formed integrally with the second supporting plate 249 at an upper portion of the rear face of the second supporting plate 249. That is, the electric device supporting portion 255 is integral with the base portion 241. The electric device supporting portion 255 protrudes rearward A2 from the rear face of the second supporting plate 249 and has a threaded engagement hole 275 (FIG. 23). The axial direction of the threaded engagement hole 275 is parallel to the front-rear direction K1.

The timer 205 is supported behind the second supporting plate 249 by the electric device supporting portion 255 described above as illustrated in FIGS. 18 and 19. Specifically, for example, a fastening member (numeral omitted) such as a bolt fixed to the timer 205 is threadably engaged with the threaded engagement hole 275 of the electric device supporting portion 255. With this, the timer 205 is fixed to the timer supporting portion 255. That is, the timer 205 is restricted by the electric device supporting portion 255 in orthogonal three-axis directions.

As illustrated in FIGS. 21 to 23, the tank supporting portion (second supporting portion) 256 is formed integrally with the second supporting plate 249 to the right of (B2) the second supporting plate 249. That is, the tank supporting portion 256 is integral with the base portion 241. The tank supporting portion 256 includes a bent beam 276 and a holding plate 277. The bent beam 276 has an S-bent shape as illustrated in FIGS. 21 and 23. The lower end portion of the bent beam 276 is fixed to the right end portion of the second supporting plate 249 at a position closer to its bottom. The front face of the holding plate 277 is fixed to an upper end portion of the bent beam 276.

As illustrated in FIGS. 17 and 20A, the reserve tank 206 is supported from ahead by the tank supporting portion 256 described above. More particularly, the holding plate 277 of the tank supporting portion 256 is in engagement with a recessed engagement portion **206*a* formed in the front face of the reserve tank 206. Because of this structure, the reserve tank 206 is held from ahead by the holding plate 277 and is thus not in contact with the isolator 203 nor with other portions of the attachment member 240. That is, the reserve tank 206 is restricted in an oblique leftward forward direction (one direction) by the tank supporting portion 256. The reserve tank 206 is fixed to a frame provided inside the machine body 2 by a member other than the attachment member 240** (not illustrated).

One end of a hose 301 and one end of the hose 207 are connected to the top of the reserve tank 206. The other end of each of the hoses 301 and 207 is connected to the radiator of the refrigerator Rg. The hoses 301 and 207 constitute the cooling fluid path 300 illustrated in FIG. 16.

As illustrated in FIGS. 21 to 23, the hose supporting portion (second supporting portion) 257 is formed integrally with the first wall 242 at a rear end portion of the first wall 242 of the base portion 241. That is, the hose supporting portion 257 is integral with the base portion 241. As illustrated in FIG. 22, the hose supporting portion 257 has an L shape. The hose supporting portion 257 includes a protruding-rightward portion (numeral omitted) that protrudes rightward B2 of the first wall 242 in parallel with the second supporting plate 249, and a through hole 278 (FIG. 23) formed in the protruding-rightward portion. The axis of the through hole 278 is parallel to the front-rear direction K1.

As illustrated in FIGS. 18 and 19, the hose 207 is supported by the hose supporting portion 257 described above. Specifically, for example, the hose 207 is hooked on the hose supporting portion 257 by engaging a sleeve-shaped engagement member 227 mounted on the hose 207 with the through hole 278. The engagement member 227, by being partially inserted into the through hole 278, may be hooked on the hose supporting portion 257, or alternatively, be fixed to the hose supporting portion 257. As another example, a string-like engagement member may be used for fixing the hose 207 to the hose supporting portion 257. That is, the hose 207 is restricted by the hose supporting portion 257 in at least one axial direction among the front-rear, left-right, and top-bottom directions.

As illustrated in FIGS. 21 to 23, a hose supporting portion 258 is formed integrally with the second supporting plate 249 at a front right position with respect to the second supporting plate 249. That is, the hose supporting portion 258 is integral with the base portion 241. The hose supporting portion 258 includes a bent beam 290, an engagement strip 291, and a through hole 292. As illustrated in FIG. 21, the bent beam 290 has an S-bent shape. The left end portion of the bent beam 290 is fixed to an upper portion of the front face of the second supporting plate 249. The right end portion of the bent beam 290 is located below the left end portion thereof. The engagement strip 291 is fixed to the right end of the bent beam 290 and protrudes forward. The through hole 292 is formed in the engagement strip 291. The axis of the through hole 292 is parallel to the vertical direction. In the working machine 1, as illustrated in FIG. 20A, the hose supporting portion 258 is a spare supporting portion that supports nothing. However, the hose supporting portion 258 is capable of supporting a hose located in the neighborhood of the hydraulic fluid tank T1, similarly to the hose supporting portion 257 described above.

Figure 20B:
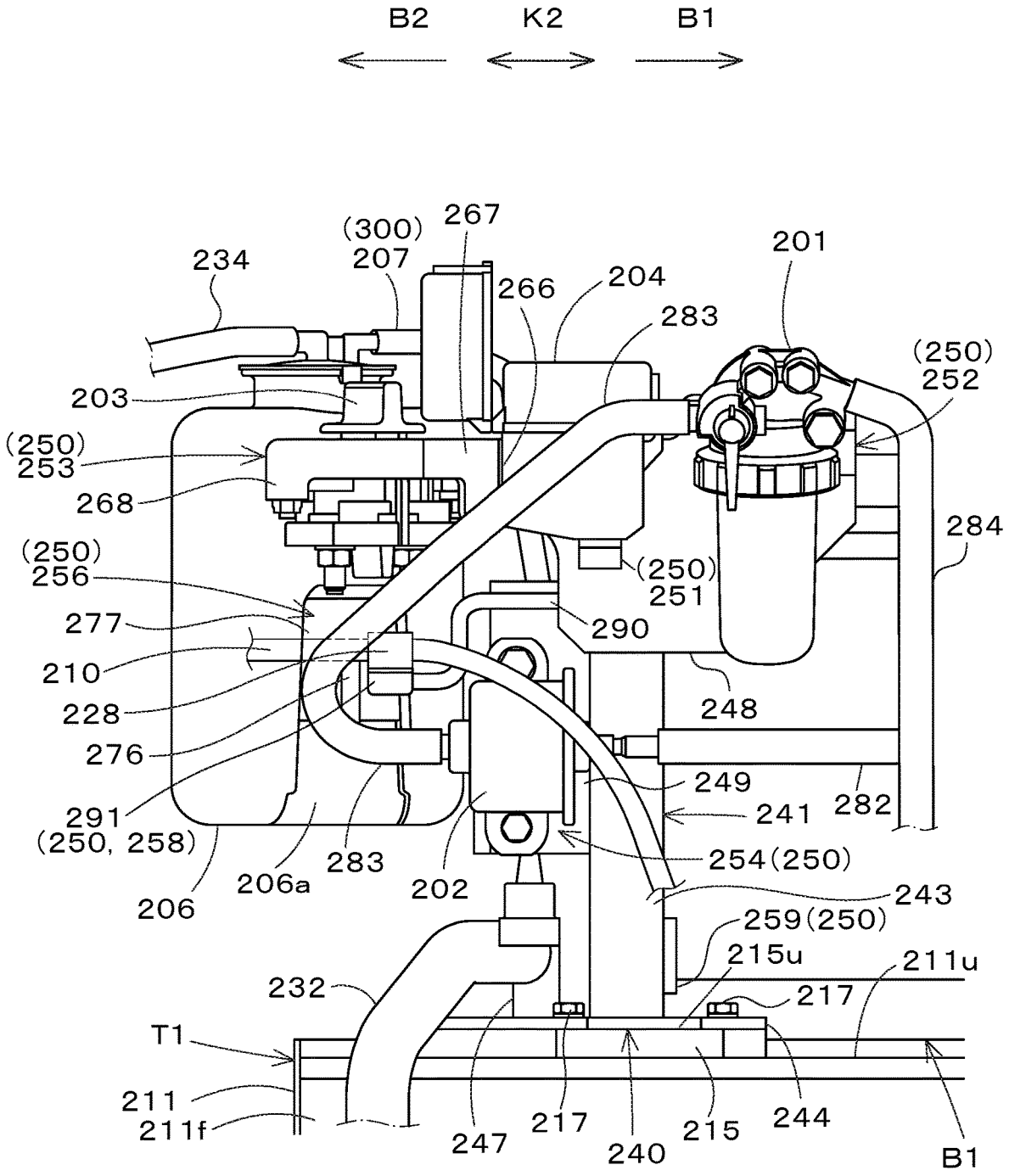
FIG. 20B is a front view of the neighborhood of the attachment member according to another example of the third embodiment.

FIG. 20B is a front view of the neighborhood of the attachment member 240 according to another example. For example, when a hose 210 through which a hydraulic fluid flows to an upper right portion of the lower tank portion 211 of the hydraulic fluid tank T1 is routed, it is possible to support the hose 210 by means of the hose supporting portion 258. Specifically, for example, the hose 210 is hooked on the hose supporting portion 258 by engaging a sleeve-shaped engagement member 228 mounted on the hose 210 with the through hole 292 of the hose supporting portion 258. The hose 210 is guided by the hose supporting portion 258 such that the tube axis of the hose 210 is oriented in a predetermined direction. As another example, a string-like engagement member may be used for fixing the hose 210 to the hose supporting portion 258. That is, the hose 210 is restricted by the hose supporting portion 258 in orthogonal three-axis directions.

The hose 210 is provided on the hydraulic fluid path 230 and constitutes the hydraulic fluid path 230. The hose 210 is included in the second devices and the hydraulic devices that are provided on the piping system. As another example, a hydraulic device other than the hose 210 may be supported by the hose supporting portion 258. Alternatively, for example, an electric wire or a harness or an electric device that is provided on an electric path, or a device provided on other path, may be supported by the hose supporting portion 258.

As illustrated in FIGS. 17 and 19, a first battery supporting portion 219 is formed integrally with the upper tank portion 212 and the lower tank portion 211 over the lower tank portion 211 of the hydraulic fluid tank T1 to the right of (B2) the upper tank portion 212. The first battery supporting portion 219 supports, from below, the positive terminal portion +bt (left end portion) of the battery Bt disposed over the lower tank portion 211. An insulation member 225 is provided between the first battery supporting portion 219 and the battery Bt.

As illustrated in FIGS. 22 and 23, the second battery supporting portion 259 is formed integrally with the first wall 242 and the second wall 243 to the left of (B1) the first wall 242 of the base portion 241 and behind (A2) the second wall 243 thereof. That is, the second battery supporting portion 259 is integral with the base portion 241. In addition, the second battery supporting portion 259 protrudes perpendicularly from a lower portion of the first wall 242 and the second wall 243 and is parallel to the cover 244.

As illustrated in FIG. 19, the second battery supporting portion 259 supports the negative terminal portion −bt (right end portion) of the battery Bt from below. An insulation member 226 is provided between the second battery supporting portion 259 and the battery Bt. An insulation member 224 is provided between each wall 242, 243 of the base portion 241 and the battery Bt. The battery Bt is located at a distance from the lower tank portion 211 and the upper tank portion 212 and is insulated against them.

To install the above-described attachment member 240 and the above-described plurality of devices 201 to 207 (the second fuel filter 201, the fuel pump 202, the isolator 203, the fuse box 204, the timer 205, the reserve tank 206, and the hose 207) and the above-described battery Bt, for example, first, the attachment member 240 is mounted onto the hydraulic fluid tank T1. Then, the plurality of devices 201 to 207 and the battery Bt are supported by the supporting portions 251 to 257 and 259 of the attachment member 240. Alternatively, for example, the attachment member 240 may be mounted onto the hydraulic fluid tank T1 after supporting (fixing) the isolator 203, the fuse box 204, the fuel pump 202, the second fuel filter 201 by the supporting portions 253, 251, 254, 252 of the attachment member 240. As another example, the air cleaner 209 and the air passage 310 that are illustrated in FIG. 16 may be disposed between the hydraulic fluid tank T1 and the prime mover Eg, and a supporting portion that supports the air cleaner 209 or the air passage 310 individually may be provided on the attachment member 240.

An electric device supporting portion that supports an electric device (which encompasses a harness, an electric wire, an electronic component, and/or the like) other than the above-described electric devices 203, 204, and 205, a fuel device supporting portion that supports a fuel device other than the above-described fuel devices 201, 202, and 208, a cooling device supporting portion that supports a cooling device other than the above-described the reserve tank 206, and/or a supporting portion that supports a device (which encompasses a hose and/or the like) provided on other path may be provided on the attachment member 240. Moreover, a supporting portion that supports a hydraulic device (a hydraulic device used for actuating the working device 4 and disposed inside the machine body 2) provided on the hydraulic fluid path 230 may be provided on the attachment member 240.

An attachment member integral with a cover mounted detachably to the fuel tank T2 and closing an opening of the fuel tank T2 may be provided. Then, two or more kinds of device among an electric device, a fuel device, a cooling device, a hydraulic device, and the like may be attached to the attachment member.

The working machine 1 according to the present embodiment produces the following effects.

First, configurations and effects related to the lock mechanism 114 according to the first embodiment will be described below.

A working machine 1 according to a first embodiment includes: a machine body 2; an operator's seat 6 provided on the machine body 2; and a manipulator base 23 provided in front of the operator's seat 6, the manipulator base 23 including an operation support shaft 34 extending in a width direction of the machine body 2, an operation member 41 supported such that the operation member 41 is rotatable about an axis of the operation support shaft 34 relative to the operation support shaft 34, and a lock mechanism 114 switchable between a locking state and an unlocking state, the locking state being a state in which a movement of the operation member 41 is restricted, the unlocking state being a state in which the movement of the operation member 41 is allowed, the lock mechanism 114 including an engagement portion 45L, 45R to rotate together with the operation member 41, a lock body 126 including an engaged portion (lock pin) 126C for engagement with the engagement portion 45L, 45R, a lock support shaft 128 supporting one of opposite end portions of the lock body 126 rotatably, and a driving portion 131 to apply a driving force to the other of the opposite end portions of the lock body 126, wherein the engaged portion 126C is provided at an intermediate portion between the one of the opposite end portions of the lock body 126 and the other of the opposite end portions of the lock body 126, and the lock body 126 is configured to be rotated about an axis of the lock support shaft 128 by the driving force applied by the driving portion 131 to change in position between an engagement position P1 in which the engaged portion 126C is in engagement with the engagement portion 45L, 45R and a disengagement position P2 in which the engaged portion 126C is not in engagement with the engagement portion 45L, 45R.

With the above configuration, the engaged portion 126C is provided at an intermediate portion between one of the opposite end portions which is a fixed end of the cantilever-supported cantilevered lock body 126 and the other of the opposite end portions which is a free end of the lock body 126. Therefore, in comparison with a known configuration in which the engaged portion 126C is provided on the free end of the lock body 126, it is possible to prevent or reduce the deviation of the position and angle of the engaged portion 126C relative to the engagement portion 45L, 45R, and thus enhance the accuracy of the operation of the lock mechanism 114 which locks or unlocks the movement of the operation member 41.

The driving portion 131 includes an interlock portion 132 provided on the operation support shaft 34 and configured to rotate together with the operation support shaft 34, and a linking member 133 to link the interlock portion 132 to the lock body 126. The lock body 126 is connected, at the other of the opposite end portions, to the linking member 133 such that the lock body 126 is rotatable relative to the linking member 133. With this configuration, it is possible to transmit a rotational driving force from the operation support shaft 34 to the lock body 126 via the interlock portion 132 and the linking member 133 and cause the lock body 126 to move between the engagement position P1 and the disengagement position P2.

The lock support shaft 128 is disposed rearward of the operation support shaft 34 in a front-rear direction of the machine body 2. The interlock portion 132 is disposed forward of the operation support shaft 34 in the front-rear direction of the machine body 2. The lock body 126 and the linking member 133 are connected to each other at a position higher than the operation support shaft 34. Note, however, that the lock support shaft 128 may be disposed forward of or rearward of the operation support shaft 34 in a front-rear direction of the machine body 2, the interlock portion 132 may be disposed on the opposite side of the operation support shaft 34 from the lock support shaft 128 in the front-rear direction of the machine body 2, and the lock body 126 and the linking member 133 may be connected to each other at a position higher than or lower than the operation support shaft 34. With this configuration, it is possible to place the lock mechanism 114 utilizing a limited inner space of the manipulator base 23 efficiently.

The engagement portion 45L, 45R protrudes from a base portion 44L, 44R of the operation member 41 outward in a radial direction of the operation support shaft 34 and has an engagement groove 46L, 46R extending from a distal end of the engagement portion 45L, 45R toward the operation support shaft 34. The interlock portion 132 protrudes upward and outward in a radial direction of the operation support shaft 34. The linking member 133 is disposed higher than the operation support shaft 34. The lock support shaft 128 is disposed lower than the operation support shaft 34 and substantially in parallel to the operation support shaft 34. The lock body 126 is configured to swing about the axis of the lock support shaft 128 forward and rearward. The engaged portion 126C includes a lock pin 126C that protrudes in the width direction of the machine body 2 from the intermediate portion of the lock body 126 and is configured to be engaged with and disengaged from the engagement groove 46L, 46R. With this configuration, by rotating the lock body 126, it is possible to change the position of the lock body 126 easily to the position P1 where the lock pin 126C is in engagement with the engagement groove 46L, 46R and to the position P2 where the lock pin 126C is not in engagement with the engagement groove 46L, 46R.

The manipulator base 23 may include a lock lever 50 changeable in position between a first position X1 and a second position X2, the first position X1 being a position in which an operator is allowed to get on and off the working machine via a passage between the operator's seat 6 and the manipulator base 23, the second position X2 being a position in which the operator is prevented from getting on and off the working machine, and the driving portion 131 may transmit a manipulation force for changing the position of the lock lever 50 as the driving force to the other of the opposite end portions of the lock body 126 to cause the lock body 126 to rotate about the axis of the lock support shaft 128. With this configuration, it is possible to switch the lock mechanism 114 between a locking state and an unlocking state easily by the manipulation force applied to the lock lever 50.

The driving portion 131 may include an actuator 139 to generate the driving force. With this configuration, it is possible to switch the lock mechanism 114 between a locking state and an unlocking state easily by driving the actuator 139.

The working machine 1 may further include: a working device 4 supported in front of the machine body 2; and a traveling device 3 supporting the machine body 2 such that the machine body 2 is allowed to travel. The manipulator base 23 includes a plurality of levers to be manipulated to operate the working device 4 and the traveling device 3, respectively. The operation member 41 is a traveling lever to be manipulated to operate the traveling device 3, the traveling lever being one of the plurality of levers. With this configuration, it is possible to switch the traveling lever 41 between a locked state and an unlocked state easily and appropriately by the lock mechanism 114.

The following description discusses features and effects related to a lock mechanism 314 according to a second embodiment.

A working machine 1 according to the second embodiment includes: a machine body 2; and a manipulator base 23 provided on the machine body 2, the manipulator base 23 including a first shaft (operation support shaft) 34 extending in a width direction K2 of the machine body 2, a first operation member 41 supported such that the first operation member 41 is rotatable about an axis of the first shaft 34 relative to the first shaft 34, a lock mechanism 314 switchable between a locking state and an unlocking state, the locking state being a state in which a movement of the first operation member 41 is restricted, the unlocking state being a state in which the movement of the first operation member 41 is allowed, a second shaft (operation shaft) 33 provided in parallel to the first shaft 34, and a second operation member (dozer lever) 66 supported such that the second operation member 66 is rotatable about an axis of the second shaft 33 relative to the second shaft 33, wherein the lock mechanism 314 includes an engagement portion 45L, 45R to rotate together with the first operation member 41, a lock body 326 including an engaged portion (lock pin) 326C for engagement with the engagement portion 45L, 45R, and a driving portion 331 to apply a driving force to the lock body 326, the second shaft 33 supports the lock body 326 such that the lock body 326 is rotatable relative to the second shaft 33, and the lock body 326 is configured to be rotated about an axis of the second shaft 33 relative to the second shaft 33 by the driving force applied by the driving portion 331 to change in position between an engagement position P1*a* in which the engaged portion 326C is in engagement with the engagement portion 45L, 45R and a disengagement position P2*a* in which the engaged portion 326C is not in engagement with the engagement portion 45L, 45R.

With the above configuration, the lock body 326 is supported by the second shaft 33 which supports the second operation member 66, without providing a dedicated supporting member which supports the lock body 326 of the lock mechanism 314. Therefore, in comparison with known lock mechanisms such as one disclosed in Japanese Unexamined Patent Application Publication No. 2018-199917, it is possible to reduce the number of constituent parts of the lock mechanism 314 and the number of dedicated parts supporting the lock mechanism 314 and reduce the total amount of dimension errors caused by deformation or wear, etc. of these parts. This makes it possible to enhance the accuracy of operation of the lock mechanism 314 that locks or unlocks the movement of the operation member 41, and to keep the accuracy of operation high.

The manipulator base 23 further includes: a plurality of third operation members 71L, 71R (first manipulation lever 71L and second manipulation lever 71R) to be manipulated to operate a respective plurality of objects (control valves V3 and V10, arm cylinder C4, boom cylinder C3, arm 16, and boom 15), and an operation switching mechanism 315 to switch the objects to be operated by the respective plurality of third operation members 71L, 71R, the operation switching mechanism 315 including a third shaft (support shaft) 37 provided in parallel to the first shaft 34 between the first shaft 34 and the second shaft 33, a plurality of rotary members 38B, 38E (second rotary sleeve 38B, fifth rotary sleeve 38E) supported such that the plurality of rotary members 38B, 38E are rotatable about an axis of the third shaft 37 relative to the third shaft 37, and a plurality of link members 89B, 89D (second interlock member 89B, fourth interlock member 89D) each of which is rotatably connected to one of the plurality of third operation members 71L, 71R and one of the plurality of rotary members 38B, 38E in a selectable manner, and the lock body 326 extends from the second shaft 33 to the first shaft 34 via an area located radially outward of one of the plurality of rotary members 38B, 38E. This makes it possible to place the lock mechanism 314 and the operation switching mechanism 315 in a space between the first shaft 34 and the second shaft 33 inside the manipulator base 23, making the space occupied by the lock mechanism 314 and the operation switching mechanism 315 smaller.

The driving portion 331 includes an interlock portion 332 provided on the first shaft 34 and configured to rotate together with the first shaft 34, and a linking member 333 connected to the interlock portion 332 and the lock body 326 such that the linking member 333 is rotatable relative to the interlock portion 332 and the lock body 326, a junction of the interlock portion 332 and the linking member 333 is more distant from the second shaft 33 than the engaged portion 326C of the lock body 326 is, and a junction of the lock body 326 and the linking member 333 is closer to the second shaft 33 than the engaged portion 326C of the lock body 326 is. This makes it possible to transmit a rotational driving force from the first shaft 34 to the lock body 326 via the interlock portion 332 and the linking member 333 and cause the lock body 326 to move between the engagement position P1*a* and the disengagement position P2*a*. Moreover, since the junction of the lock body 326 and the linking member 333 (the point of effort of the lock body 326) is closer to the second shaft 33 (the fulcrum of the lock body 326) than the engaged portion 326C (the point of load of the lock body 326) is, even if the angle of rotation of the first shaft 34 is small, it is possible to rotate the lock body 326 to engage the engaged portion 326C with, and disengage it from, the engagement portion 45L, 45R.

The engagement portion 45L, 45R protrudes from a base portion 44L, 44R of the first operation member 41 outward in a radial direction of the first shaft 34 and has an engagement groove 46L, 46R extending from a distal end of the engagement portion 45L, 45R toward the first shaft 34. The interlock portion 332 protrudes upward and outward in a radial direction of the first shaft 34. The linking member 333 extends from an area above the first shaft 34 to an area below the first shaft 34 via an area radially outward of the first shaft 34. The second shaft 33 is disposed lower than the first shaft 34. The lock body 326 is configured to swing about the axis of the second shaft 33 forward and rearward (in a front-rear direction K1). The engaged portion 326C includes a lock pin 326C that protrudes in the width direction K2 of the machine body 2 from an upper end portion of the lock body 326 and is configured to be engaged with and disengaged from the engagement groove 46L, 46R. This makes it possible to change the position of the lock body 326 easily to the position P1*a* where the lock pin 326C is in engagement with the engagement groove 46L, 46R and to the position P2*a* where the lock pin 326C is not in engagement with the engagement groove 46L, 46R by rotating the lock body 326. Moreover, it is possible to place the junction of the lock body 326 and the linking member 333 (the point of effort of the lock body 326) at a position closer to the second shaft 33 (the fulcrum of the lock body 326) than the engaged portion 326C (the point of load of the lock body 326) is.

The manipulator base 23 further includes: an arm protrusion portion 45X, 45Y protruding outward in a radial direction of the first shaft 34 from a position different from a position of the engagement portion 45L, 45R on the base portion 44L, 44R of the first operation member 41. A joint (ball joint) 49L, 49R rotatably connected to the arm protrusion portion 45X, 45Y. A rod (connecting rod) 48L, 48R having one of opposite ends (lower end) thereof connected to a spool S4, S7 of a control valve V4, V7. A relay member 340 including a first threaded connected portion (external thread portion) 340*q* and a second threaded connected portion (external thread portion) 340*s*, the first threaded connected portion 340*q* being in threaded engagement with a first threaded connecting portion (internal thread portion) 49*p* in the joint 49L, 49R, the second threaded connected portion 340*s* being in threaded engagement with a second threaded connecting portion (internal thread portion) 48*p* in the other of the opposite ends (upper end) of the rod 48L, 48R. One of first and second threaded engagement structures has right hand threads and the other of the first and second threaded engagement structures has left hand threads, the first threaded engagement structure being a threaded engagement structure between the first threaded connecting portion 49*p* and the first threaded connected portion 340*q*, the second threaded engagement structure being a threaded engagement structure between the second threaded connecting portion 48*p* and the second threaded connected portion 340*s*.

With the above configuration, by rotating the rod 48L, 48R or the relay member 340 about an axis to adjust the depth of threaded engagement of the rod 48L, 48R and the relay member 340 or the depth of threaded engagement of the relay member 340 and the joint 49L, 49R, it is possible to adjust the position of the engagement portion 45L, 45R of the lock mechanism 314 around the first shaft 34 with high accuracy, and adjust the engagement state of the engagement groove 46L, 46R of the engagement portion 45L, 45R with the engaged portion 326C appropriately.

The lock body 326 further includes a cavity portion 326D in which one of the plurality of rotary members 38B, 38E enters without contacting the lock body 326 when the lock body 326 is in the engagement position P1*a*. This makes it possible to place the lock body 326 near the third shaft 37 supporting the rotary member 38B, 38E and thus make the amount of protrusion of the lock mechanism 314 rearward A2 smaller. Moreover, it is possible to prevent the contact of the lock body 326 with any one of the plurality of rotary members 38B, 38E (in the example illustrated in FIG. 9, the rotary member 38E) when located in the engagement position P1*a* and thus keep the performance of the lock mechanism 314 and the operation switching mechanism 315 high.

The manipulator base 23 further includes a lock lever 50A to be swung between a first position X1*a* and a second position X2*a*. The driving portion 331 transmits a force of swinging the lock lever 50A as the driving force to the lock body 326 to cause the lock body 326 rotate about the axis of the second shaft 33 to change in position between the engagement position P1*a* and the disengagement position P2*a*. This makes it possible to switch the lock mechanism 314 between a locking state and an unlocking state easily by means of the manipulation force applied to the lock lever 50A.

The driving portion 331 includes an actuator 339 to generate the driving force. This makes it possible to switch the lock mechanism 314 between a locking state and an unlocking state easily by driving the actuator 339.

The working machine 1 further includes: a traveling device 3 to support the machine body 2 such that the machine body 2 is allowed to travel; and a working device 4 and a dozer device 7 which are supported on the machine body 2. The manipulator base 23 further includes a plurality of levers 41L, 41R, 71L, 71R, and 66 to be manipulated to operate the traveling device 3, the working device 4, and the dozer device 7, respectively. The first operation member 41 is a traveling lever 41L, 41R (first traveling lever 41L, second traveling lever 41R) to be manipulated to operate the traveling device 3, the second operation member 66 is a dozer lever 66 to be manipulated to operate the dozer device 7, and the third operation member 71L, 71R is a manipulation lever 71L, 71R (first manipulation lever 71L, second manipulation lever 71R) to be manipulated to operate the working device 4, the traveling lever 41L, 41R, the dozer lever 66, and the manipulation lever 71L, 71R being included in the plurality of levers 41L, 41R, 71L, 71R, and 66. This makes it possible to make the number of constituent parts of the lock mechanism 314 smaller than the number of constituent parts of a known lock mechanism by supporting the lock body 326 by the second shaft 33 supporting the dozer lever 66. Moreover, it is possible to lock or unlock the movement of the traveling lever 41L, 41R by the lock mechanism 314. Furthermore, combining the lock mechanism 112, 113 for the manipulation lever 71L, 71R with the lock mechanism 314 makes it possible to lock or unlock both the movement of the manipulation lever 71L, 71R and the movement of the traveling lever 41L, 41R by swinging the lock lever 50A.

The working device 4 includes a boom 15 rotatably connected to the machine body 2, and an arm 16 rotatably connected to a distal end portion of the boom 15. The third operation member 71L, 71R includes a plurality of manipulation levers 71L, 71R to be manipulated to operate the boom 15 and the arm 16, respectively. The operation switching mechanism 315 is configured to use each of the plurality of manipulation levers 71L, 71R selectively as a boom operation lever manipulated to operate the boom 15 or an arm operation lever manipulated to operate the arm 16. This makes it possible to place the operation switching mechanism 315, which switches the object to be operated by the manipulation lever 71L, 71R to the boom 15 or the arm 16, and the lock mechanism 314 inside the manipulator base 23, making the inner space occupied by the operation switching mechanism 315 and the lock mechanism 314 smaller.

The following discusses features and effects related to an attachment member 240 according to a third embodiment.

A working machine 1 according to the third embodiment includes: a machine body 2; a tank (hydraulic fluid tank) T1 provided inside the machine body 2 and containing a liquid; a cover 244 mounted detachably to the tank T1 and closing an opening 216 of the tank T1; and an attachment member 240 to which a plurality of devices 201 to 205, 207, and 210 is attached, wherein the attachment member 240 is integral with the cover 244. With this configuration, by mounting the cover 244 onto the tank T1, it is possible to mount, onto the tank T1, the plurality of devices 201 to 205, 207, and 210 attached to the attachment member 240 integral with the cover 244. Therefore, there is no need to pre-fix to the tank T1 bosses, etc. for mounting an attachment member such as a bracket onto the tank T1 as done in related art; accordingly, it is possible to mount the plurality of devices 201 to 205, 207, and 210 onto the tank T1 easily and properly.

The cover 244 includes four or more through holes 246 formed at predetermined intervals along a peripheral portion of the cover 244, and is fixed to the tank T1 by means of fastening members 217 inserted through the through holes 246. With this configuration, since the cover 244 is fixed to the tank T1 by means of four or more fastening members 217, it is possible to reduce an error in assembly of the cover 244 onto the tank T1. With this, it is possible to reduce variations in attachment positions of the devices 201 to 205, 207, and 210 attached to the attachment member 240 integral with the cover 244. More preferably, the number of the through holes 246, and of the fastening members 217, should be five or more. Still more preferably, said number should be six or more.

The tank T1 is a hydraulic fluid tank T1 containing a hydraulic fluid for causing the working device 4 to operate. However, in place of the hydraulic fluid tank T1, the cover 244 and the attachment member 240 may be mounted on a fuel tank T2 containing fuel. In general, the hydraulic fluid tank T1 and the fuel tank T2 have high rigidity. Therefore, with the above configuration, it is possible to reduce variations in attachment positions of the devices 201 to 205, 207, and 210 attached to the attachment member 240.

The plurality of devices 201 to 205, 207, and 210 includes devices provided on different piping/wiring systems. In general, each of devices provided on different piping/wiring systems is mounted in/on a machine body by means of an individual bracket. By contrast, with the above configuration, it is possible to mount the devices 201 to 205, 207, and 210 provided on different piping/wiring systems by using a common attachment member 240. Therefore, it is possible to enhance the precision in attachment positions of these devices 201 to 205, 207, and 210 relative to one another.

Moreover, it is possible to improve work operability in attaching each of the devices 201 to 205, 207, and 210.

The working machine 1 further includes: an electric path 320 through which a current flows; and a fluid path 230, 280, 300 (the hydraulic fluid path 230, the fuel path 280, the cooling fluid path 300) through which a fluid flows, wherein the plurality of devices 201 to 205, 207, and 210 includes a first device 203, 204, 205 provided on the electric path 320 and a second device 201, 202, 207, 210 provided on the fluid path 230, 280, 300, and the first device and the second device are attached to the attachment member 240. With this configuration, it is possible to perform positioning of the first device 203, 204, 205 whose installation position is limited by the electric path 320 and the second device 201, 202, 207, 210 whose installation position is limited by the fluid path 230, 280, 300 easily by means of the attachment member 240, and improve work operability in mounting them onto the tank T1.

The working machine 1 further includes: a prime mover Eg that is an engine mounted in the machine body 2, wherein the fluid path includes a fuel path 280 through which fuel is supplied to the prime mover, the second device includes a fuel device 201, 202 provided on the fuel path 280, the first device includes an electric device 203, 204, 205 through which the current flowing through the electric path 320 flows, and the fuel device 201, 202 and the electric device 203, 204, 205 are attached to the attachment member 240. With this configuration, it is possible to perform positioning of the fuel device 201, 202 and the electric device 203, 204, 205 easily by means of the attachment member 240, and improve work operability in mounting them onto the tank T1.

Among a fuel pump 202 and fuel filters 201 and 208 that are included in the fuel device(s), the fuel pump 202 and the second fuel filter 201 are attached to the attachment member 240; however, at least one of these fuel devices 201, 202, 208 may be attached to the attachment member 240. With this configuration, it is possible to perform positioning of at least one of the fuel devices whose installation position is limited by the fuel path 280 easily by means of the attachment member 240, and improve work operability in mounting the fuel device onto the tank T1.

The electric device(s) includes an isolator 203 that shuts off current flow through the electric path 320 and a fuse box 204 in which a built-in fuse that prevents overcurrent flow through the electric path 320 is provided, and they are attached to the attachment member 240; however, at least one of them may be attached to the attachment member 240. With this configuration, it is possible to perform positioning of the isolator 203 or the fuse box 204 whose installation position is limited by the electric path 320 easily by means of the attachment member 240, and improve work operability in mounting it onto the tank T1. Moreover, a timer 205, which is included in the electric device(s), can also be easily positioned by means of the attachment member 240, thereby improving work operability in mounting it onto the tank T1.

The fluid path(s) includes a cooling fluid path 300 through which a cooling fluid flows, a cooling device(s) provided on the cooling fluid path 300 includes a reserve tank 206 containing the cooling fluid, and the attachment member 240 restricts the reserve tank 206 in one direction; however, the attachment member 240 may restrict the reserve tank 206 in two or more directions. With this configuration, it is possible to perform positioning of the reserve tank 206 easily while avoiding positional interference with ambient devices 203 and other portions of the attachment member 240, etc., and improve work operability in mounting the reserve tank 206.

The plurality of devices 201 to 205, 207, and 210 includes two or more kinds of device among an electric device 203, 204, 205 provided on an electric path 320 through which a current flows, a fuel device 201, 202 provided on a fuel path 280, a hydraulic device 210 provided on a hydraulic fluid path 230, and a cooling device 207 provided on a cooling fluid path 300 through which a cooling fluid flows. With this configuration, it is possible to perform positioning of the plurality of devices 201 to 205, 207, and 210 whose installation positions are limited by the electric path 320, the fuel path 280, the hydraulic fluid path 230, and the cooling fluid path 300 easily by means of the attachment member 240, and improve work operability in mounting them onto the tank T1.

The attachment member 240 includes a plurality of supporting portions 251 to 259 supporting the plurality of devices 201 to 207, 210, and Bt and restricting them in at least one direction, and the supporting portions 251 to 259 include a hose supporting portion 257 for a hose 207, 210 connected to the device (the reserve tank 206, the hydraulic fluid tank T1, the hydraulic device, etc.) provided on the fluid path. With this configuration, it is possible to perform positioning of the plurality of devices 201 to 207, 210, and Bt easily by means of the attachment member 240. Moreover, it is possible to route the hose 207, 210 among them properly inside the machine body 2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a machine body;

an operator's seat provided on the machine body; and a manipulator base provided in front of the operator's seat, the manipulator base including an operation support shaft extending in a width direction of the machine body, an operation member supported such that the operation member is rotatable about an axis of the operation support shaft relative to the operation support shaft, and a lock mechanism switchable between a locking state and an unlocking state, the locking state being a state in which a movement of the operation member is restricted, the unlocking state being a state in which the movement of the operation member is allowed, the lock mechanism including an engagement portion to rotate together with the operation member, a lock body including an engaged portion for engagement with the engagement portion, a lock support shaft supporting one of opposite end portions of the lock body rotatably, and a driving portion to apply a driving force to the other of the opposite end portions of the lock body, wherein the engaged portion is provided at an intermediate portion between the one of the opposite end portions of the lock body and the other of the opposite end portions of the lock body, and the lock body is configured to be rotated about an axis of the lock support shaft by the driving force applied by the driving portion to change in position between an engagement position in which the engaged portion is in engagement with the engagement portion and a disengagement position in which the engaged portion is not in engagement with the engagement portion.

2. The working machine according to claim 1, wherein the driving portion includes an interlock portion provided on the operation support shaft and configured to rotate together with the operation support shaft, and a linking member to link the interlock portion to the lock body, and the lock body is connected, at the other of the opposite end portions, to the linking member such that the lock body is rotatable relative to the linking member.

3. The working machine according to claim 2, wherein the lock support shaft is disposed forward of or rearward of the operation support shaft in a front-rear direction of the machine body, the interlock portion is disposed on the opposite side of the operation support shaft from the lock support shaft in the front-rear direction of the machine body, and the lock body and the linking member are connected to each other at a position higher than or lower than the operation support shaft.

4. The working machine according to claim 3, wherein the engagement portion protrudes from a base portion of the operation member outward in a radial direction of the operation support shaft and has an engagement groove extending from a distal end of the engagement portion toward the operation support shaft, the interlock portion protrudes upward and outward in a radial direction of the operation support shaft, the linking member is disposed higher than the operation support shaft, the lock support shaft is disposed lower than the operation support shaft and substantially in parallel to the operation support shaft, the lock body is configured to swing about the axis of the lock support shaft forward and rearward, and the engaged portion includes a lock pin that protrudes in the width direction of the machine body from the intermediate portion of the lock body and is configured to be engaged with and disengaged from the engagement groove.

5. The working machine according to claim 1, further comprising:

a working device supported in front of the machine body; and a traveling device supporting the machine body such that the machine body is allowed to travel, wherein the manipulator base includes a plurality of levers to be manipulated to operate the working device and the traveling device, respectively, and the operation member is a traveling lever to be manipulated to operate the traveling device, the traveling lever being one of the plurality of levers.

6. The working machine according to claim 1, wherein the manipulator base further includes a lock lever to be swung between a first position and a second position, and the driving portion transmits a force of swinging the lock lever as the driving force to the lock body to cause the lock body to change in position between the engagement position and the disengagement position.

7. The working machine according to claim 1, wherein the driving portion includes an actuator to generate the driving force.

8. A working machine, comprising:

a machine body; and a manipulator base provided on the machine body, the manipulator base including a first shaft extending in a width direction of the machine body, a first operation member supported such that the first operation member is rotatable about an axis of the first shaft relative to the first shaft, a lock mechanism switchable between a locking state and an unlocking state, the locking state being a state in which a movement of the first operation member is restricted, the unlocking state being a state in which the movement of the first operation member is allowed, a second shaft provided in parallel to the first shaft, and a second operation member supported such that the second operation member is rotatable about an axis of the second shaft relative to the second shaft, wherein the lock mechanism includes an engagement portion to rotate together with the first operation member, a lock body including an engaged portion for engagement with the engagement portion, and a driving portion to apply a driving force to the lock body, the second shaft supports the lock body such that the lock body is rotatable relative to the second shaft, and the lock body is configured to be rotated about an axis of the second shaft relative to the second shaft by the driving force applied by the driving portion to change in position between an engagement position in which the engaged portion is in engagement with the engagement portion and a disengagement position in which the engaged portion is not in engagement with the engagement portion.

9. The working machine according to claim 8, wherein the manipulator base further includes:

a plurality of third operation members to be manipulated to operate a respective plurality of objects, and an operation switching mechanism to switch the objects to be operated by the respective plurality of third operation members, the operation switching mechanism including a third shaft provided in parallel to the first shaft between the first shaft and the second shaft, a plurality of rotary members supported such that the plurality of rotary members are rotatable about an axis of the third shaft relative to the third shaft, and a plurality of link members each of which is rotatably connected to one of the plurality of third operation members and one of the plurality of rotary members in a selectable manner, and the lock body extends from the second shaft to the first shaft via an area located radially outward of one of the plurality of rotary members.

10. The working machine according to claim 9, wherein the lock body further includes a cavity portion in which one of the plurality of rotary members enters without contacting the lock body when the lock body is in the engagement position.

11. The working machine according to claim 9, further comprising:

a traveling device to support the machine body such that the machine body is allowed to travel; and a working device and a dozer device which are supported on the machine body, wherein the manipulator base further includes a plurality of levers to be manipulated to operate the traveling device, the working device, and the dozer device, respectively, and the first operation member is a traveling lever to be manipulated to operate the traveling device, the second operation member is a dozer lever to be manipulated to operate the dozer device, and the third operation member is a manipulation lever to be manipulated to operate the working device, the traveling lever, the dozer lever, and the manipulation lever being included in the plurality of levers.

12. The working machine according to claim 11, wherein the working device includes a boom rotatably connected to the machine body, and an arm rotatably connected to a distal end portion of the boom, the third operation member includes a plurality of manipulation levers to be manipulated to operate the boom and the arm, respectively, and the operation switching mechanism is configured to use each of the plurality of manipulation levers selectively as a boom operation lever manipulated to operate the boom or an arm operation lever manipulated to operate the arm.

13. The working machine according to claim 9, wherein the driving portion includes an interlock portion provided on the first shaft and configured to rotate together with the first shaft, and a linking member connected to the interlock portion and the lock body such that the linking member is rotatable relative to the interlock portion and the lock body, a junction of the interlock portion and the linking member is more distant from the second shaft than the engaged portion of the lock body is, and a junction of the lock body and the linking member is closer to the second shaft than the engaged portion of the lock body is.

14. The working machine according to claim 13, wherein the engagement portion protrudes from a base portion of the first operation member outward in a radial direction of the first shaft and has an engagement groove extending from a distal end of the engagement portion toward the first shaft, the interlock portion protrudes upward and outward in a radial direction of the first shaft, the linking member extends from an area above the first shaft to an area below the first shaft via an area radially outward of the first shaft, the second shaft is disposed lower than the first shaft, the lock body is configured to swing about the axis of the second shaft forward and rearward, and the engaged portion includes a lock pin that protrudes in the width direction of the machine body from an upper end portion of the lock body and is configured to be engaged with and disengaged from the engagement groove.

15. The working machine according to claim 14, wherein the manipulator base further includes:

an arm protrusion portion protruding outward in a radial direction of the first shaft from a position different from a position of the engagement portion on the base portion of the first operation member, a joint rotatably connected to the arm protrusion portion, a rod having one of opposite ends thereof connected to a spool of a control valve, and a relay member including a first threaded connected portion and a second threaded connected portion, the first threaded connected portion being in threaded engagement with a first threaded connecting portion in the joint, the second threaded connected portion being in threaded engagement with a second threaded connecting portion in the other of the opposite ends of the rod, and one of first and second threaded engagement structures has right hand threads and the other of the first and second threaded engagement structures has left hand threads, the first threaded engagement structure being a threaded engagement structure between the first threaded connecting portion and the first threaded connected portion, the second threaded engagement structure being a threaded engagement structure between the second threaded connecting portion and the second threaded connected portion.

16. The working machine according to claim 8, wherein the manipulator base further includes a lock lever to be swung between a first position and a second position, and the driving portion transmits a force of swinging the lock lever as the driving force to the lock body to cause the lock body to change in position between the engagement position and the disengagement position.

17. The working machine according to claim 8, wherein the driving portion includes an actuator to generate the driving force.

18. The working machine according to claim 8, wherein the driving portion includes an interlock portion provided on the first shaft and configured to rotate together with the first shaft, and a linking member connected to the interlock portion and the lock body such that the linking member is rotatable relative to the interlock portion and the lock body, a junction of the interlock portion and the linking member is more distant from the second shaft than the engaged portion of the lock body is, and a junction of the lock body and the linking member is closer to the second shaft than the engaged portion of the lock body is.

19. The working machine according to claim 18, wherein the engagement portion protrudes from a base portion of the first operation member outward in a radial direction of the first shaft and has an engagement groove extending from a distal end of the engagement portion toward the first shaft, the interlock portion protrudes upward and outward in a radial direction of the first shaft, the linking member extends from an area above the first shaft to an area below the first shaft via an area radially outward of the first shaft, the second shaft is disposed lower than the first shaft, the lock body is configured to swing about the axis of the second shaft forward and rearward, and the engaged portion includes a lock pin that protrudes in the width direction of the machine body from an upper end portion of the lock body and is configured to be engaged with and disengaged from the engagement groove.

20. The working machine according to claim 19, wherein the manipulator base further includes:

an arm protrusion portion protruding outward in a radial direction of the first shaft from a position different from a position of the engagement portion on the base portion of the first operation member, a joint rotatably connected to the arm protrusion portion, a rod having one of opposite ends thereof connected to a spool of a control valve, and a relay member including a first threaded connected portion and a second threaded connected portion, the first threaded connected portion being in threaded engagement with a first threaded connecting portion in the joint, the second threaded connected portion being in threaded engagement with a second threaded connecting portion in the other of the opposite ends of the rod, and one of first and second threaded engagement structures has right hand threads and the other of the first and second threaded engagement structures has left hand threads, the first threaded engagement structure being a threaded engagement structure between the first threaded connecting portion and the first threaded connected portion, the second threaded engagement structure being a threaded engagement structure between the second threaded connecting portion and the second threaded connected portion.

* * * * *